US011713935B2

(12) United States Patent
Peterson et al.

(10) Patent No.: US 11,713,935 B2
(45) Date of Patent: Aug. 1, 2023

(54) REDUCED ENERGY MSR SYSTEM

(71) Applicant: Federal Cartridge Company, Anoka, MN (US)

(72) Inventors: Bryan P. Peterson, Isanti, MN (US); Drew L. Goodlin, Isanti, MN (US); Jared Kutney, Cambridge, MN (US); Matthew S. Schroeder, Princeton, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

(21) Appl. No.: 17/472,896

(22) Filed: Sep. 13, 2021

(65) Prior Publication Data

US 2021/0404756 A1 Dec. 30, 2021

Related U.S. Application Data

(63) Continuation of application No. 16/674,925, filed on Nov. 5, 2019, now Pat. No. 11,118,851, which is a (Continued)

(51) Int. Cl.
*F42B 5/30* (2006.01)
*F41A 5/02* (2006.01)

(Continued)

(52) U.S. Cl.
CPC *F41A 5/02* (2013.01); *F41A 3/54* (2013.01); *F41A 3/82* (2013.01); *F42B 5/307* (2013.01); *F41A 11/02* (2013.01); *F42B 8/02* (2013.01)

(58) Field of Classification Search
CPC ..... F42B 5/307; F42B 5/30; B22F 2998/10; B22F 3/225; B22F 3/1025

(Continued)

(56) References Cited

U.S. PATENT DOCUMENTS 517,719 A 4/1894 Aikin
539,327 A 5/1895 Aikin (Continued)

FOREIGN PATENT DOCUMENTS

EP 0131863 B1 9/1988
WO WO2000/034732 A1 6/2000

(Continued)

OTHER PUBLICATIONS

PCT/US17/24361—International Search Report.

(Continued)

*Primary Examiner* — Michael D David

(74) *Attorney, Agent, or Firm* — Reed Smith LLP; Matthew P. Frederick; Travis J. Sumpter

(57) ABSTRACT

A system for firing reduced energy cartridges from a modern sporting rifle utilizes a bolt assembly weighing less than a conventional bolt assembly for such rifles and utilizes blow back for cycling the bolt assembly rather than gas operation. A bolt insert in a polymer bolt carrier of the bolt assembly has a projection that fits within a recess on the rear face of reduced energy cartridges. The reduced energy cartridges having a polymer casing, a rimfire power load for propellant, the power load recessed from the rear face of the casing. Tuning the bolt may comprise adjusting the weight of the bolt or the sliding resistance of the bolt assembly in the upper receiver. The bolt may be formed by metal injection molding with a polymer bolt carrier attached thereto.

20 Claims, 47 Drawing Sheets

Related U.S. Application Data continuation-in-part of application No. 16/141,505, filed on Sep. 25, 2018, now Pat. No. 10,466,022, which is a continuation-in-part of application No. PCT/US2017/024361, filed on Mar. 27, 2017.

(60) Provisional application No. 62/413,065, filed on Oct. 26, 2016, provisional application No. 62/348,258, filed on Jun. 10, 2016, provisional application No. 62/313,563, filed on Mar. 25, 2016, provisional application No. 62/856,146, filed on Jun. 3, 2019.

(51) Int. Cl.

| | |
|---|---|
| ***F41A 3/54*** | (2006.01) |
| ***F42B 5/307*** | (2006.01) |
| ***F41A 3/82*** | (2006.01) |
| *F41A 11/02* | (2006.01) |
| *F42B 8/02* | (2006.01) |

(58) Field of Classification Search
USPC ..... 102/466, 467, 469, 439
See application file for complete search history.

(56) References Cited

U.S. PATENT DOCUMENTS

| | | | |
|---|---|---|---|
| 2,263,941 | A | 11/1941 | Albree |
| 2,294,822 | A | 9/1942 | Albree |
| 2,654,319 | A | 10/1953 | Roske |
| 2,889,749 | A | 6/1959 | Janson |
| 3,026,802 | A | 3/1962 | Barnet et al. |
| 3,060,856 | A | 10/1962 | Dunn |
| 3,099,958 | A | 8/1963 | Daubenspeck et al. |
| 3,144,827 | A | 8/1964 | Boutwell |
| 3,485,170 | A | 12/1969 | Scanlon |
| 3,609,904 | A | 10/1971 | Scanlon |
| 3,745,924 | A | 7/1973 | Scanlon |
| 3,830,157 | A | 8/1974 | Donnard et al. |
| 3,842,739 | A | 10/1974 | Scanlon et al. |
| 3,874,294 | A | 4/1975 | Hale |
| 3,935,816 | A | 2/1976 | Boquette, Jr. |
| 3,977,326 | A | 8/1976 | Anderson et al. |
| 3,990,366 | A | 11/1976 | Scanlon |
| 4,867,065 | A | 9/1989 | Kaltmann et al. |
| 5,033,386 | A | 7/1991 | Vatsvog |
| 5,259,288 | A | 11/1993 | Vatsvog |
| 5,617,664 | A | 4/1997 | Troncoso |
| 5,677,505 | A | 10/1997 | Dittrich |
| 5,907,121 | A | 5/1999 | Fritze |
| 6,357,331 | B1 | 3/2002 | Dionne |
| 6,625,916 | B1 | 9/2003 | Dionne |
| 6,752,084 | B1 | 6/2004 | Husseini et al. |
| 6,779,461 | B1 | 8/2004 | Olson et al. |
| 6,832,556 | B1 | 12/2004 | Smalley, Jr. |
| 6,845,716 | B2 | 1/2005 | Husseini et al. |
| 7,047,686 | B2 | 5/2006 | Zimmermann |
| 7,059,234 | B2 | 6/2006 | Husseini |
| 7,066,092 | B2 | 6/2006 | Olson et al. |
| 7,069,863 | B2 | 7/2006 | Olson et al. |
| 7,204,191 | B2 | 4/2007 | Wiley et al. |
| 7,213,519 | B2 | 5/2007 | Wiley et al. |
| 7,252,038 | B2 | 8/2007 | Olson et al. |
| 7,287,475 | B2 | 10/2007 | Brunn |
| 7,441,504 | B2 | 10/2008 | Husseini et al. |
| 7,503,521 | B2 | 3/2009 | Maynard et al. |
| 7,581,499 | B2 | 9/2009 | Stark et al. |
| 7,610,858 | B2 | 11/2009 | Chung |
| 7,814,820 | B2 | 10/2010 | Menefee |
| 7,921,779 | B1 | 4/2011 | Olson et al. |
| 7,984,668 | B2 | 7/2011 | Huffman |
| 8,028,455 | B1 | 10/2011 | Battaglia |
| 8,056,460 | B2 | 11/2011 | Herring |
| 8,186,273 | B2 | 5/2012 | Trivette |
| 8,240,252 | B2 | 8/2012 | Maljkovic et al. |
| 8,276,519 | B2 | 10/2012 | Menefee, III et al. |
| 8,322,063 | B1 | 12/2012 | Battaglia |
| 8,327,767 | B2 | 12/2012 | Lafortune |
| 8,408,137 | B2 | 4/2013 | Battaglia |
| 8,443,730 | B2 | 5/2013 | Padgett |
| 8,522,684 | B2 | 9/2013 | Davies et al. |
| 8,561,543 | B2 | 10/2013 | Burrow |
| 8,573,126 | B2 | 11/2013 | Klein et al. |
| 8,573,127 | B2 | 11/2013 | Sullivan et al. |
| 8,689,475 | B2 | 4/2014 | Battaglia |
| 8,689,696 | B1 | 4/2014 | Seeman et al. |
| 8,763,535 | B2 | 7/2014 | Padgett |
| 8,800,449 | B2 | 8/2014 | Schluckebier et al. |
| 8,813,650 | B2 | 8/2014 | Maljkovic et al. |
| 8,820,212 | B2 | 9/2014 | Rostocil |
| 8,869,702 | B2 | 10/2014 | Padgett |
| 8,875,633 | B2 | 11/2014 | Padgett |
| 8,925,463 | B1 | 1/2015 | Sullivan et al. |
| 8,978,559 | B2 | 3/2015 | Davies et al. |
| 8,997,653 | B1 | 4/2015 | Calvert |
| 9,003,973 | B1 | 4/2015 | Padgett |
| 9,032,855 | B1 | 5/2015 | Foren et al. |
| 9,052,172 | B2 | 6/2015 | Whitworth |
| 9,091,516 | B2 | 7/2015 | Davies et al. |
| 9,134,102 | B2 | 9/2015 | Flowers |
| 9,182,204 | B2 | 11/2015 | Maljkovic et al. |
| 9,188,412 | B2 | 11/2015 | Maljkovic et al. |
| 9,194,674 | B2 | 11/2015 | Whitworth |
| 9,200,880 | B1 | 12/2015 | Foren et al. |
| 9,212,878 | B2 | 12/2015 | Seeman et al. |
| 9,212,879 | B2 | 12/2015 | Whitworth |
| 9,255,775 | B1 | 2/2016 | Rubin |
| 9,261,335 | B2 | 2/2016 | Padgett |
| 9,322,623 | B2 | 4/2016 | Seeman et al. |
| D755,916 | S | 5/2016 | O'Sullivan |
| 9,335,137 | B2 | 5/2016 | Maljkovic et al. |
| 9,347,752 | B2 | 5/2016 | Blin et al. |
| 9,372,054 | B2 | 6/2016 | Padgett |
| 9,395,163 | B2 | 7/2016 | Fritz |
| 9,395,165 | B2 | 7/2016 | Maljkovic et al. |
| 9,429,407 | B2 | 8/2016 | Burrow |
| 9,441,930 | B2 | 9/2016 | Burrow |
| 9,453,714 | B2 | 9/2016 | Bosarge et al. |
| 9,470,485 | B1 | 10/2016 | Kley |
| 9,500,453 | B2 | 11/2016 | Schluckebier et al. |
| 9,506,735 | B1 | 11/2016 | Burrow |
| 9,513,096 | B2 | 12/2016 | Burrow |
| 9,518,810 | B1 | 12/2016 | Burrow |
| 9,523,563 | B1 | 12/2016 | Burrow |
| 9,528,799 | B2 | 12/2016 | Maljkovic |
| 9,528,805 | B2 | 12/2016 | Seeman et al. |
| 9,546,849 | B2 | 1/2017 | Burrow |
| 9,551,557 | B1 | 1/2017 | Burrow |
| 9,587,918 | B1 | 3/2017 | Burrow |
| 9,587,919 | B2 | 3/2017 | Daniau |
| 9,599,443 | B2 | 3/2017 | Padgett et al. |
| 9,631,907 | B2 | 4/2017 | Burrow |
| 9,644,930 | B1 | 5/2017 | Burrow |
| 9,683,818 | B2 | 6/2017 | Lemke et al. |
| 9,739,579 | B2 | 8/2017 | Beal |
| 9,835,423 | B2 | 12/2017 | Burrow |
| 9,835,427 | B2 | 12/2017 | Burrow |
| 9,869,536 | B2 | 1/2018 | Burrow |
| 9,885,551 | B2 | 2/2018 | Burrow |
| 9,927,219 | B2 | 3/2018 | Burrow |
| 9,933,241 | B2 | 4/2018 | Burrow |
| 9,939,236 | B2 | 4/2018 | Drobockyi et al. |
| 9,939,241 | B2 | 4/2018 | Skiles et al. |
| 9,964,388 | B1 | 5/2018 | Burrow |
| 9,976,840 | B1 | 5/2018 | Burrow |
| 9,982,977 | B2 | 5/2018 | Menefee, III |
| 9,989,343 | B2 | 6/2018 | Padgett et al. |
| 9,995,561 | B2 | 6/2018 | Padgett |
| 10,466,022 | B2 | 11/2019 | Peterson |
| 11,118,851 | B2 | 9/2021 | Peterson et al. |
| 2003/0177896 | A1 | 9/2003 | Dionne |
| 2005/0016414 | A1 | 1/2005 | Leitner-Wise |
| 2007/0214992 | A1 | 9/2007 | Dittrich |
| 2010/0269724 | A1 | 10/2010 | Head et al. |

(56) References Cited

U.S. PATENT DOCUMENTS

| | | | |
|---|---|---|---|
| 2011/0167700 | A1 | 7/2011 | Bozicevic |
| 2011/0179965 | A1 | 7/2011 | Mason |
| 2012/0111219 | A1 | 5/2012 | Burrow |
| 2012/0180648 | A1 | 7/2012 | Sullivan et al. |
| 2012/0199033 | A1 | 8/2012 | Bybee et al. |
| 2012/0240807 | A1 | 9/2012 | Hayes |
| 2013/0055916 | A1 | 3/2013 | Menefee, III |
| 2014/0090573 | A1 | 4/2014 | Huffman |
| 2014/0130699 | A1 | 5/2014 | Peterson et al. |
| 2014/0260925 | A1 | 9/2014 | Beach et al. |
| 2014/0311332 | A1 | 10/2014 | Carlson et al. |
| 2014/0373744 | A1 | 12/2014 | Padgett et al. |
| 2014/0373745 | A1 | 12/2014 | Carlson et al. |
| 2015/0033970 | A1 | 2/2015 | Maljkovic et al. |
| 2015/0040454 | A1 | 2/2015 | Naik et al. |
| 2015/0075400 | A1 | 3/2015 | Lemke et al. |
| 2015/0241183 | A1 | 8/2015 | Padgett et al. |
| 2016/0003588 | A1 | 1/2016 | Burrow |
| 2016/0047612 | A1 | 2/2016 | Sullivan et al. |
| 2016/0069653 | A1 | 3/2016 | Walsh |
| 2016/0069654 | A1 | 3/2016 | Walsh |
| 2016/0091288 | A1 | 3/2016 | Daniau |
| 2016/0131461 | A1 | 5/2016 | Skiles et al. |
| 2016/0131463 | A1 | 5/2016 | Stauffer |
| 2016/0153754 | A1 | 6/2016 | Veschi et al. |
| 2016/0223303 | A1 | 8/2016 | Sloan |
| 2017/0108320 | A1 | 4/2017 | Peterson |
| 2017/0115104 | A1 | 4/2017 | Peterson |
| 2017/0131071 | A1 | 5/2017 | Burkart et al. |
| 2017/0160027 | A1 | 6/2017 | Gangl |
| 2017/0160028 | A1 | 6/2017 | Martinez, Jr. et al. |
| 2017/0184380 | A9 | 6/2017 | Burrow |
| 2017/0299352 | A9 | 10/2017 | Burrow |
| 2017/0307346 | A9 | 10/2017 | Burrow |
| 2018/0010897 | A1 | 1/2018 | Pitre et al. |
| 2018/0031358 | A1 | 2/2018 | Tedde |
| 2018/0364017 | A1* | 12/2018 | Peterson ..... F42B 10/46 |
| 2019/0093996 | A1 | 3/2019 | Peterson |
| 2020/0080803 | A1 | 3/2020 | Peterson et al. |

FOREIGN PATENT DOCUMENTS

| | | | |
|---|---|---|---|
| WO | WO2000/062009 | A1 | 10/2000 |
| WO | 2002065046 | A1 | 8/2002 |
| WO | WO2003/069261 | A1 | 8/2003 |
| WO | WO2004/015359 | A1 | 2/2004 |
| WO | WO2006086527 | A1 | 8/2006 |
| WO | WO2007014024 | A2 | 2/2007 |
| WO | WO2008020884 | A2 | 2/2008 |
| WO | WO2011130550 | A2 | 10/2011 |
| WO | WO2013082557 | A1 | 6/2013 |
| WO | WO2013180739 | A1 | 12/2013 |
| WO | WO2015004561 | A1 | 1/2015 |
| WO | WO2015199786 | A2 | 12/2015 |
| WO | 2017172640 | A3 | 10/2017 |
| WO | WO 2017/172640 | | 10/2017 |

OTHER PUBLICATIONS

EP 17776407.3—Supplementary European Search Report.
International Search Report and Written Opinion for PCT/US20/35228, dated Aug. 19, 2020.

* cited by examiner

REDUCED ENERGY MSR SYSTEM

This application is a continuation of U.S. application Ser. No. 16/674,925, filed Nov. 15, 2019, which is a continuation-in-part of U.S. application Ser. No. 16/141,505, filed Sep. 25, 2018, now U.S. Pat. No. 10,466,022, which is a continuation-in-part of International Patent Application No. PCT/US2017/024361, filed Mar. 27, 2017, which claims the benefit of U.S. Provisional Patent Application No. 62/331,563, filed Mar. 25, 2016, U.S. Provisional Patent Application No. 62/348,258, filed Jun. 10, 2016, and U.S. Provisional Patent Application No. 62/413,065, filed Oct. 26, 2016. the disclosures of which are hereby incorporated by reference herein in their entirety. U.S. application Ser. No. 16/674,925 also claims the benefit of U.S. Provisional Patent Application No. 62/856,146, filed Jun. 3, 2019, the disclosure of which is hereby incorporated by reference herein in its entirety.

BACKGROUND OF THE DISCLOSURE

The modern sporting rifle (MSR), based on the AR-15 platform, is one example of a gas operated firearm. An MSR appears cosmetically similar to military rifles, such as the M-16, but function like other semi-automatic civilian sporting firearms, firing only one round with each pull of the trigger. Gas operated firearms are also used by law enforcement and military organizations. Examples of gas operated firearms include, but are not limited to, AR10, AK-47, AK-74, M14 M16, M16A2, M4, FN SCAR family, M110, MK11, and others. These gas operated rifles have been produced by numerous manufacturers. These weapons, typically shoot, but are not limited to, 5.45 mm, 5.56 mm, 6.8 mm, and 7.62 mm bullets which provide very high bullet velocities.

These gas operated type rifles utilize either a direct gas impingement system or a gas and push rod system for operating their ejection and loading mechanisms, in an automatic mode and a semi-automatic mode. The expanding gas from the cartridge propellant is tapped from a port in the barrel intermediate the chamber and the muzzle end of the barrel. In the direct gas impingement system, a conduit extends from the port to the upper receiver and into the region of the bolt carrier. In the gas and pushrod system, the gas impinges against the push rod which extends to the upper receiver and into the region of the bolt carrier. During the initial firing of the cartridge, the bolt is locked into the barrel extension, the gas forces the bolt carrier backward a short distance to unlock the bolt. As the bolt carrier moves toward the butt of the gun, a bolt cam pin, forces the bolt to rotate, by this time the bullet has left the barrel. The inertia of the bolt and bolt carrier continues the rearward motion causing the bolt to extract the fired empty cartridge. A spring absorbs the rearward motion of the bolt and bolt carrier forcing the bolt and bolt carrier forward to engage the next cartridge in the magazine and push same into the chamber ready for firing.

The gas pressures for operating the gas operated style weapons are significant and with the 5.56 mm cartridges the exit velocities, typically in excess of 2700 feet per second (fps), substantially exceeding the sound barrier (about 1,126 fps). Associated with these velocities are high bullet travel distances, in excess of 2 miles, and high noise levels, including from the bullet breaking the sound barrier and generating shock waves that cannot be effectively suppressed.

Modifications have been developed for these gas operated weapons to shoot low mass rounds at low velocities that utilize telescoping cartridges-practice ammunition. Typically the cartridges have very low mass, compared to lethal rounds, and may also have frangible projectiles with marking media. The modifications include a bolt and bolt carrier modification that allows the bolt to retract entirely by the propulsion of the expanding telescoping cartridge with no assist from the gas port, effectively changing the function of the weapon from a direct gas impingement system to a direct blowback system. The bolt does not lock into place rearward of the chamber. The energetics in these cartridges is low compared to a normal lethal round and the rounds are relatively expensive.

A need remains for a system that implements a cartridge that fires projectiles at subsonic muzzle velocities, to be used with a modern sporting rifle that has energy levels in a mid energy range that may be used for hunting small game or target practice, that is not supersonic, and that does not have the distance range or energy levels of conventional cartridges, but still allows the modern sporting rifles to reliably cycle.

SUMMARY

In various embodiments of the disclosure, a rifle system is disclosed suitable for delivery of projectiles at a reduced energy level relative to standard cartridges used in MSR systems. Standard cartridges deliver projectiles at muzzle energies typically in a range of 1200 foot-pounds force (ft-lbf) to 1400 ft-lbf. Herein, unless otherwise stated, a "reduced" energy level less than 70% of the standard energy level. Such energy levels include a so-called "mid energy" level, which, unless otherwise stated, is defined herein as delivering a projectile at a muzzle energy that is in a range from 50 foot-pounds force (ft-lbf) to 400 ft-lbf inclusive. Reduced energy levels also include mid- to low-energy level, which is herein defined as a projectile muzzle energy in a range of 15 ft-lbf to 250 ft-lbf inclusive. Herein, a range that is said to be "inclusive" includes the end point values of the range as well as all values between the end point values. Such reduced energy levels include both lethal and non-lethal rounds.

The mid energy and mid- to low-energy levels may be tailored to produce subsonic muzzle velocities of the projectile. Subsonic velocities can substantially reduce the noise associated with discharge of a firearm because of the absence of shock waves that are generated by the projectile at sonic or supersonic muzzle velocities. Accordingly, in some embodiments of the disclosure, the sound generated by the MSR can be effectively suppressed so that, in combination with standard silencer technology, the MSR can be operated without hearing protection.

In embodiments, a conversion kit is provided for a gas operated modern sporting rifle that is originally built to fire centerfire rimless necked cartridges to fire rimless necked cartridges of the same exterior casing form factor but utilizing a rimfire propellant unit that is fixed in a recess in the rear face of the cartridge and that is spaced forward in the recess. In embodiments such cartridges have a projectile that weighs from 40 grains to 100 grains. In embodiments, the entirety of the propellant for firing the cartridge projectile and for cycling the modern sporting rifle by direct blowback is provided by the rimfire propellant unit. In embodiments, the conversion kit includes a conversion bolt assembly to replace the original bolt and bolt carrier. The bolt assembly including a non-locking bolt with a bolt face that confronts and abuts the rearwardly most circular face of the rimless necked cartridges and that further has a rigid projection that extends into the recess to confront and engage the rearward surface of the rimfire propellant unit. An offset firing pin extends through a hole positioned near a periphery of the projection such that actuation of the firing pin engages the rim of the rimfire propellant unit. The conventional bolt assembly cannot fire the new ammunition in that the projection on the bolt precludes the bolt from going into an in-battery position with conventional centerfire necked cartridges and the offset firing pin precludes the firing pin from striking a centerfire primer.

In embodiments, the bolt may be formed of stainless steel by way of metal injection molding, providing an economical manufacturing method that is significantly less expensive than the conventional machining of the bolt. Utilization of a polymer bolt carrier accommodates the lack of close tolerances typically inherent in metal injection molding. The polymer to metal engagement of the bolt carrier and bolt does require the close tolerances of a metal bolt to metal bolt carrier. In embodiments, the bolt may be press fit into an injection molded polymer bolt carrier and may be retained therein by, for example a conventional roll pin extending transverse to the axis of travel of the bolt assembly.

The inventors have recognized that retention between the polymer bolt carrier and metal bolt may be enhanced by utilization of a series of recesses or divots along lengthwise extending surfaces of the bolt. The divots advantageously can also reduce the weight of the bolt. Such divots may form serrations that enhance the robustness of the interface between the polymer bolt carrier and the bolt. The enhancement of the robustness of the interface is applicable particularly where there is an interference fit between the polymer bolt carrier and the bolt and the bolt is forced into the polymer bolt carrier. The serrations and/or divots providing gripping teeth engaging the polymer of the bolt carrier. The enhancement of the robustness of the interface is further applicable where the polymer bolt is overmolded onto the bolt such that the molten polymer will fill the divots or serrations locking the polymer bolt carrier to the bolt.

In embodiments, a flange extends radially outward from the metal bolt to abuttingly engage a forward face of the polymer bolt carrier. This flange may provide further fixation of the polymer bolt carrier with respect to the bolt and enhance the robustness of the engagement between the bolt carrier and the bolt. The flange may absorb forward forces of the bolt carrier as the bolt assembly cycles into an in-battery position. The flange minimizes or eliminates shear forces between the bolt and bolt carrier along axially extending interfaces between the bolt and bolt carrier as the bolt assembly cycles that could otherwise affect a loosening of the bolt and bolt assembly interface after many cycles. The flange and receiver may cooperate to provide a surface that the forward face of the flange engages with a portion of the receiver or a barrel extension simultaneously as the front face of the bolt engages the barrel face. The flange may be configured as a tab extending outwardly at only an upper portion of the bolt. Such a tab configuration facilitates the metal injection molding of the bolt minimizing complexity of the mold.

Other components of the bolt assembly, for example the ejector and extractor, may also be formed by metal injection molding.

In conventional prior art conversion kits for converting modern sporting rifles to fire practice ammunition, the recoil spring is replaced by a spring with a lesser spring constant. In embodiments, a conversion kit can include components allowing "tuning" of the bolt assembly for reliable cycling without replacing the original recoil spring. Such components may include and assortment of weights that may be added to the bolt assembly, in particular, such weights may be added to the bolt carrier by the end user to adjust the reciprocating mass and to facilitate reliable cycling with the existing spring. In embodiments, a conversion kit may include an assortment of such weights and one or more replacement springs allowing the conversion of different brands and models of modern sporting rifles.

The inventors have recognized that conventional bolt assemblies utilize metal to metal bearing surfaces between the bolt assembly and the upper receiver and converting the metal bolt carrier to a polymer then provides a polymer to metal bearing surface with differing characteristics. Depending on the specific polymer, the engagement surface areas, and the amount of usage, that is the number or rounds fired, the bolt carrier polymer bearing surfaces may wear faster than the conventional metal bolt carriers and may provide different friction characteristics. A feature and advantage of embodiments is a bearing insert in the polymer bolt carrier that provides a bearing surface of a material other than the primary injection molded polymer of the polymer bolt carrier. Such inserts may be formed of a metal, for example, that will provide better wear surface and a similar or same friction characteristics as metal bolt carriers. The inserts may be attached to the polymer bolt carrier after molding or they may be placed in the polymer bolt carrier mold prior to injecting the molten polymer into the bolt carrier mold. In embodiments, the bearing inserts may have an adjustment capability such as a threaded member to vary engagement pressure between the bearing insert and receiver bearing surfaces. Such adjustment can provide adjustment of a "tuning" variable to optimize the smooth and reliable cycling of the firearm. In embodiments bearing surface adjustments may also be made to polymer pieces for adjusting the friction and spacing with respect to the bolt assembly and receiver. In embodiments, the bearing inserts can be a replaceable component. In embodiments, tuning may be a slidability adjustment at the receiver for adjusting the relative engagement force between the bolt assembly and the receiver thereby adjusting the relative friction and the slidability.

In conventional bolt assemblies for modern sporting rifles, specifically the AR15, the bolt assembly may be disassembled, in embodiments the conversion bolt and bolt carrier can be integrated to discourage or prevent any such disassembly minimizing consumer issues associated with incorrect reassembly.

The conversion kit may also include instructions for accomplishing the conversion and also instructions for the "tuning" of the new bolt assembly for obtaining reliable cycling of the mechanism. For example, utilizing attachable weights to attach to the bolt carrier, different springs, and bolt carrier bearing inserts, and adjustment of bearing inserts where adjustable.

In embodiments the rimless, necked cartridges utilizing exclusively a 22 caliber projectile weighs 28 grains to 85 grains. In embodiments the projectile weighs 25 grains to 65 grains.

In the disclosed embodiments, the reduced energy cartridges includes a polymer case. The polymer case provides a substantial reduction in the weight relative to conventional metallic casings. The reduction in weight is a substantial factor when considering the shipping and handling of bulk supplies of the cartridges, for example for shipping from supplier to user, in construction of storage and display facilities at the point of purchase, or in the consideration of supply logistics for military applications. Material costs (polymer vs. metals) may also be substantially reduced.

A consideration in the design of polymer-based cartridges is material strength. The firing chambers of many firearms do not support the perimeter of the cartridge near the base, in order to allow clearance for bolt operation and extraction mechanisms. (The unsupported region of the base of the cartridge is illustrated, for example, at FIG. 21A of the present disclosure.) Accordingly, polymer cartridges are prone to failure in the form of rupture or fragmentation near the base of the cartridge.

To address this concern, some embodiments of the disclosure include a reinforcement liner that provides support to the unsupported region of the cartridge. In some embodiments, the reinforcement liner lines the inner diameter of the cartridge case at the base. In some embodiments, a portion of the reinforcement liner is imbedded within an annular region of the polymer wall of the cartridge. The length of the reinforcement liner may be tailored to provide the necessary overlap with the supported regions of the cartridge, based on the power level of the cartridge. That is, the reinforcement liners for higher power rounds may have a greater length than for lower power rounds, to provide more overlap with the supported portion of the cartridge which enhances the strength of the bridging of the unsupported portion.

The reinforcement liner may be secured within the polymer casing by a process wherein the polymer case is overmolded onto the reinforcement liner. Various features and geometries also secure the reinforcement liner within the overmolded polymer case.

Structurally, in various embodiments of the disclosure, a reduced energy cartridge comprises a polymer case including: a sleeve portion defining a first outer diameter, the body portion including a base portion defining a base lumen; a neck portion defining a second outer diameter that is less than the first outer diameter, the neck portion defining a neck lumen; and a frustoconical portion extending between the body portion and the neck portion. A projectile includes a first portion disposed within the neck lumen and a second portion extending forwardly beyond the polymer case. A reinforcement liner is disposed within the base lumen, the reinforcement liner defining a sleeve lumen. A propellant unit is disposed in within the sleeve lumen, the propellant unit including: a housing defining a cavity; a propellant charge disposed inside the cavity for producing a quantity of propellant gas; and a priming material disposed inside the cavity for igniting the propellant.

In various embodiments of the disclosure, a reduced energy cartridge, comprises a polymer case having a polymer case wall, the polymer case including: a sleeve portion defining a first outer diameter, the body portion including a base portion defining a base lumen; a neck portion defining a second outer diameter that is less than the first outer diameter, the neck portion defining a neck lumen; and a frustoconical portion extending between the body portion and the neck portion. A projectile includes a first portion disposed within the neck lumen and a second portion extending forwardly beyond the neck portion of the polymer case. A reinforcement liner includes a sleeve portion at least partially imbedded annularly within the polymer case wall of the body portion and a flange portion extending rearwardly beyond the base portion of the polymer case. A propellant unit is disposed in within the base lumen, the propellant unit including: a housing defining a cavity; a propellant charge disposed inside the cavity for producing a quantity of propellant gas; and a priming material disposed inside the cavity for igniting the propellant.

In some embodiments, the polymer case is an injection molded case that is simultaneously overmolded onto the reinforcement liner and the projectile. An outer surface of the sleeve portion of the reinforcement liner may include texturing for enhanced coupling between the polymer case and the reinforcement liner. In some embodiments, the propellant unit is a rim fire blank, for example a .22 caliber power load. In some embodiments, the polymer case defines a forward cavity portion having a first diameter and a rearward cavity portion having a second cavity diameter that is smaller than the first cavity diameter so that polymer case wall includes a step portion where the rearward cavity portion meets the forward cavity portion. The polymer case may define a plurality of longitudinal flutes. In various embodiments, a tangentially extending relief groove is defined on an inner surface of the base portion adjacent the propellant unit. The tangentially extending relief groove is continuous.

In various embodiments of the disclosure, a method of fabricating a cartridge having a polymer case comprises: disposing a projectile in a first aperture defined by a mold; disposing a reinforcement liner in a second aperture defined by the mold; and, after disposing the projectile and the reinforcement liner into the mold, injecting a polymer into the mold. In some embodiments, prior to injecting the polymer into the mold, a pull core is inserted through the second aperture to register against a base of the projectile that is disposed in the first aperture. During the step of inserting the pull core through the second aperture, the pull core may be inserted through the reinforcement liner. In some embodiments, the pull core is removed after the polymer is set. In some embodiments, the pull core is removed after the polymer is cured. In various embodiments, prior to injecting the polymer into the mold, a fitting is positioned at a proximal end of the pull core, the fitting and the pull core cooperating to define a diaphragm gate, wherein the step of injecting the polymer is performed through the diaphragm gate. In some embodiments, the pull core includes a protrusion that forms a relief groove on an interior wall of the polymer case upon injection of the polymer. The relief groove may extend tangentially, and may be continuous. The relief groove may be formed on the polymer case distal to the reinforcement liner.

In various embodiments of the disclosure, a system comprises a gas operated modern sporting rifle (MSR), at least one reduced energy cartridge sized to conform to one of the .223 Remington, a 5.56×45 mm NATO cartridge, 7.62×51 mm NATO cartridge, and a 7.62×39 mm cartridge size having a polymer case and a .22 caliber rim fire power load for a propellant, and a replacement bolt assembly configured to allow a plurality of the reduced energy cartridges to be fired from the modern sporting rifle and cycled through the modern sporting rifle by blowback operation of the replacement bolt assembly. In an embodiment, the replacement bolt assembly moves the low energy cartridge into the chamber and extracts a casing of the low energy cartridge from the chamber after a projectile of the low energy cartridge has been fired through a barrel of the modern sporting rifle. In an embodiment, the modern sporting rifle comprises a upper receiver and a barrel extending forwardly from a forward end of the upper receiver, and the reduced energy cartridge comprises a projectile that is dimensioned to be received in a bore of the barrel.

In various embodiments of the disclosure, a reduced energy cartridge comprises a polymer case having a polymer case wall. The polymer case has a sleeve portion having a first outer diameter, a neck portion having a second outer diameter that is less than the first diameter, and a frusto-conical portion extending between the body portion and the neck portion. A projectile of the cartridge has a first portion disposed inside a lumen defined by the neck portion of the polymer case and a second portion extending forwardly beyond the polymer case. A propellant unit is disposed in a lumen defined by a base of the polymer case. The propellant unit comprises a housing defining a cavity, a propellant charge disposed inside the cavity for producing a quantity of propellant gas and a priming material disposed inside the cavity for igniting the propellant. The propellant unit may be a rim fire blank, such as a .22 caliber power load, such as used in construction. In an embodiment, the propellant charge is sized to fire the projectile at a velocity of less than 1125 feet per second. The polymer case defines a forward cavity portion having a first diameter and a rearward cavity portion having a second cavity diameter that is smaller than the first cavity diameter so that polymer case wall includes a step portion where the rearward cavity portion meets the forward cavity portion. The step portion of the polymer case wall has an annular surface that is substantially orthogonal to a longitudinal axis of the polymer case so that propellant gas produced upon ignition of the propellant charge acts on the annular surface to produce a substantially rearward ejecting force on the polymer case. In an embodiment, the first cavity diameter is between 4.0 mm and 8.0 mm. In an embodiment, the second cavity diameter is between 2.0 mm and 7.0 mm. In an embodiment, the first outer diameter is between 8.9 mm and 9.1 mm. In an embodiment, the second outer diameter is between 6.2 mm and 6.4 mm.

In some embodiments of the disclosure, the polymer case has a plurality of longitudinal flutes. The flutes provide a reduced surface contact area in the chamber for reduced extraction force.

Additionally, the flutes provide a thin-walled casing section that may deform with the expansion of the forward portion of a .22 caliber power load inserted in the rearward end of the casing, thus locking the power load into the casing, preventing the power load from moving rearwardly with respect to the casing upon firing. The casing may otherwise be thinned at the region corresponding to the region of the power load that expands to receive and facilitate the radial expansion of the power load and to allow deformation of the polymer at said region effecting the locking of the polymer casing to the power load.

In some embodiments of the disclosure, a rim fire propellant unit expands upon firing to lock the primer to the polymer casing.

In embodiments utilizing a rimfire primer as a propellant unit, such as a power load, the exterior of the propellant unit is secured to the inwardly facing wall of the polymer casing with an adhesive.

A feature and advantage of some embodiments of the disclosure is a round which is quieter and does not create a sonic boom when fired to provide superior covert and stealth capabilities.

A feature and advantage of some embodiments of the disclosure is reduced projectile energy allowing for use in backyards, basements, training facilities, hunting small game, and the like.

A feature and advantage of some embodiments of the disclosure is low cost conversion of a modern sporting rifle to fire the cartridges described in the detailed description.

A feature and advantage of some embodiments of the disclosure is reduced wear to a modern sporting rifle firing the cartridges described in the detailed description.

A feature and advantage of some embodiments of the disclosure is reduced recoil (compared to standard cartridges) when the cartridges described in the detailed description are fired from a modern sporting rifle.

A feature and advantage of some embodiments of the disclosure is the suitability of a modern sporting rifle firing the cartridges described in the detailed description for use when hunting small game.

A feature and advantage of some embodiments of the disclosure is that standard modern sporting rifle magazines may be used in combination with the replacement bolt assemblies and cartridges described in the detailed description.

A feature and advantage of some embodiments of the disclosure is the ability to fire low energy cartridges having an amount of propellant that would not create sufficient gas pressure for operation of gas-operated reloading mechanism of a modern sporting rifle.

A feature and advantage of embodiments is providing a low-cost cartridge capable of cycling modern sporting rifles, that has providing economical A feature and advantage of some embodiments of the disclosure is the ability to quickly and easily convert a modern sporting rifle back to firing regular full energy ammunition.

DETAILED DESCRIPTION

Figure 1A:
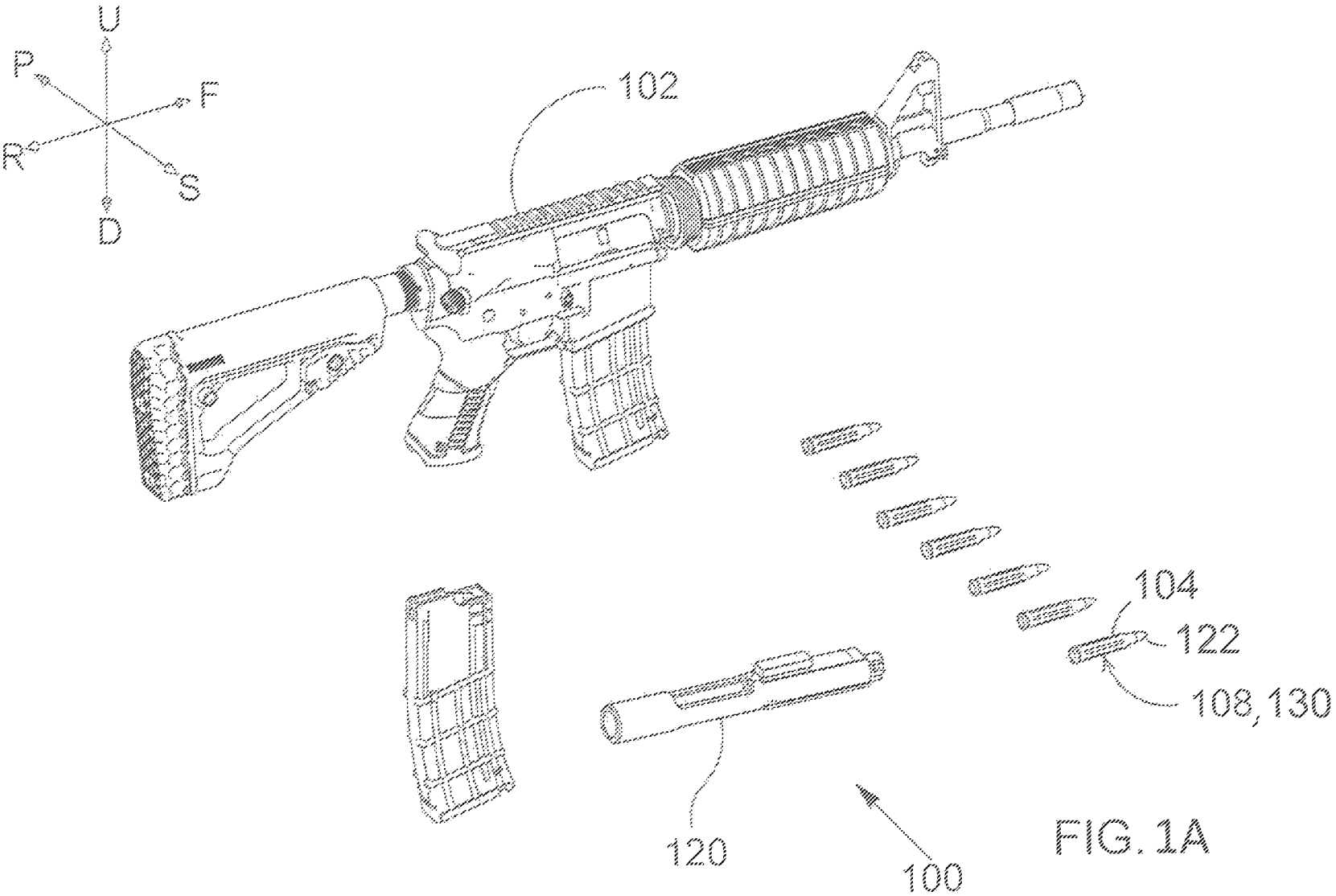
FIG. 1A is a perspective view of a modern sporting rifle (MSR) system according to an embodiment of the disclosure.
Figure 1B:
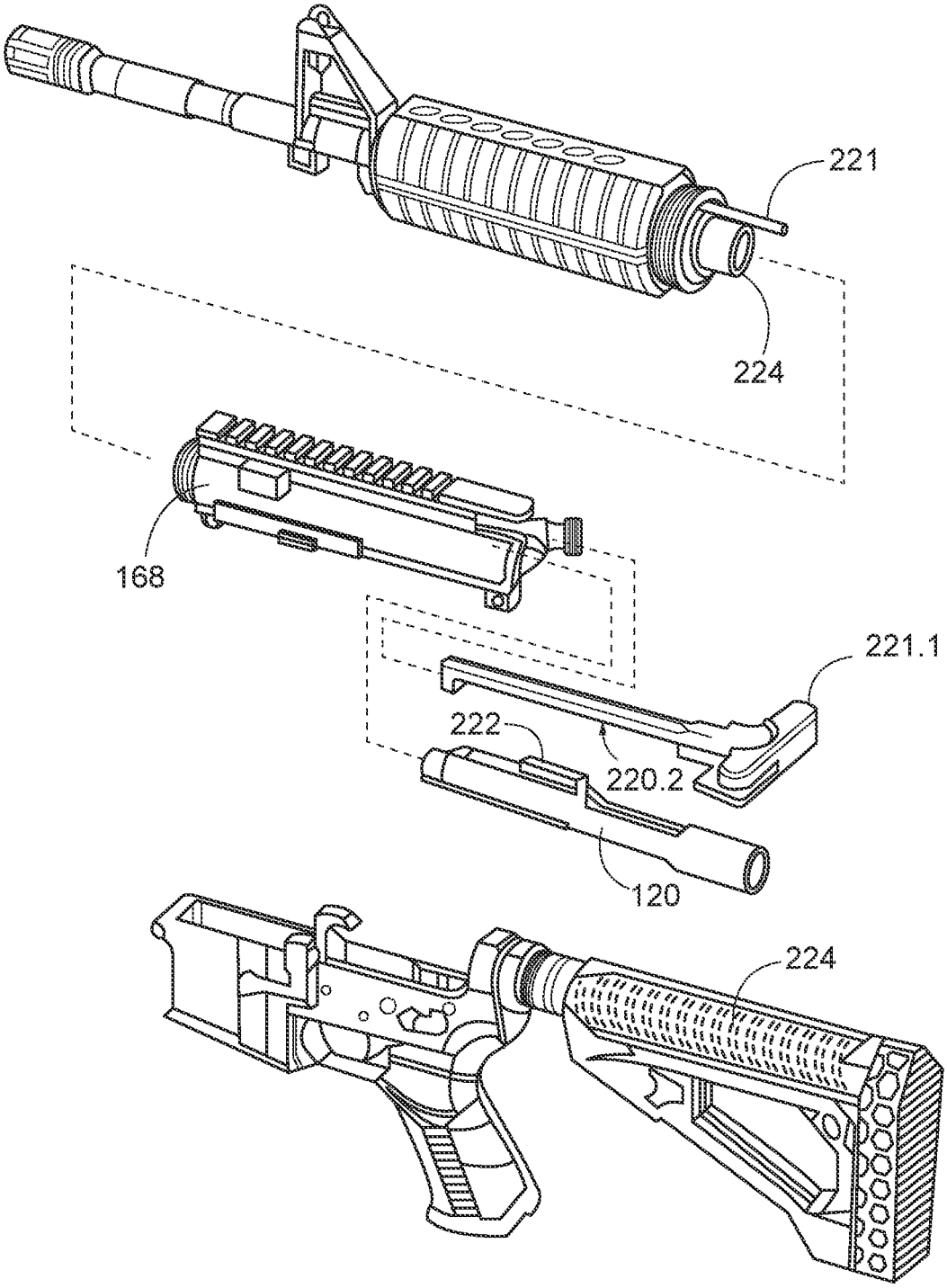
FIG. 1B is an exploded view of a modern sporting rifle including a replacement bolt assembly according to an embodiment of the disclosure.
Figure 1C:
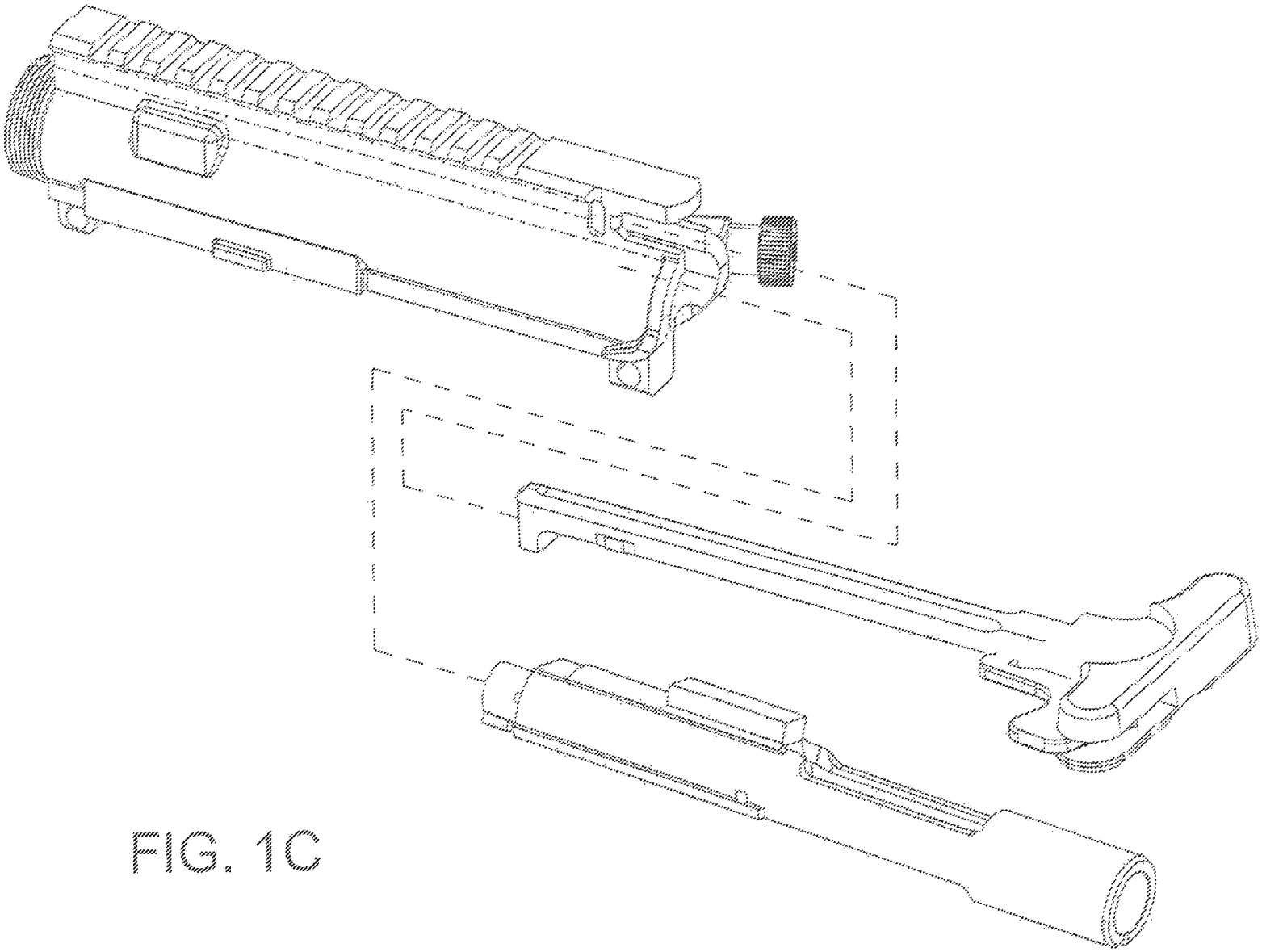
FIG. 1C is an exploded view of an assembly including a replacement bolt assembly according to an embodiment of the disclosure.
Figure 1D:
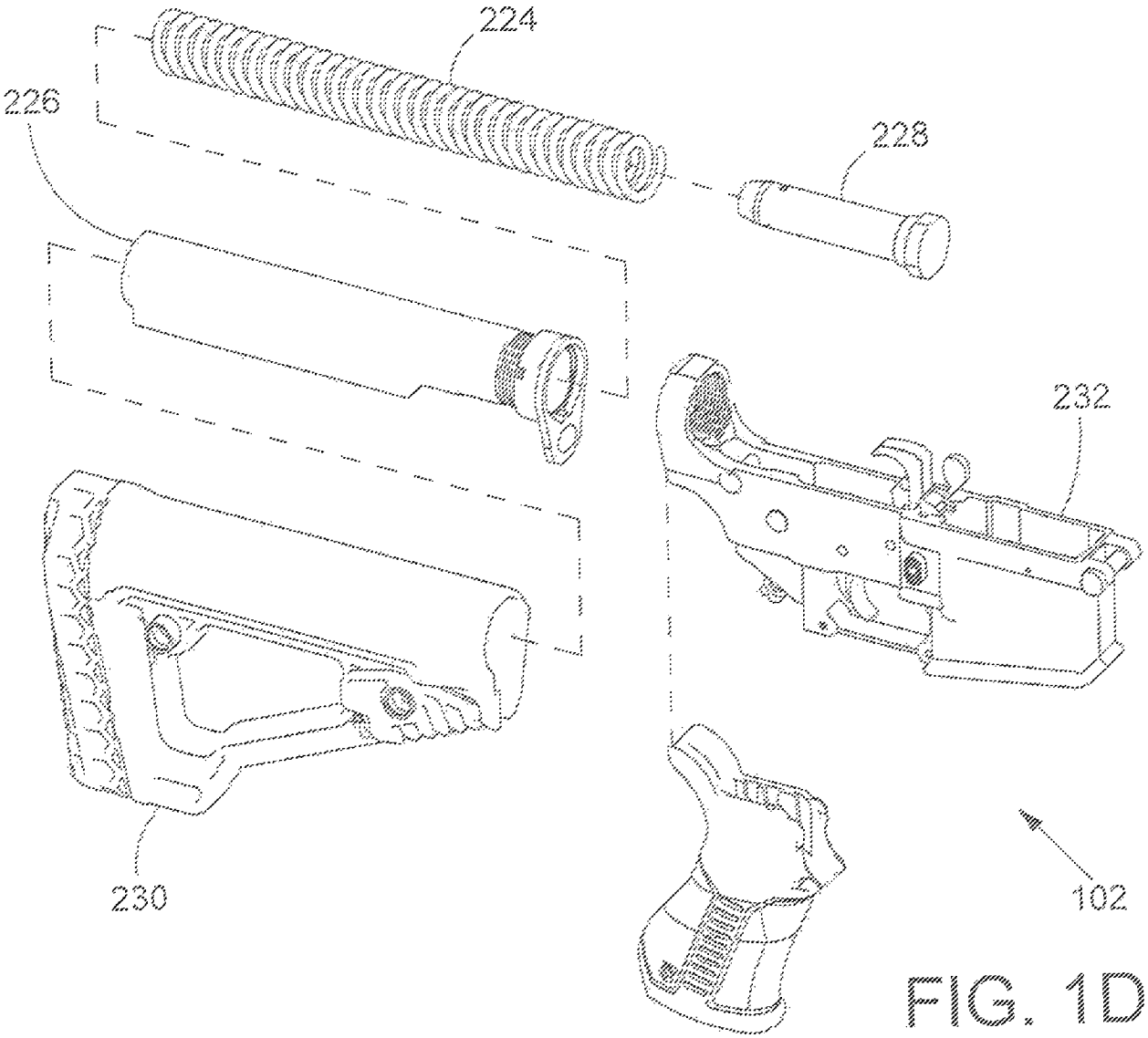
FIG. 1D is an exploded view of a stock and trigger housing according to an embodiment of the disclosure.

Referring to FIG. 1A-1D, a rifle system 100 is depicted according to an embodiment of the disclosure. The rifle system 100 includes a gas operated modern sporting rifle 102, reduced energy cartridges 108 having polymer cases 104, and a replacement bolt assembly 120 configured to allow a plurality of reduced energy cartridges 108 to be fired from the modern sporting rifle 102 and cycled through the modern sporting rifle 102 by blowback operation of the replacement bolt assembly 120. In some embodiments, the replacement bolt assembly 120 moves the reduced energy cartridge 108 into the chamber and extracts a polymer case 104 of the reduced energy cartridge 108 from the chamber after a projectile 122 of the reduced energy cartridge 108 has been fired through a barrel 126 of the modern sporting rifle 102. In some embodiments, the modern sporting rifle 102 comprises a upper receiver 124 and a barrel 126 extending forwardly from a forward end of the upper receiver 124, and the reduced energy cartridge 108 comprises a projectile 122 that is dimensioned to be received in a bore of the barrel 126. In one embodiment, the reduced energy cartridges 108 may be of the .223 Remington size with a reduced amount of propellant charge 106.

Orientations are keyed from a firearm in a normal firing position and are applicable throughout this application. The various directions are illustrated in FIG. 1A. An upward direction U and a downward or lower direction D are illustrated using arrows labeled "U" and "D," respectively. A forward direction F and a rearward direction R are illustrated using arrows labeled "F" and "R," respectively, in FIG. 1. A starboard direction S and a port direction P are illustrated using arrows labeled "S" and "P," respectively. Various direction-indicating terms are used herein as a convenient way to discuss the objects depicted in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portly," and "starboardly," should not be interpreted to limit the scope of the invention recited in the attached claims.

Figure 2B:
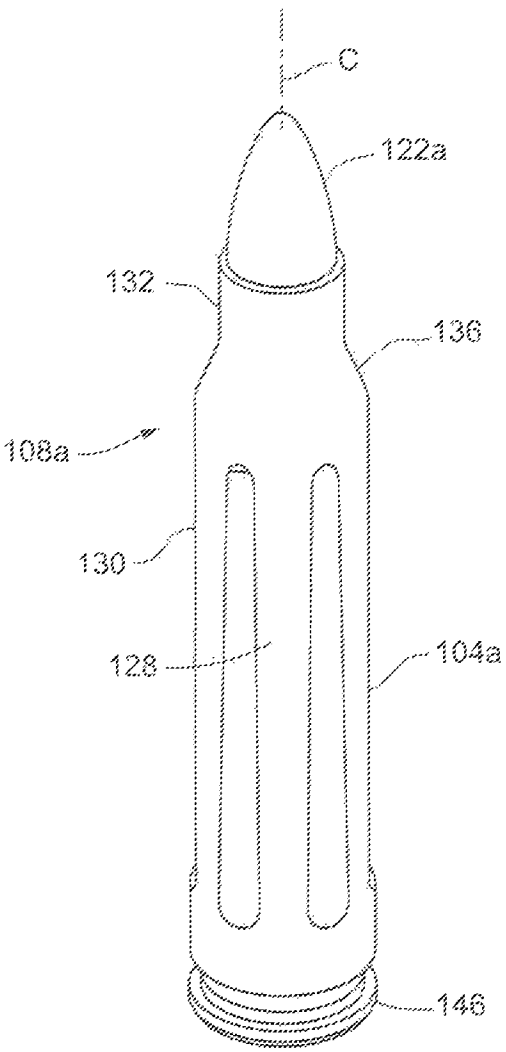
FIG. 2B is a perspective view of the cartridge depicted in FIG. 2A.
Figure 2A:
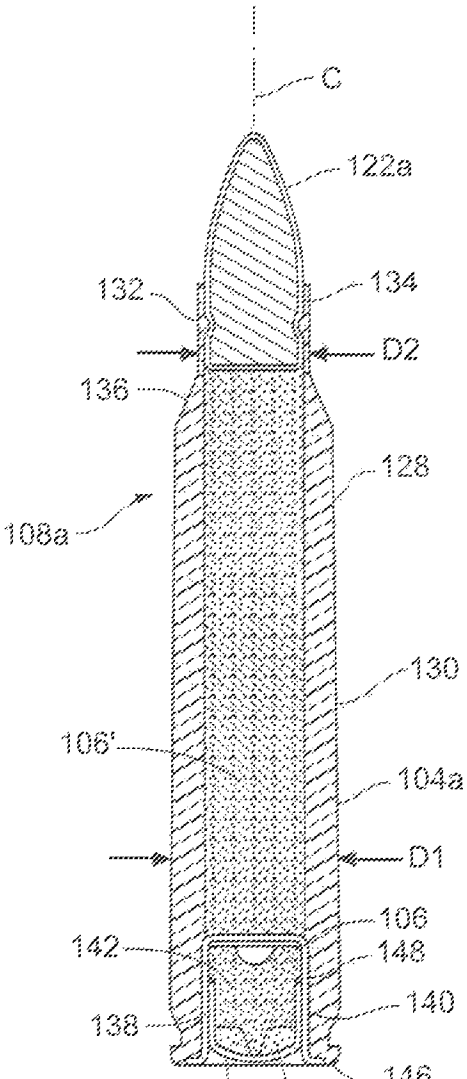
FIG. 2A is a cross-sectional view of a cartridge according to an embodiment of the disclosure.
Figure 3:
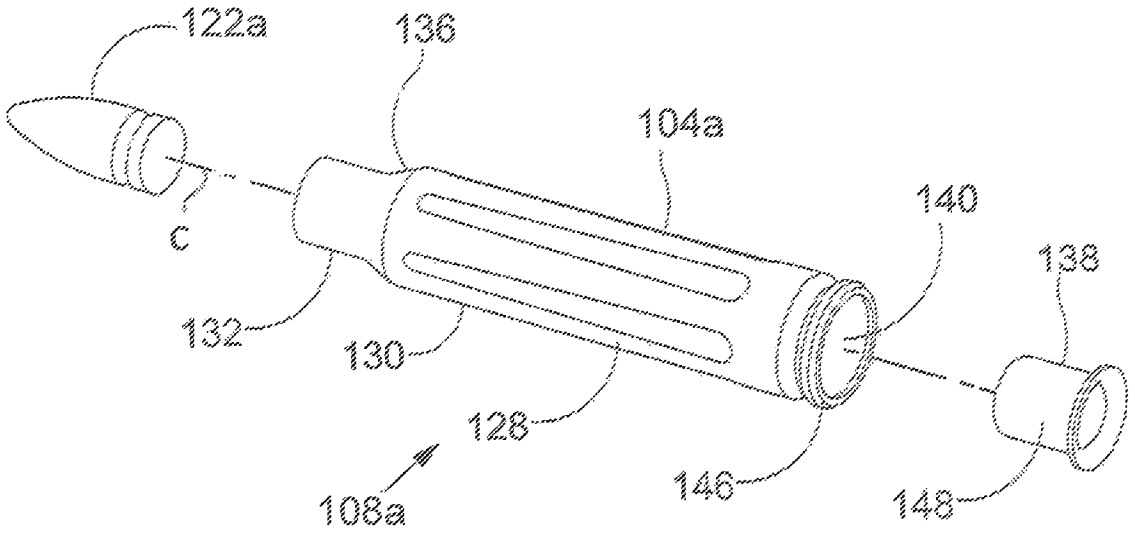
FIG. 3 is an exploded perspective view of the cartridge depicted in FIG. 2A and FIG. 2B.
Figure 4C:
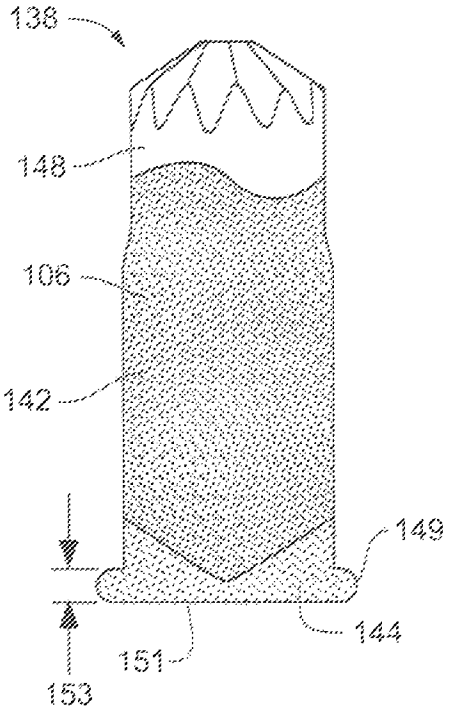
FIG. 4C is an elevational, partial cross-sectional view of a propellant unit of the cartridge depicted in FIG. 4A
Figure 4B:
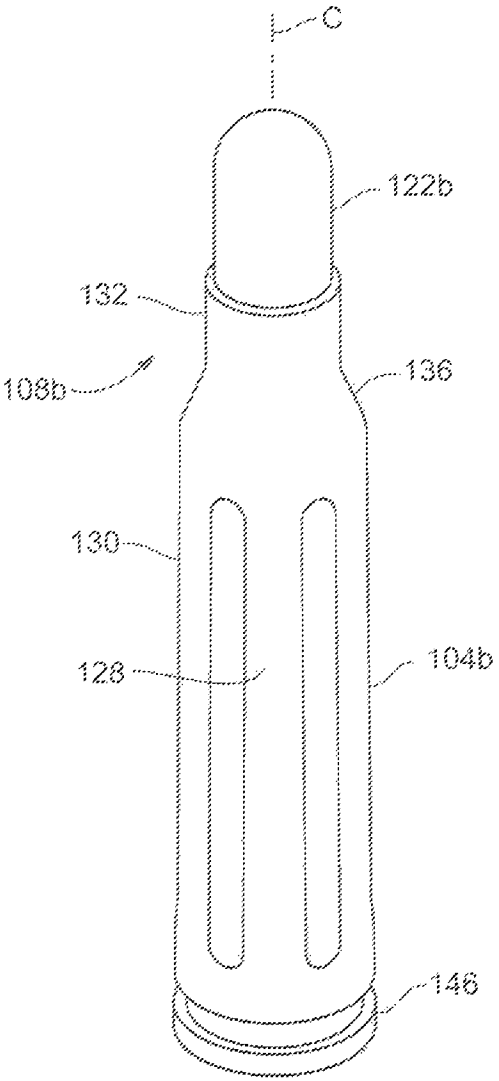
FIG. 4B is a perspective view of the cartridge depicted in FIG. 4A.
Figure 4A:
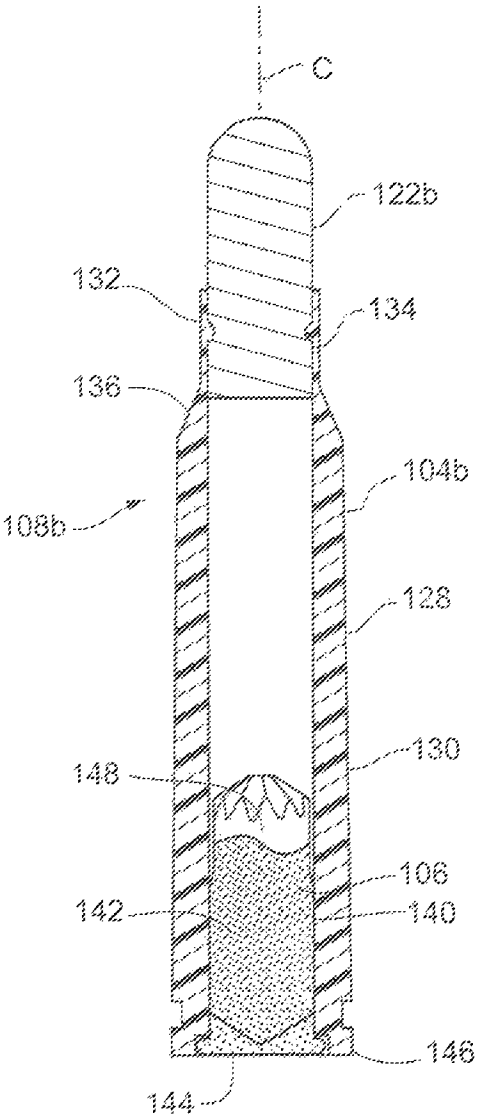
FIG. 4A is a cross-sectional view of a cartridge according to an embodiment of the disclosure.
Figure 5:
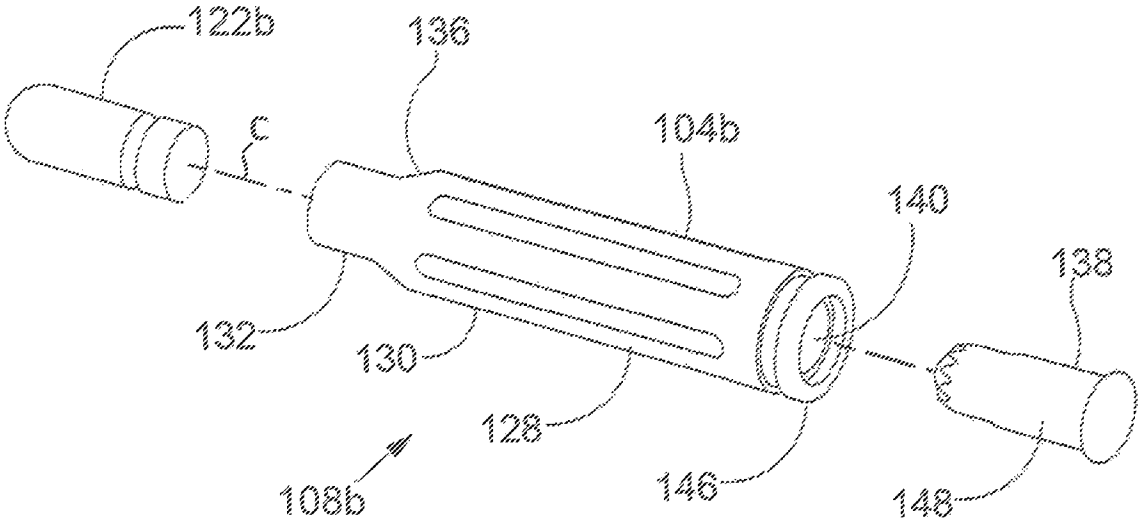
FIG. 5 is an exploded perspective view of the cartridge depicted in FIG. 4A and FIG. 4B.

Herein, the reduced energy cartridges are referred to collectively and generically by reference character 108, with specific configurations referred to by the reference character 108 followed by a letter suffix (e.g., reduced energy cartridge 108*a* at FIG. 2A). Likewise, polymer cases and projectiles are referred to collectively and generically by reference characters 104 and 122, respectively, with specific configurations referred to the reference characters 104 and 122 followed by a letter suffix (e.g., projectile 122*a* and polymer case 104*a* at FIG. 2A).

In some embodiments, standard modern sporting rifle magazines may be used in combination with the replacement bolt assembly 120 and the reduced energy cartridges 108. The system 100 may include and be used with various firearms without deviating from the spirit and scope of the present detailed description. Embodiments of system 100 may include and be used with handguns and/or rifles. Embodiments of system 100 may include and be used with gas operated firearms and/or non-gas-operated firearms. Examples of gas operated firearms include, but are not limited to, AR10, AK-47, AK-74, M14, M16, M16A2, M4, FN SCAR family, M110, MK11, and others.

Referring to FIGS. 2A through 8, reduced energy cartridges 108 are depicted according to embodiments of the disclosure. In the depicted embodiments, the polymer cases have a generally cylindrical body portion 130 with a polymer case wall 128. The cylindrical body portion includes a first outer diameter D1, a neck portion 132 having a second outer diameter D2 that is less than the first diameter D1, and a frustoconical portion 136 extending between the body portion 130 and the neck portion 132. Projectiles 122 of the reduced energy cartridges 108 include a first portion disposed inside a neck lumen 134 defined by the neck portion 132 of the polymer case 104 and a second portion extending forwardly beyond the polymer case 104. The projectiles 122 may be of standard shapes known to the artisan (e.g., projectile 122*a* at FIG. 2A having a substantially pointed tip, or projectile 122*b* of FIG. 4A having a radiused tip).

A propellant unit 138 is disposed in a base lumen 140, the base lumen 140 being defined by a base 146 of the polymer case 104. The propellant unit 138 includes a housing 148 having an anvil 151 and defining a cavity 142. A propellant charge 106 is disposed inside the cavity 142, and a priming material 144 disposed inside the cavity 142 for igniting the propellant charge 106. In some embodiments, supplemental propellant 106' is disposed within the polymer case 104 outside the propellant unit (FIGS. 2A, 6A, and 6B). In some embodiments, the housing 148 of the propellant unit 138 includes a body portion 147 and a hollow rim portion 149 that cooperate to define the cavity 142 (e.g., FIG. 4C). The quantity of propellant charge 106 disposed inside the cavity 142 may be sized to produce an estimated quantity of propellant gas.

In some embodiments, the propellant charge 106, 106' is sized to fire the projectile 122 at a velocity of less than 1125 feet per second. In certain embodiments, the propellant unit 138 contains the entire energetic load for launching the projectile 122 and operating the ejection mechanism of the modern sporting rifle 102. In some embodiments, the reduced energy cartridge 108 may include supplemental propellant 106' disposed in one or more cavities defined by the polymer case 104 (e.g., as depicted for polymer cases 104*a*, 104*c*, and 104*d* of FIGS. 2A, 6A, and 6B).

Figure 6C:
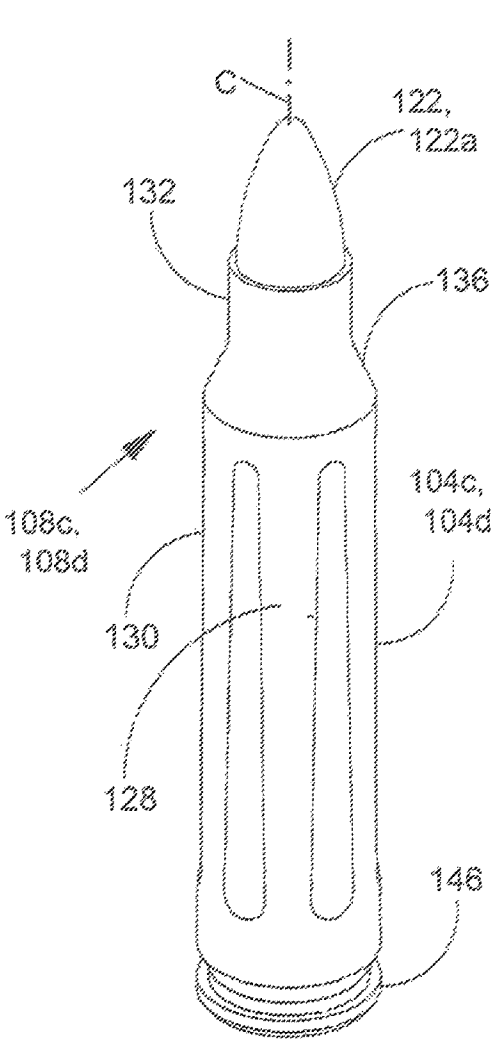
FIG. 6C is a perspective view of the cartridge depicted in FIG. 6A or 6B.
Figure 6B:
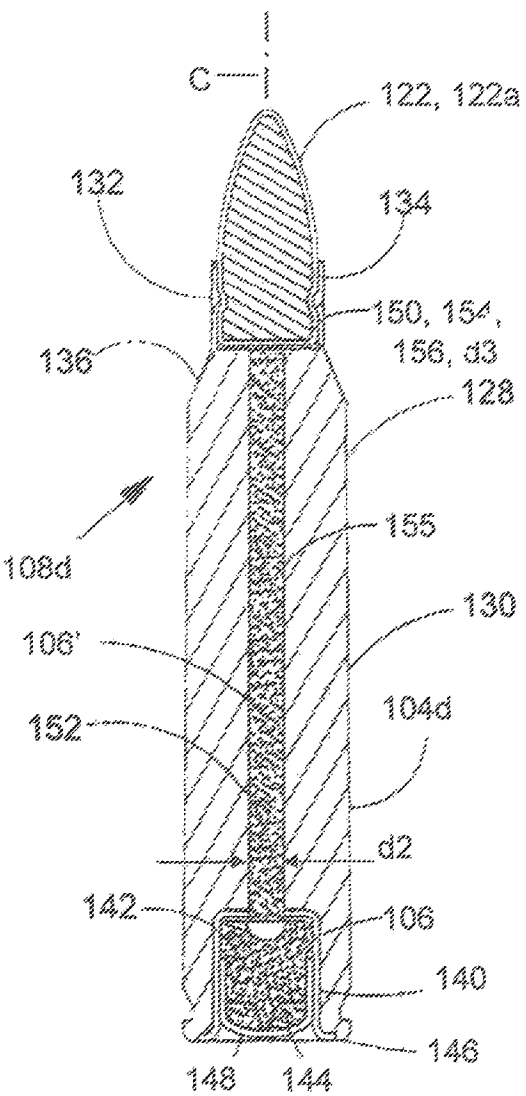
FIG. 6B is a cross-sectional view of a cartridge according to an embodiment of the disclosure
Figure 6A:
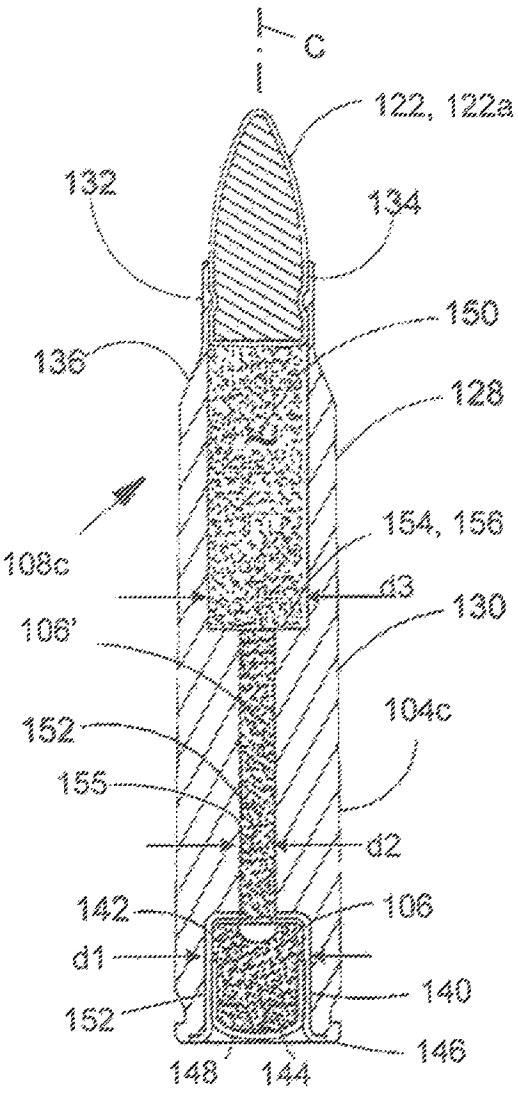
FIG. 6A is a cross-sectional view of a cartridge according to an embodiment of the disclosure.
Figure 7:
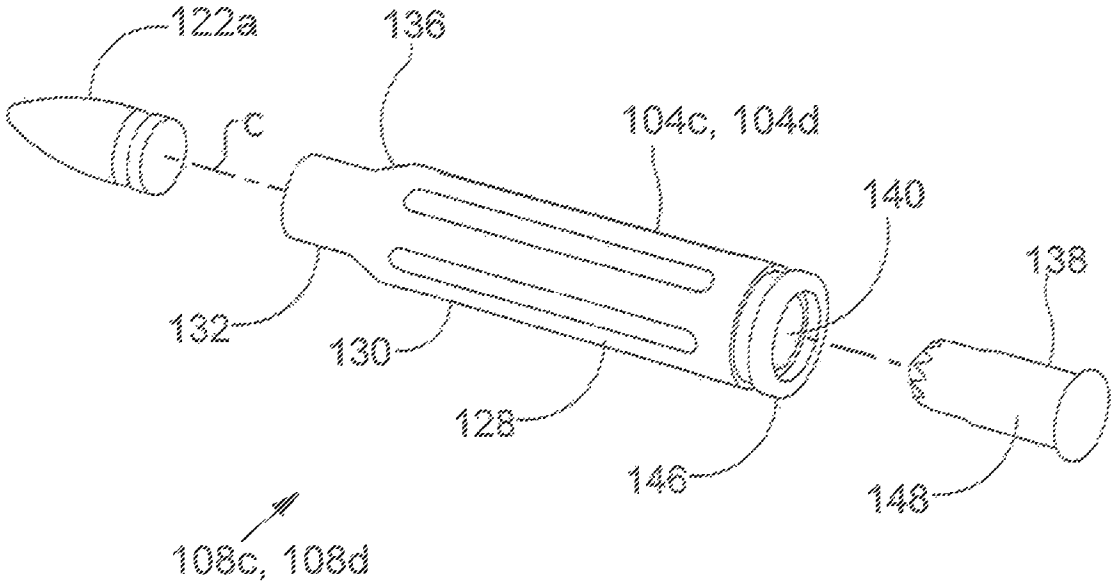
FIG. 7 is an exploded perspective view of an additional embodiment of a cartridge according to an embodiment of the disclosure.
Figure 8:
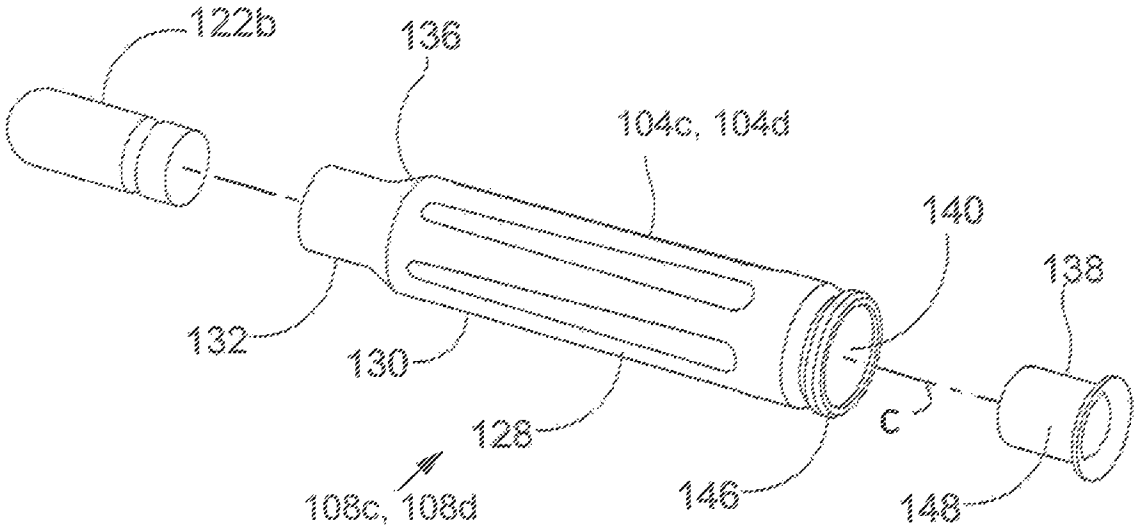
FIG. 8 is an exploded perspective view of an additional embodiment of a cartridge according to an embodiment of the disclosure.
Figure 9:
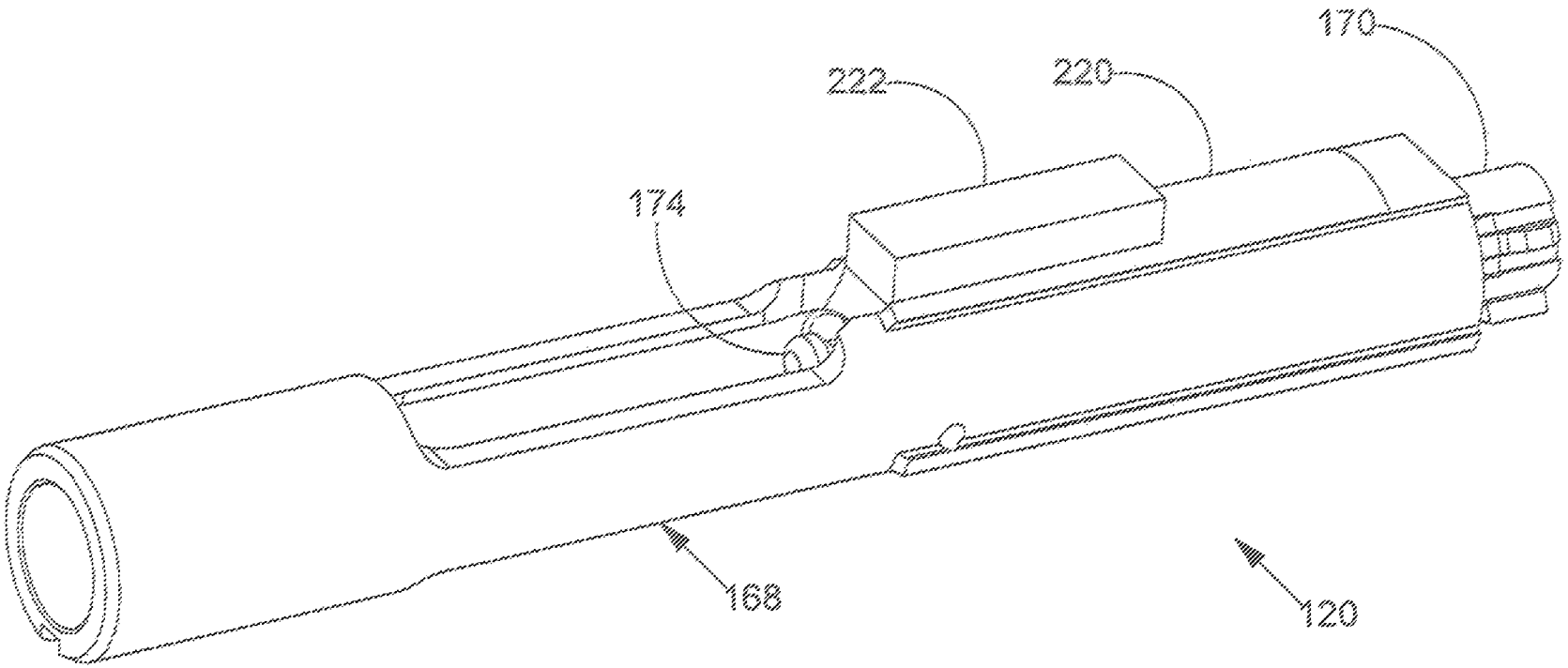
FIG. 9 is a perspective view of a replacement bolt assembly according to an embodiment of the disclosure.
Figure 10:
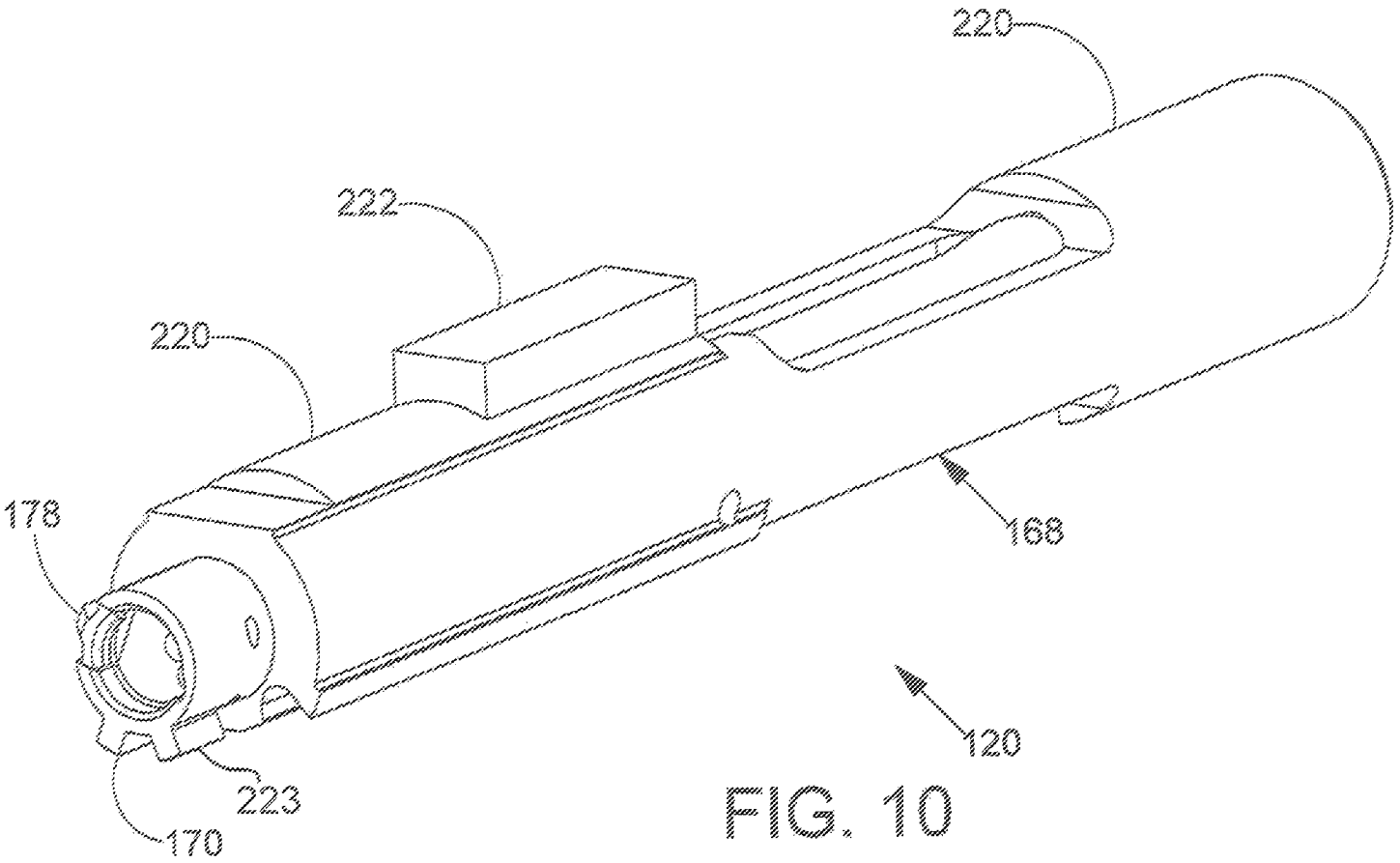
FIG. 10 is a perspective view of a replacement bolt assembly according to an embodiment of the disclosure.
Figure 11:
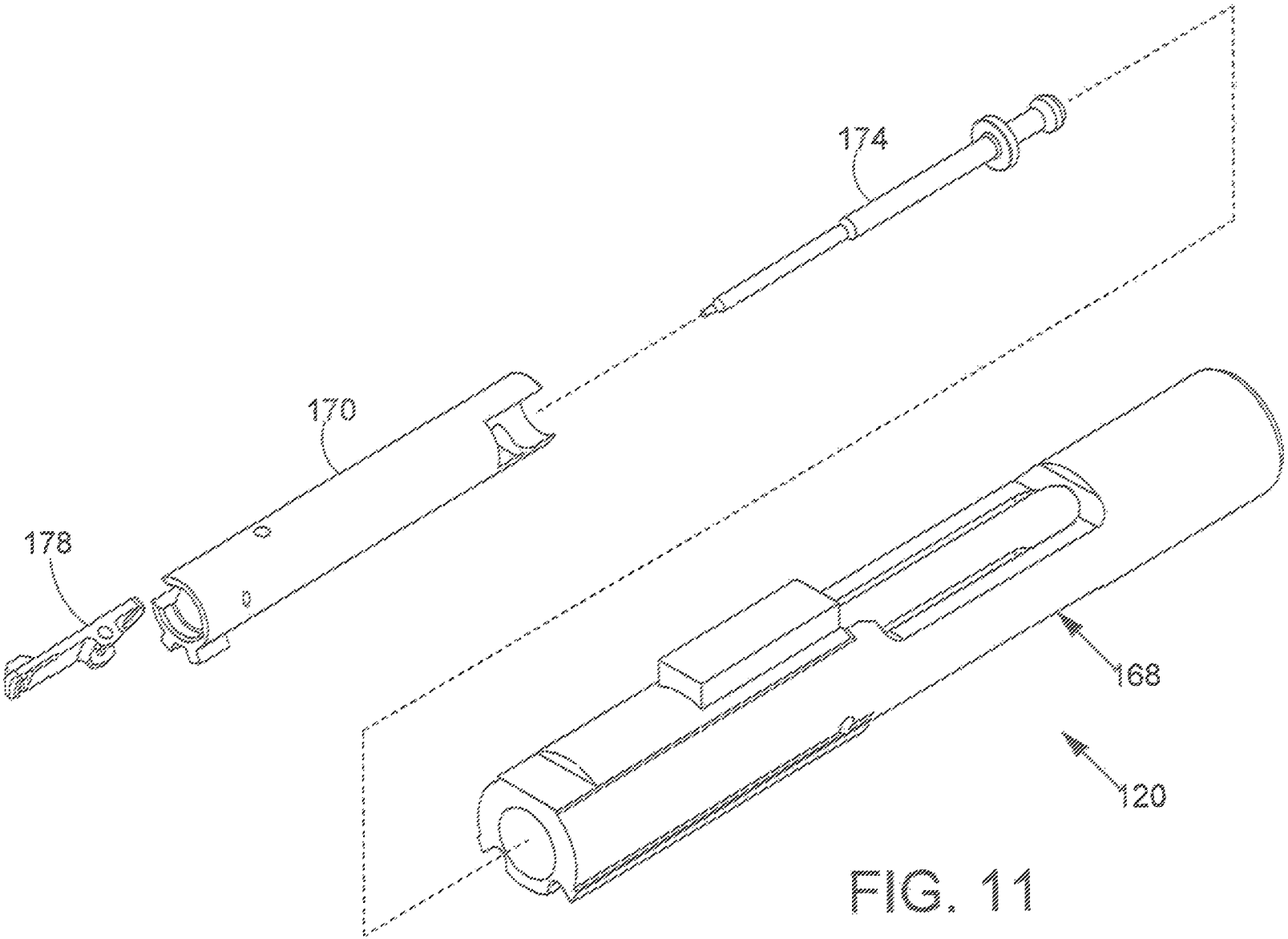
FIG. 11 is an exploded view of a replacement bolt assembly according to an embodiment of the disclosure.
Figure 12:
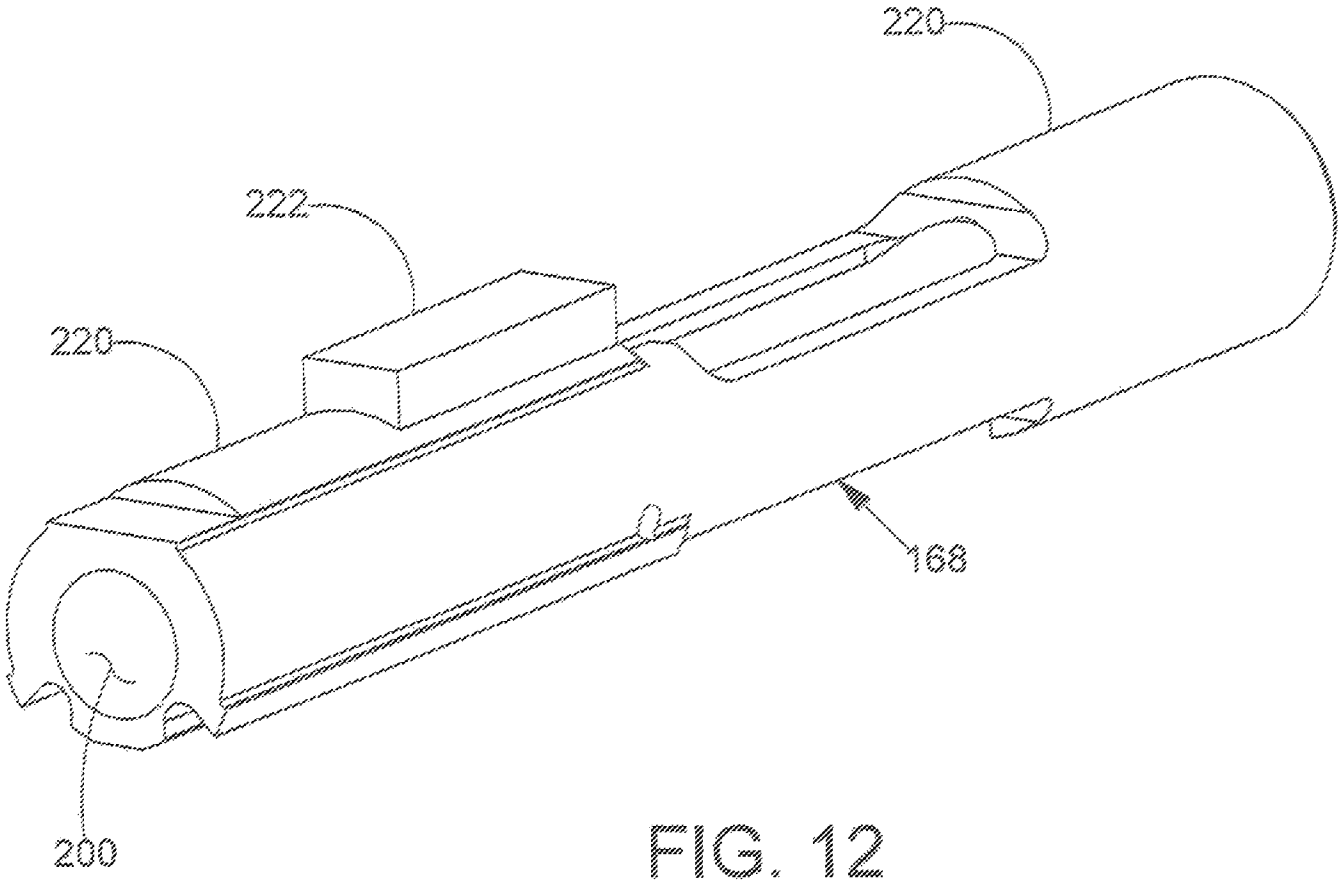
FIG. 12 is a perspective view of a bolt carrier according to an embodiment of the disclosure.
Figure 13:
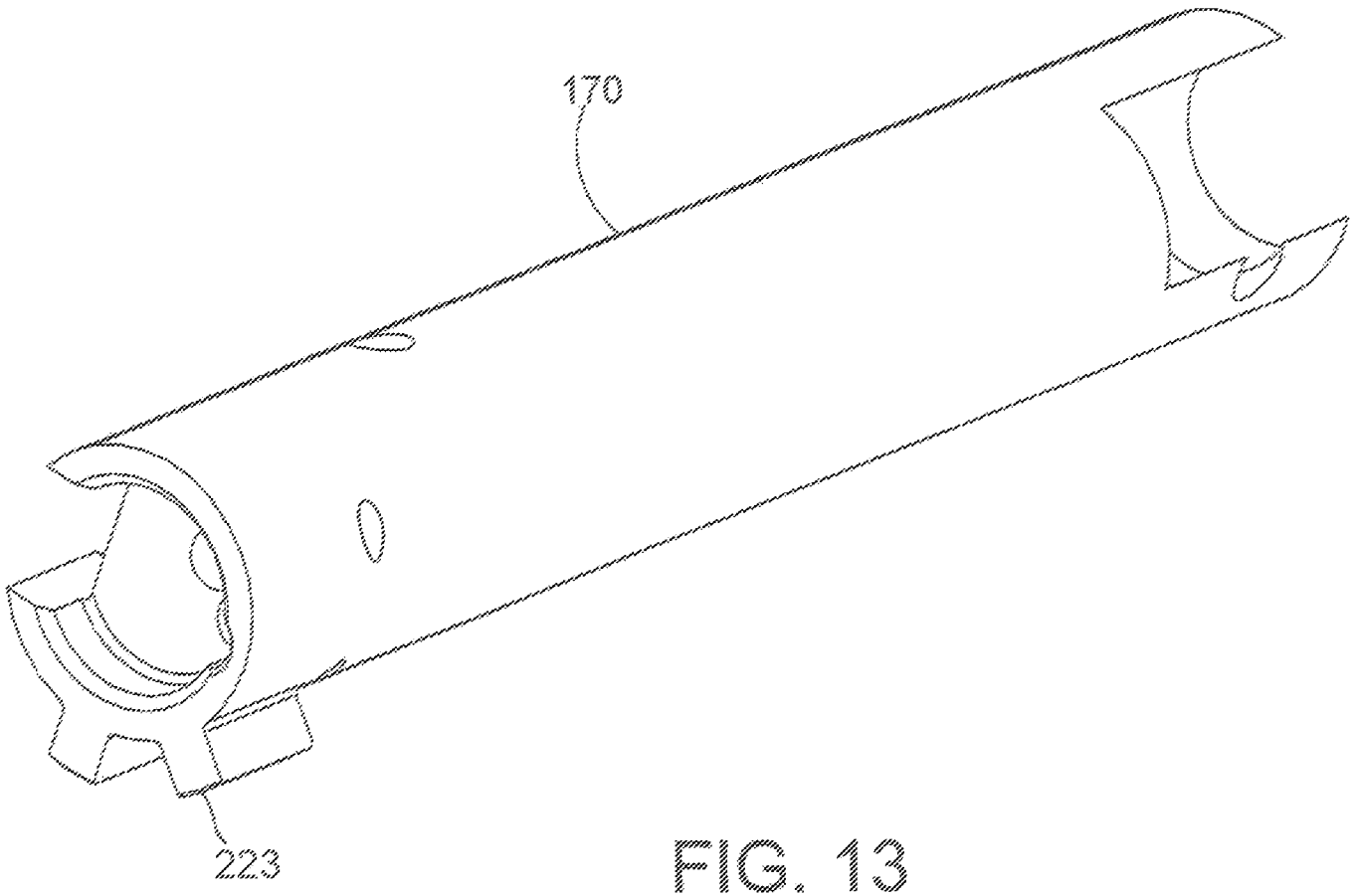
FIG. 13 is a perspective view of a bolt according to an embodiment of the disclosure.

Referring to FIGS. 6A through 6C, polymer cases 104*c* and 104*d* are depicted according to embodiments of the disclosure. The polymer cases 104*c*, 104*d* define a rearward cavity 152 and a first inner diameter d1 of the base the lumen 140. The polymer cases 104*c*, 104*d* also define a body lumen 155 between the base lumen 140 and the neck lumen 134, the body lumen 155 having a diameter d2 that is less than a diameter d1 of the base lumen. The polymer cases 104*c*, 104*d* further define a forward cavity 150 having a third inner diameter d3 of the neck lumen 134. The second inner diameter d2 that is smaller than the inner diameter d3 of the forward cavity 150 so that the polymer case wall 128 includes a step portion 154 where the body lumen 155 meets the forward cavity 150. The step portion 154 of the polymer case wall 128 may include an annular surface 156 that is substantially orthogonal to a longitudinal axis C of the polymer case 104.

In the depicted embodiments, the polymer case wall 128 is unitary (i.e., formed as a single component) from the body lumen 155 to the first outer diameter D1 of the polymer case 104*c*, 104*d*. In some embodiments, the reduced energy cartridge 108*c*, 108*d* may include supplemental propellant 106' that fills the forward cavity 150 and the body lumen 155 to eliminate air pockets between the propellant unit 138 and the projectile 122*a*. A primary distinction between polymer cases 104*c* and 104*d* is the volume (e.g., axial length) of the forward cavity 150. That is, the polymer case 104*c* defines a longer forward cavity 150, with space between the annular surface 156 and the projectile 122*a*. The polymer case 104*d* provides essentially no space, with the projectile 122*a* being proximate or in contact with the annular surface 156. In some embodiments, the diameter d3 of the forward cavity 150 and neck lumen 134 is in a range of 4.0 mm to 8.0 mm inclusive, with, the diameter d2 of the body lumen 155 is in a range between 2.0 mm and 7.0 mm inclusive. In some embodiments, the third outer diameter d3 is in a range of 8.9 mm and 9.1 mm inclusive, with the second outer diameter d2 in a range of 6.2 mm and 6.4 mm inclusive.

Functionally, the ability to size the forward cavity 150 and body lumen 155 enables tailoring the desired amount of supplemental propellant 106' to be used to match the volume of the forward cavity 150 and body lumen 155, where the desired amount of supplemental propellant 106' produces a desired energy level of the projectile in flight. By matching the volume of the supplemental propellant 106' to the void volumes of the body lumen 155 and the forward cavity 150 that exists between the projectile 122 and the propellant unit 138, the supplemental propellant 106' can be effectively packed or contiguous without substantial air pockets. Elimination of air pockets mitigates detonation or explosion of the propellant in favor of a rapid burning discharge. Upon ignition of the propellant charge 106, 106', the initial pressure buildup of the propellant gas behind the projectile 122*a* acts on the annular surface 156 to produce a substantially rearward ejecting force on the polymer case 104*c*.

Referring to Table 1, muzzle velocities and muzzle energies for reduced energy cartridges 108 (and for reinforced reduced energy cartridges 308 described below) of various cartridge forms at various projectile weights are presented according to embodiments of the disclosure. The energy levels for 40 grain projectiles fall within a mid energy range of 50 ft-lbf to 450 ft-lbf inclusive. The reduced energy cartridges 108, 308 with 55 grain, 77 grain, and 100 grain projectiles may also be configured to deliver muzzle energies that fall within this range. Likewise, various embodiments of the reduced energy cartridges 108, 308 may be tailored to deliver subsonic velocities (i.e., less than about 1126 fps) for noise abatement.

| Cartridge Form | Projectile Weight [grains] | Muzzle Velocity [fps] | Muzzle Energy [ft-lbf] |
|---|---|---|---|
| 223 Rem/5.56 × 45 mm | 40 | 750 | 50 |
| 223 Rem/5.56 × 45 mm | 40 | 1080 | 103 |
| 223 Rem/5.56 × 45 mm | 40 | 2200 | 429 |
| 223 Rem/5.56 × 45 mm | 55 | 1080 | 142 |
| 223 Rem/5.56 × 45 mm | 77 | 1080 | 199 |
| 5.56 × 39 mm | 40 | 750 | 50 |
| 5.56 × 39 mm | 40 | 1080 | 103 |
| 5.56 × 39 mm | 40 | 2200 | 429 |
| 5.56 × 39 mm | 55 | 1080 | 142 |
| 5.56 × 39 mm | 77 | 1080 | 199 |
| 9 × 19 mm | 20 | 1080 | 52 |
| 7.62 × 39 mm | 100 | 750 | 125 |
| 7.62 × 39 mm | 240 | 1080 | 621 |
| 7.62 × 39 mm | 125 | 1500 | 624 |

Referring to FIGS. 9 through 17C, details of the rifle system 100 are depicted according to an embodiment of the disclosure. The system 100 configured to allow a plurality of reduced energy cartridges 108 to be fired from the modern sporting rifle 102 and cycled through the modern sporting rifle 102 by blowback operation of the replacement bolt assembly 120. The replacement bolt assembly 120 includes a bolt carrier 168 that is formed of a polymeric material. In one or more embodiments, the bolt carrier 168 is formed by injection molding. In one or more embodiments, the bolt carrier 168 comprises nylon and/or a polyimide material. In embodiments, the bolt carrier polymer may be filled with metal for adding weight and/or effecting specific parameters such as wear resistance and sliding engagement friction with the upper receiver In an embodiment, the replacement bolt assembly weighs less than about 330 grams. In an embodiment, the replacement bolt assembly weighs less than about 300 grams. In an embodiment, the replacement bolt assembly weighs less than about 250 grams. In an embodiment, the replacement bolt assembly weighs less than about 200 grams. In an embodiment, the replacement bolt assembly weighs less than about 150 grams. In an embodiment, the replacement bolt assembly weighs less than about 120 grams.

In one or more embodiments, the modern sporting rifle 102 includes a gas-operated reloading mechanism comprising a piston that reciprocates longitudinally within a cylinder between a forward position and a rearward position when exposed to high-pressure gases from the firing of rounds. In one or more embodiments, the replacement bolt assembly 120 moves the reduced energy cartridges 108 into the chamber and extracts a casings of the reduced energy cartridges 108 from the chamber after the projectile 122 of the reduced energy cartridge 108 has been fired through a barrel of the modern sporting rifle 102. In one or more embodiments, the modern sporting rifle 102 comprises a upper receiver and a barrel extending forwardly from a forward end of the upper receiver, and the reduced energy cartridge comprises a projectile that is dimensioned to be received in a bore of the barrel.

In one or more embodiments, the modern sporting rifle 102 comprises a recoil spring disposed in a lumen defined by a receiver extension, the receiver extension extending in a rearward direction from the upper receiver and the recoil spring acts to bias the replacement bolt assembly in a forward direction. In one or more embodiments, the replacement bolt assembly 120 is biased in a forward direction by a recoil spring and translates in a rearward direction upon firing of the modern sporting rifle 102 to effect cycling of the modern sporting rifle 102 through blowback operation. In embodiments, the recoil spring is the original recoil spring supplied with the modern sporting rifle before installation of the replacement bolt assembly. In embodiments the spring may be replaced The replacement bolt assembly 120 comprises a bolt 170. In one or more embodiments, the bolt 170 has a first portion disposed inside a cavity 200 defined by the bolt carrier 168 and a second portion extending forwardly beyond the bolt carrier 168. In one or more embodiments, the bolt carrier 168 comprises a body portion 220 and a key member 222 extending upward from the body, the key member does not generally engage the gas tube 221, see FIG. 1B, but may ride in a slot 220.2 in the T-shaped bolt extractor 221.1. In one or more embodiments, the body portion 220 has a cylindrical three dimensional shape and the key member 222 has a parallel piped three dimensional shape. In embodiments the bolt and bolt carrier may be unitary, that is not separate components assembled together. The bolt may have cogs, see FIG. 10 that interlace with cogs 224 on the barrel at the firing chamber 225, see FIG. 1B In one or more embodiments, the replacement bolt assembly comprises an extractor 178 pivotally coupled to the bolt. In one or more embodiments, the extractor comprises 17-4 stainless steel. In one or more embodiments, the bolt comprises 17-4 stainless steel. In one or more embodiments, the replacement bolt assembly 120 comprises a firing pin 174. In one or more embodiments, the firing pin 174 is offset from a central longitudinal axis of the bolt 170. In one or more embodiments, the firing pin is positioned to strike a rim of a rim fire blank that is part of a reduced energy cartridge. In one or more embodiments, the firing pin 174 comprises 17-4 stainless steel.

Figure 17C:
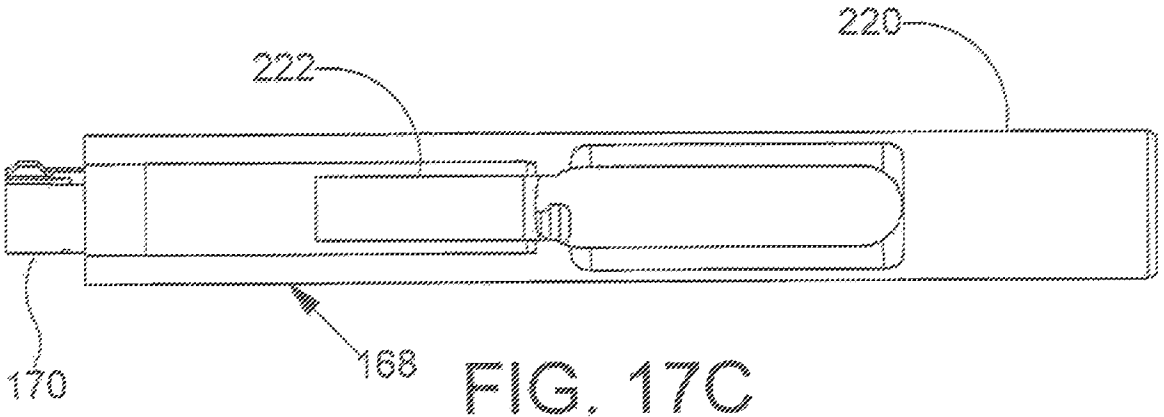
FIG. 17C is a top view of the replacement bolt assembly depicted in FIG. 17A.
Figure 17B:
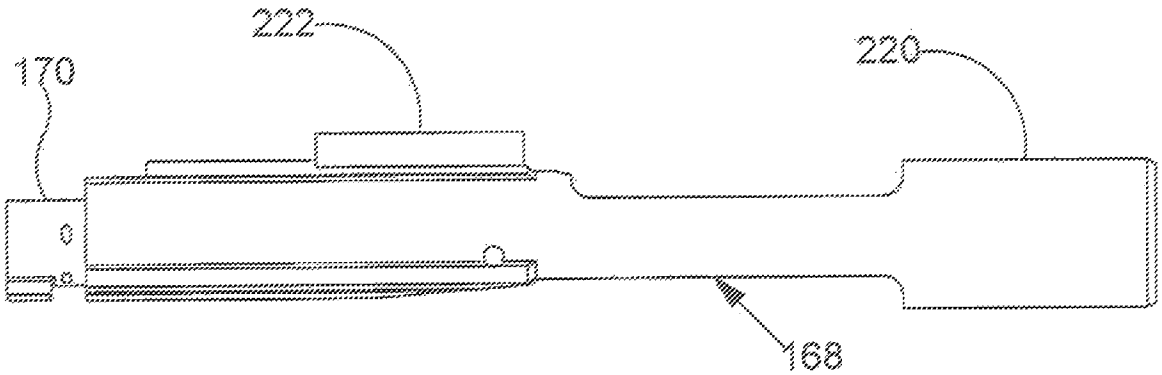
FIG. 17B is a right side view of the replacement bolt assembly depicted in FIG. 17A.
Figure 17A:
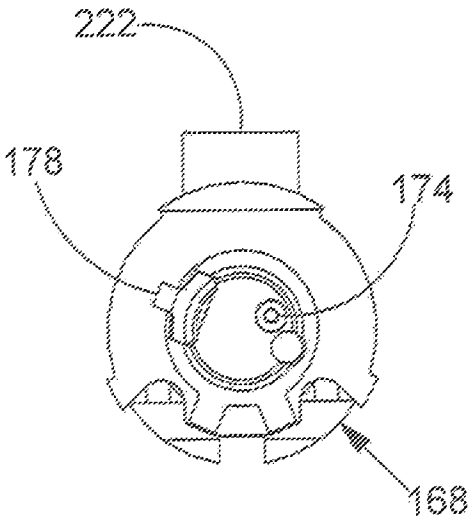
FIG. 17A is a front view of a replacement bolt assembly according to an embodiment of the disclosure.

Elevation and plan views of three sides of a replacement bolt assembly 120 are depicted in FIG. 17A through FIG. 17C (referred to collectively herein as FIG. 17). Engineer graphics textbooks generally refer to the process used to create orthogonal views of a three dimensional object as multiview projection or orthographic projection. It is customary to refer to multiview projections using terms such as front view, right side view, top view, rear view, left side view, and bottom view. In accordance with this convention, FIG. 17A may be referred to as a front view of the conversion bolt assembly 120, FIG. 17B as a right side view of the conversion bolt 120, and FIG. 17C as a top view of the conversion bolt assembly 120. Terms such as front view and right side view are used herein as a convenient method for differentiating between the views depicted in FIG. 17. It will be appreciated that the elements depicted in FIG. 17 may assume various orientations without deviating from the spirit and scope of this disclosure. Accordingly, the terms front view, right side view, top view, rear view, left side view, bottom view, and the like should not be interpreted to limit the scope of the invention recited in the attached claims.

Referring to FIGS. 14A-14D and FIGS. 16A-16D, an embodiment of a replacement bolt assembly 120.1 that includes a bolt carrier 168.1 and a bolt 170.1. The bolt includes an extractor 178.1, a firing pin 174.1, and an ejector 175. A pivot pin 179 secures the extractor in place. The bolt carrier may be formed from polymers and in embodiments may be filled with metal or other materials for increasing its density, its material properties such as wear resistance and slidability or friction when engaged with the receiver of the modern sporting rifle. The bolt carrier may have pads 176 that have sliding engagement or bearing surfaces 177 that interface with bearing surfaces on the upper receiver 124.

The bolt may have recesses or divots 181 defining serrations 182 that may be utilized for reducing the weight of the bolt and also for securing the bolt within the bolt carrier. In a press fit arrangement with a polymer carrier, the serrations will resist a sliding disengagement of the bolt and bolt carrier. The bolt may be secured in the bolt carrier with a roll pin 183 that also constrains the firing pin within the bolt. Where the polymer carrier is overmolded over the bolt, the serrations will fill with polymer and the bolt will be locked therein. Additionally, the bolt may have a flange 184 that the polymer bolt carrier may abut against, the flange serving as a stop with respect to the positioning of the polymer bolt carrier on the bolt. The bolt may have a forward projection 189 that fits into recesses of embodiments of reduced energy cartridges. The projection assuring that only the proper ammunition is fired with the replacement bolt and also providing a means of holding a rimfire propellant unit secure in the cartridge being fired, discussion below.

Figure 14A:
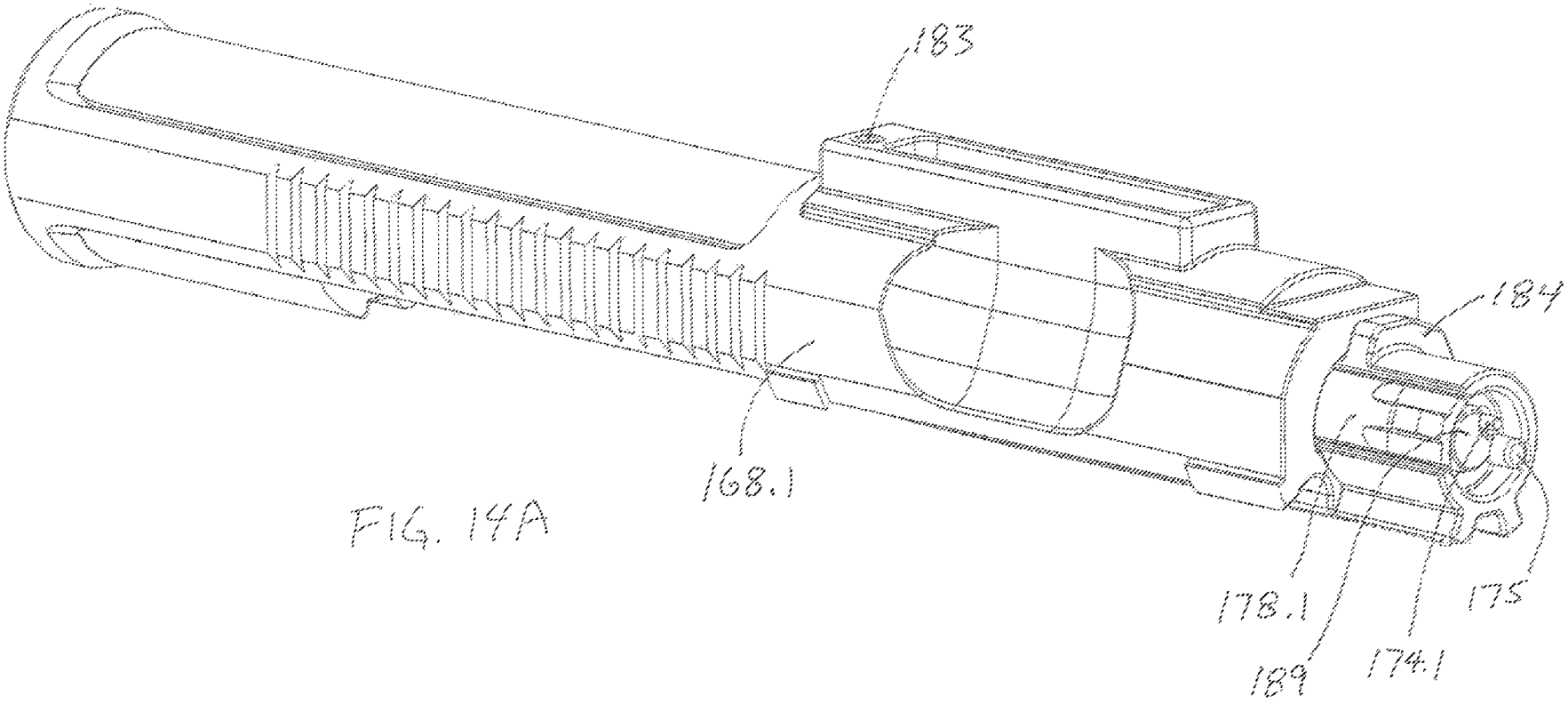
FIGS. 14A and 14B are perspective views of another bolt assembly according to an embodiment of the disclosure.
Figure 14B:
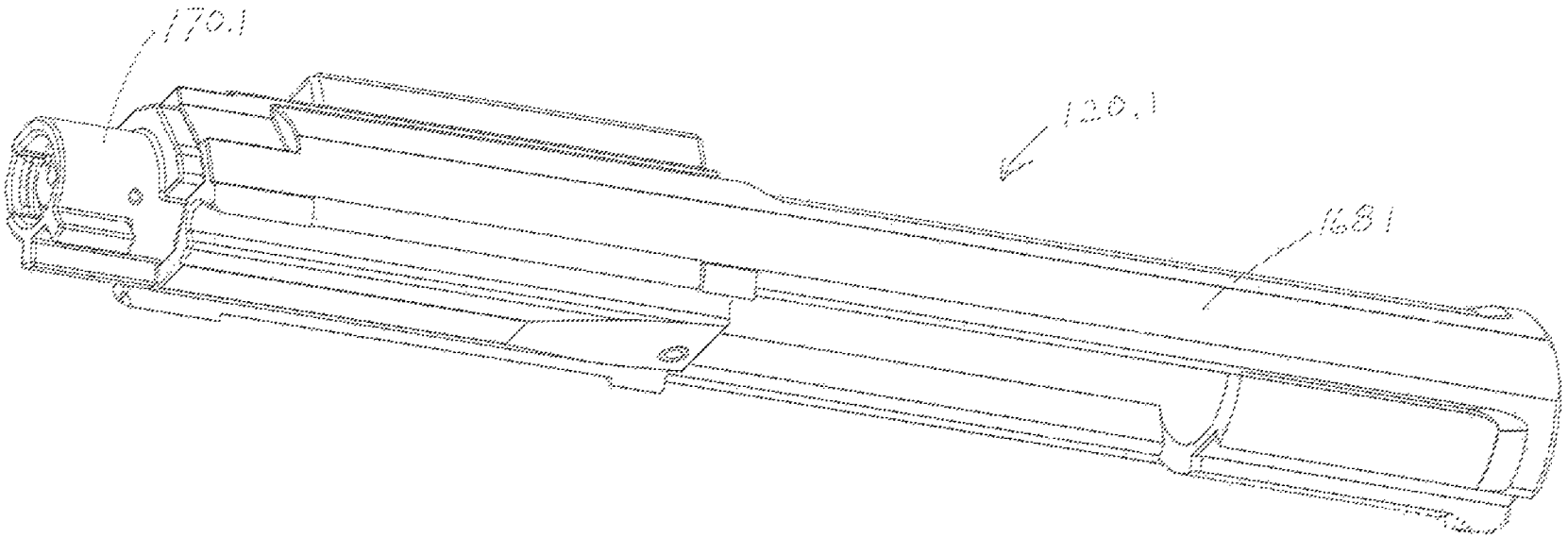
Figure 14C:
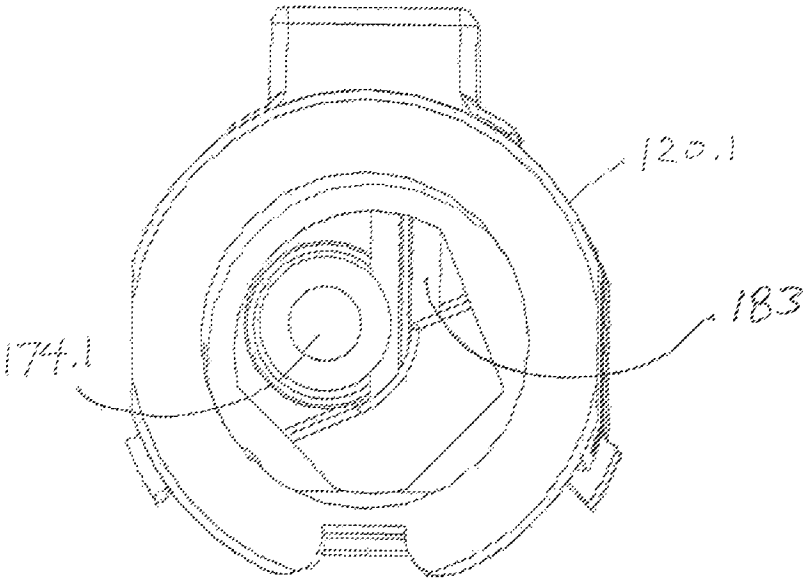
FIG. 14C is an end view of the bolt assembly of the bolt assembly of FIGS. 14A and 14B.
Figure 14D:
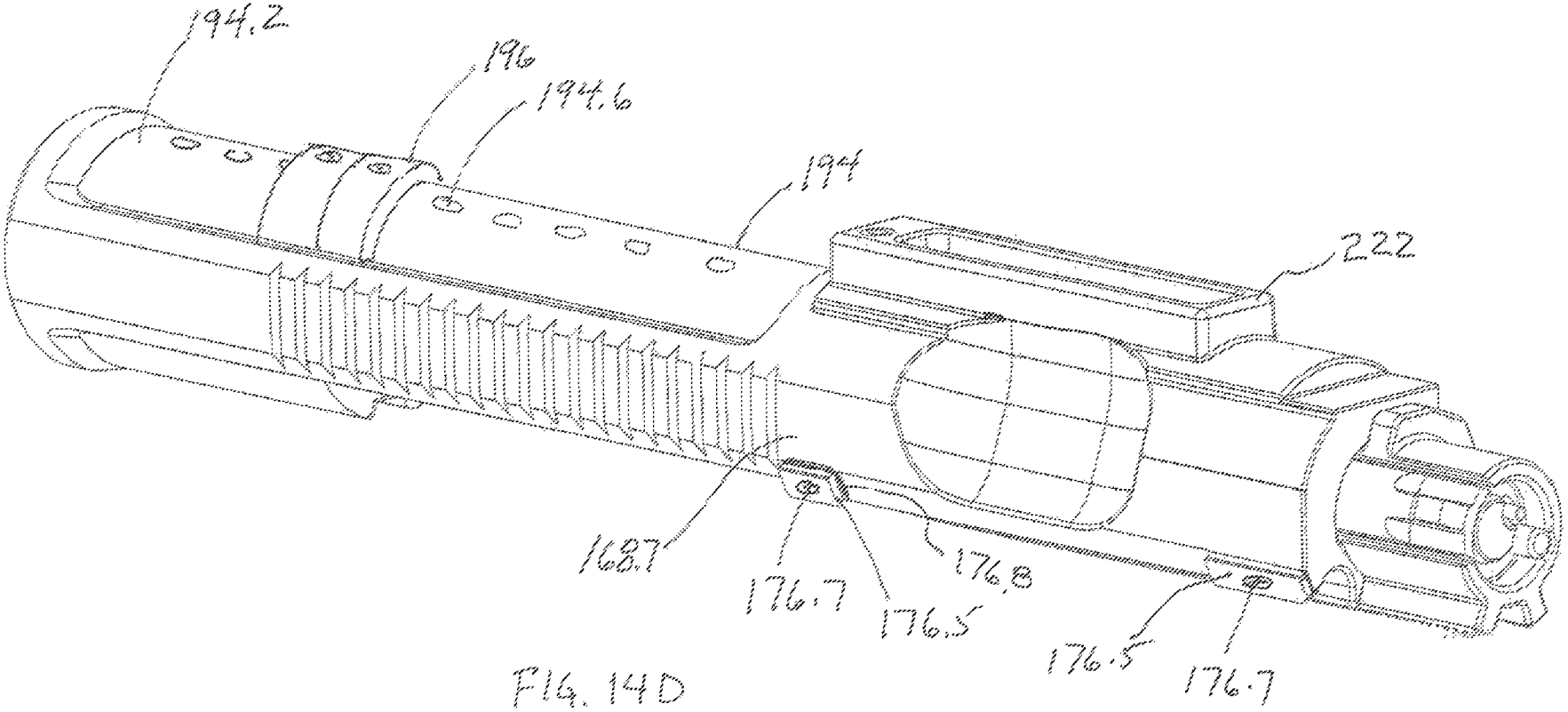
FIG. 14D is a perspective view of the bolt assembly of FIGS. 14A-14C.
Figure 15C:
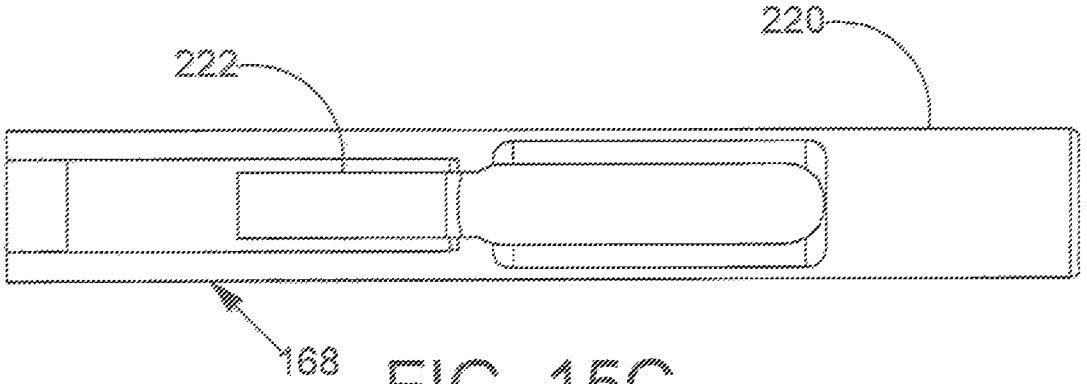
FIG. 15C is a top view of the bolt carrier depicted in FIG. 15A.
Figure 15B:
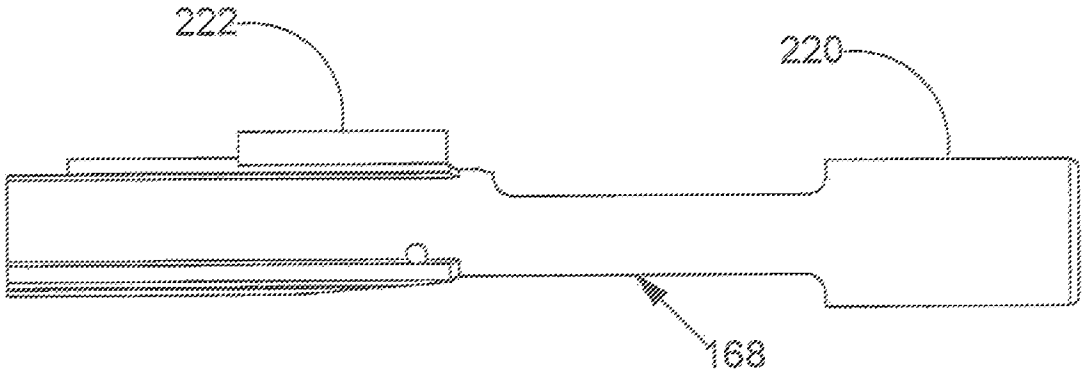
FIG. 15B is a right side view of the bolt carrier depicted in FIG. 15A.
Figure 15A:
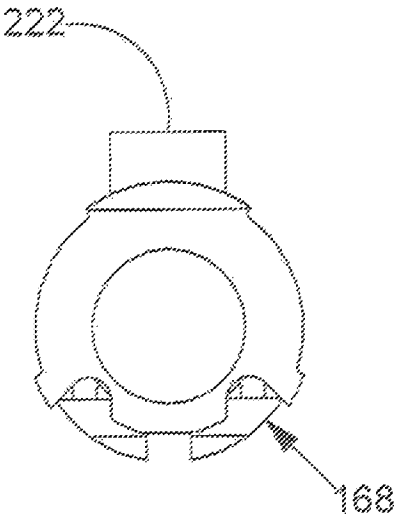
FIG. 15A is a front view of a bolt carrier according to an embodiment of the disclosure.
Figure 16A:
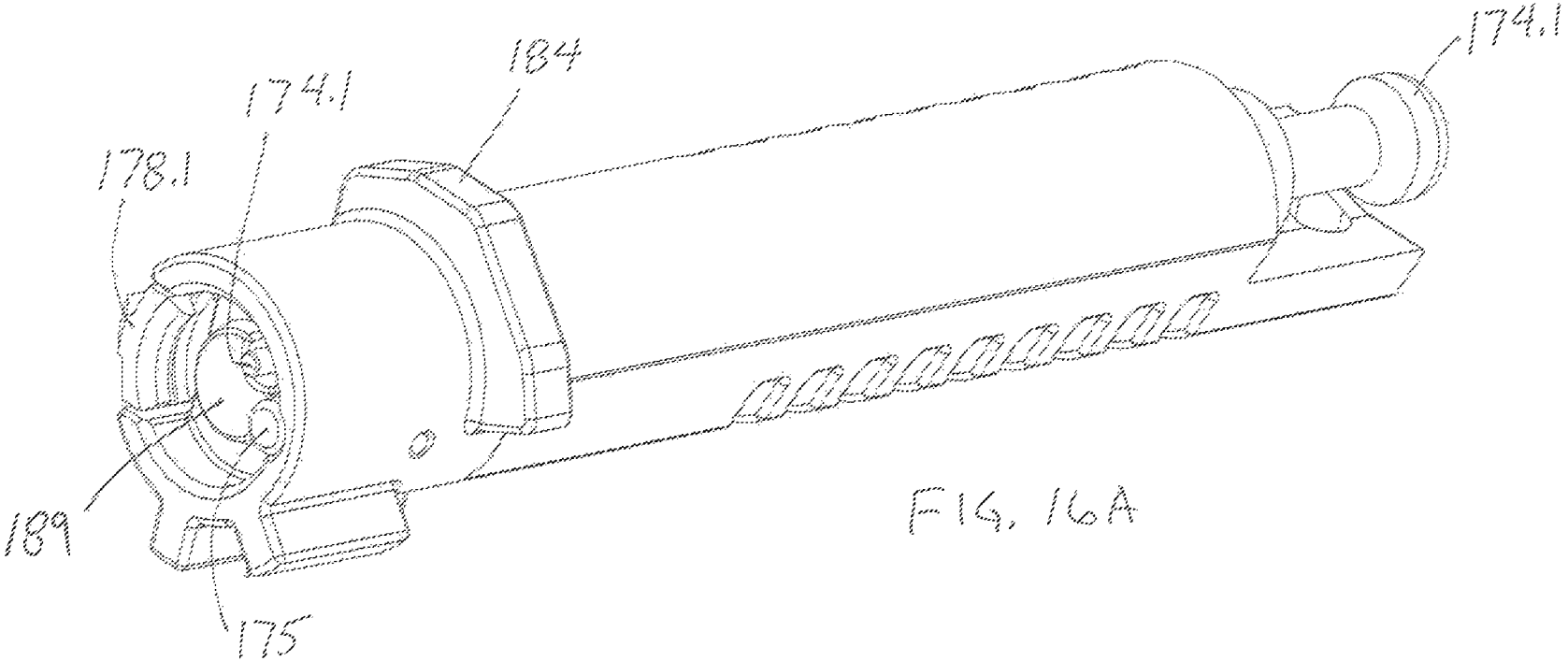
FIGS. 16A-16C are perspective views of the bolt of the bolt assembly of FIGS. 14A-14C including the firing pin, ejector, and extractor.
Figure 16B:
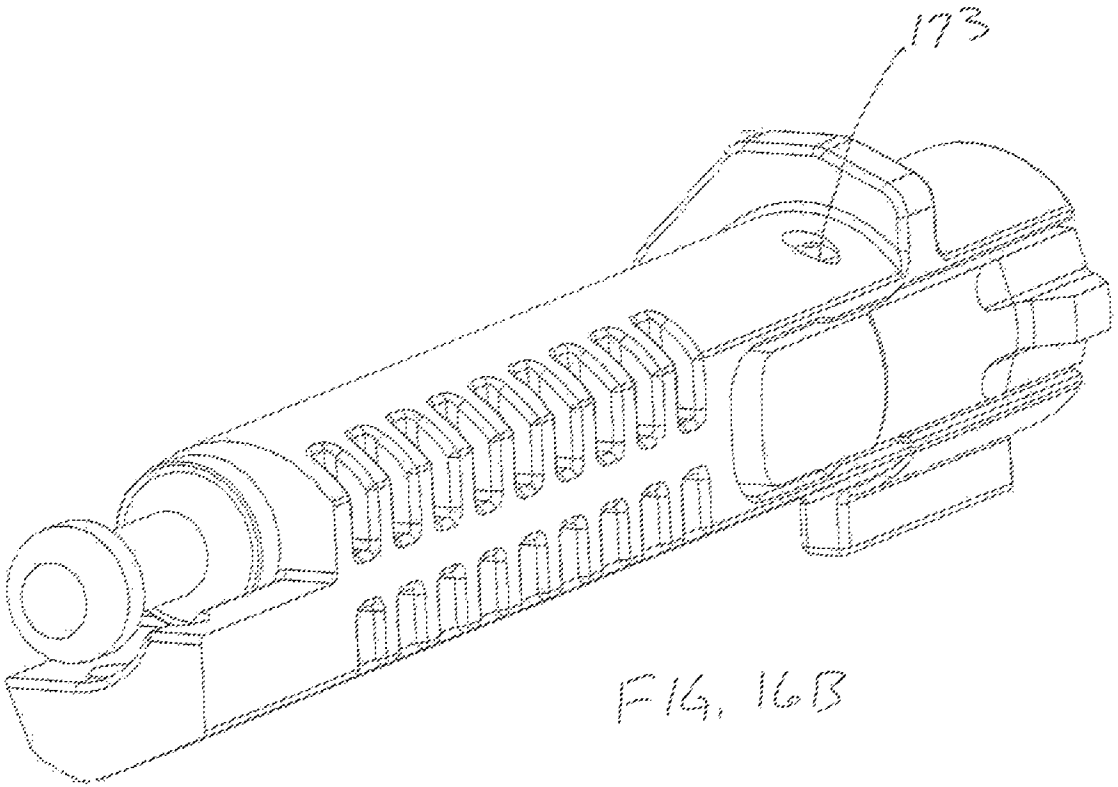
Figure 16C:
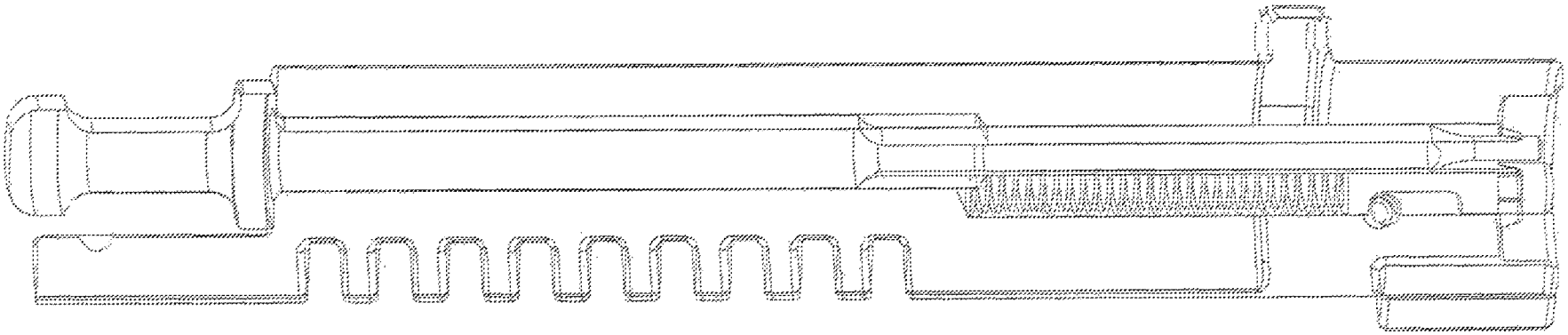
Figure 16D:
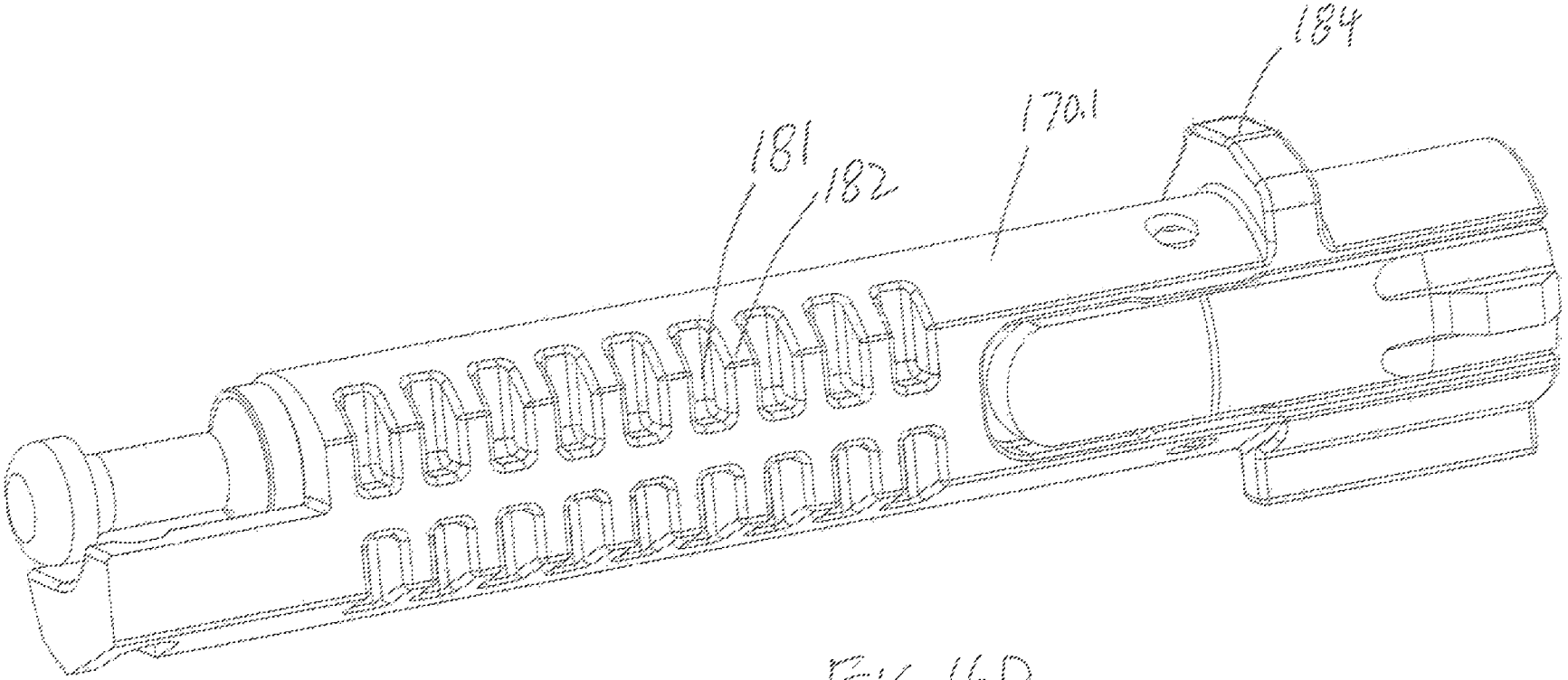
FIG. 16D is a cross section of the bolt of FIGS. 16A-16C.

Referring to FIG. 14D, in an embodiment, a bolt assembly 12.5 has "tuning" means for facilitating reliable recycling as a replacement bolt assembly. The bolt carrier 168.5 may have receiving regions 194 on a recessed region 194.2 of the bolt carrier at attachment holes 194.6. Weights 196, conformingly shaped to the bolt carrier, may be provided as part of a tuning kit, and attached in various combinations and regions on the bolt carrier in order to provide an ideal mass for reliable recycling, in particular with the original spring of the modern sporting rifle being converted. An assortment of weights may be provided with the replacement bolt or otherwise be available. Additionally, bearing inserts 176.5 may be utilized for providing desirable friction/slidability characteristics with the receiving to further provide reliable cycling. The inserts may be metal or a polymer or material different from the bolt carrier body, and may be attached by fasteners to the bolt carrier body 168.7 or may be fixed as an intergrated part of the bolt carrier by overmolding. That is the inserts placed in the mold of the polymer bolt carrier before the polymer is injected. The inserts may be attached with fasteners 176.7. In embodiments, the weights described above may also be utilized as bearing surfaces. The positioning of the inserts may be adjustable such as by way of a deformable elastomeric member 176.8 between the bolt carrier body and the insert that may be compressed by tightening of the fastener 176.7. Different inserts, for example different sizes of the inserts, may be provided as a kit or otherwise be available. Instructions may be provided with the kit or otherwise be available for the tuning.

The key 222 may also be a separate removable piece that can be a material other than the material of the bolt carrier body and may be secured by fasteners and otherwise adjusted by using different sizes, weights, shape, or materials to further facility tuning for reliable operation of the firearm.

In embodiments the bolt assembly may further be tuned by adjusting the inserts, the key member, or the weights, by changing their size, their position, or their radial projection distance to "tune" the operation of the replacement bolt assembly for use with reduced energy ammunition and for proper reliable cycling.

Referring to FIGS. 18, 18A, 18B, 19, and 20, reinforced reduced energy cartridges 308*a* and 308*b* are depicted in embodiments of the disclosure. Herein, reinforced reduced energy cartridges are referred to collectively and generically by reference character 308, with specific configurations referred to by reference character 308 followed by a letter suffix (e.g., reduced energy cartridges 308*a* at FIG. 18A). The reinforced reduced energy cartridges 308 include many of the same components and attributes as the reduced energy cartridges 108, indicated by same-numbered numerical references. In addition, the reinforced reduced energy cartridges 308*a* and 308*b* include reinforcement liners 310*a* and 310*b*, respectively, disposed within the base 146 of the polymer case 104. Herein, the reinforcement liners are referred to collectively and generically by reference character 310, with specific configurations referred to by the reference character 310 followed by a letter suffix (e.g., reinforcement liner 310*b* at FIG. 20).

Figure 18B:
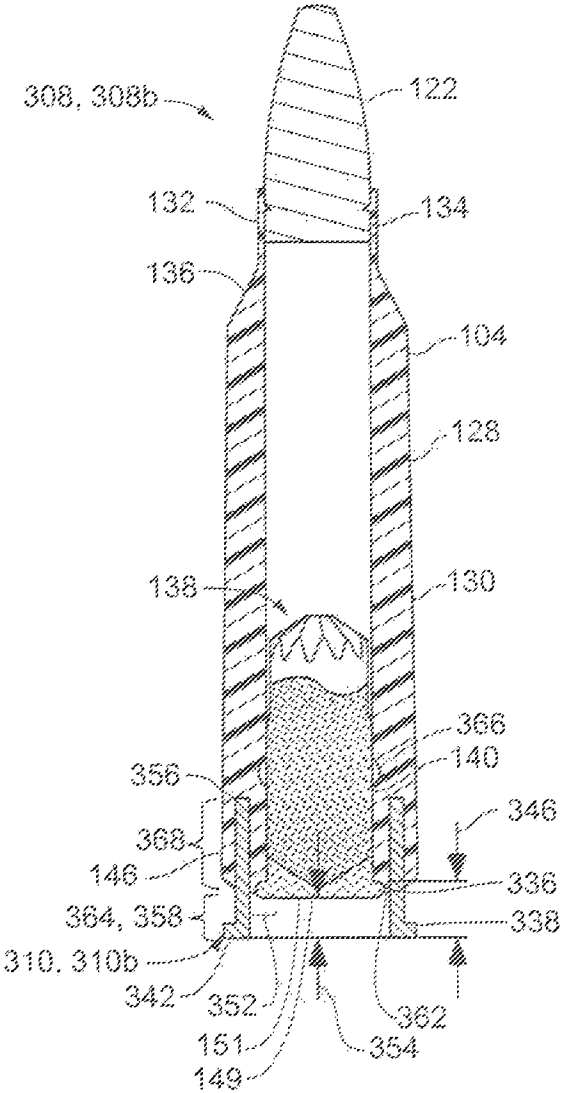
FIG. 18B is a cross-sectional view of a cartridge having a reinforcement liner according to an embodiment of the disclosure.
Figure 18A:
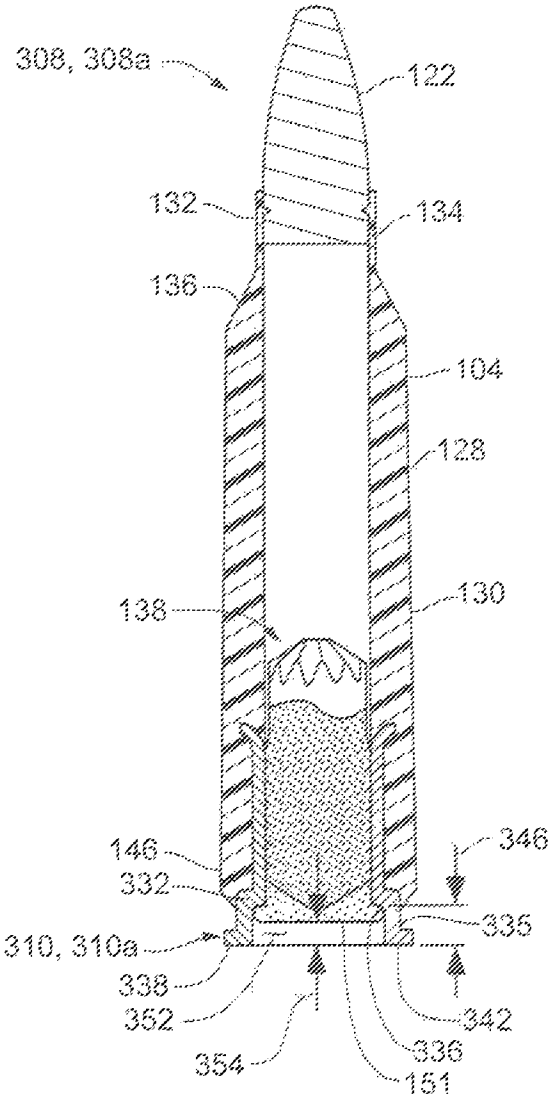
FIG. 18A is a cross-sectional view of a cartridge having a reinforcement liner according to an embodiment of the disclosure.
Figure 18:
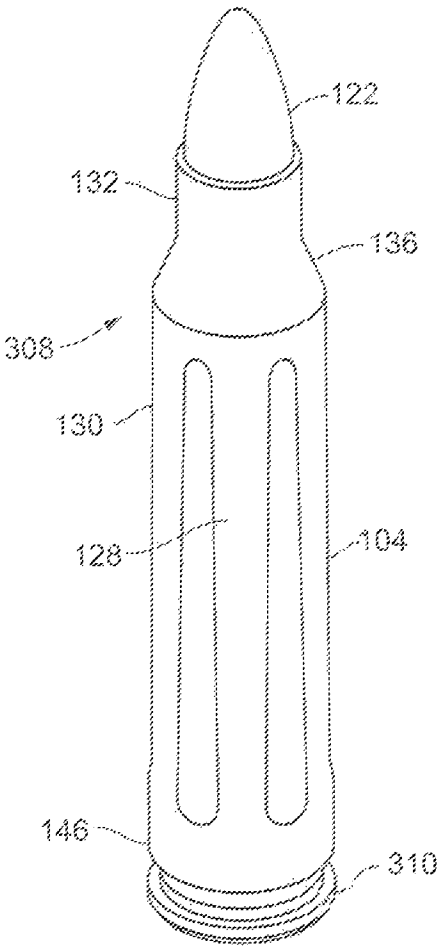
FIG. 18 is a perspective view of a cartridge having a reinforcement liner according to an embodiment of the disclosure.
Figure 19B:
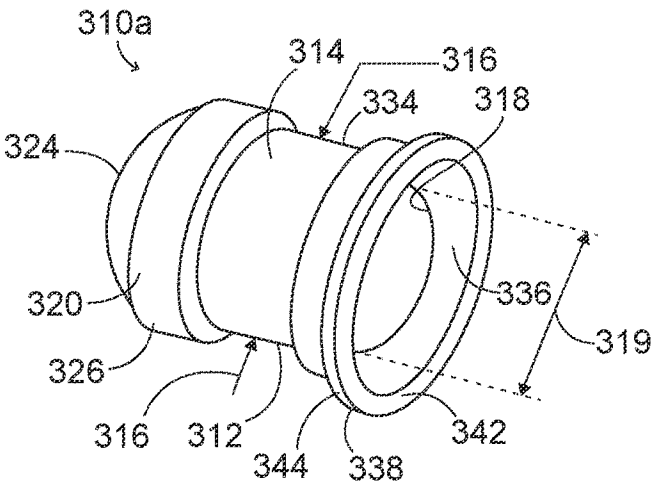
FIG. 19B is a perspective view of a reinforcement liner according to an embodiment of the disclosure.
Figure 19A:
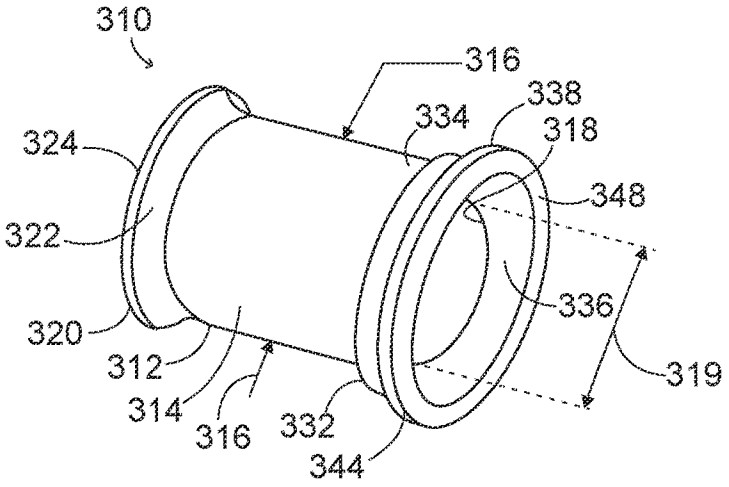
FIG. 19A is a perspective view of the reinforcement liner of the cartridge of FIG. 18A.
Figure 19:
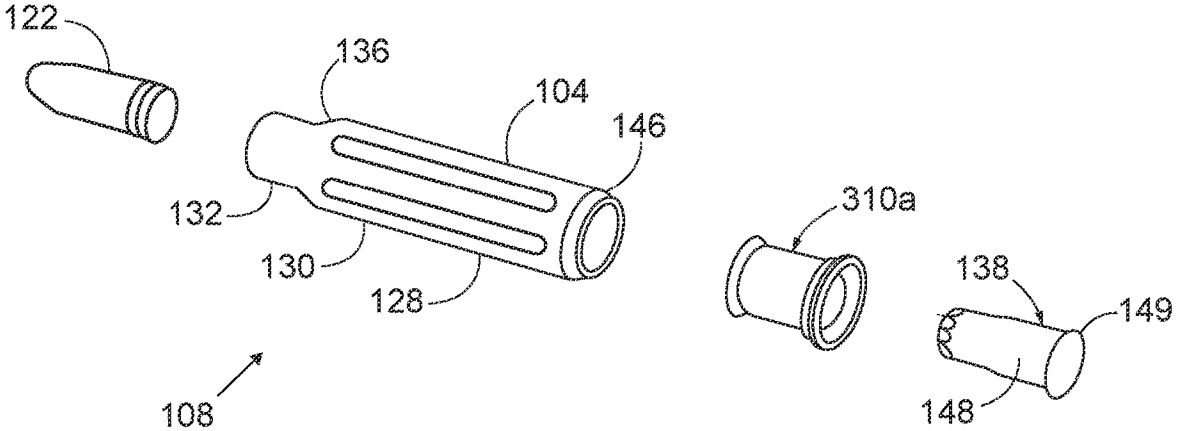
FIG. 19 is an exploded perspective view of the cartridge depicted in FIG. 18A.
Figure 20A:
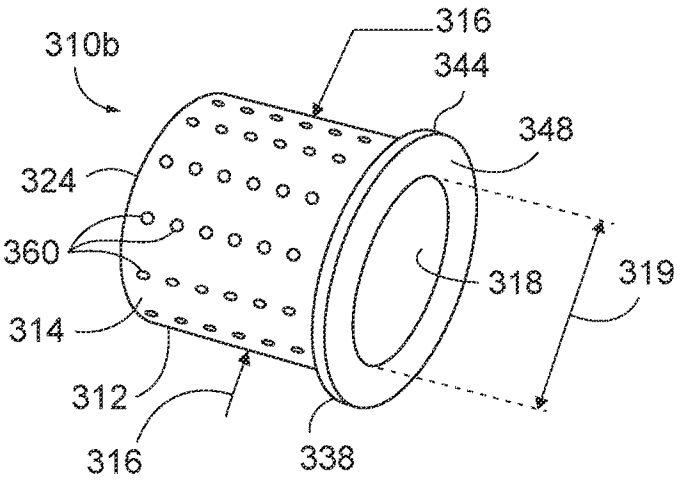
FIG. 20A is a perspective view of the reinforcement liner of the cartridge of FIG. 18B.

Referring to FIG. 19A, and again to FIGS. 18A and 19, the reinforcement liner 310*a* is depicted in isolation in an embodiment of the disclosure. The reinforcement liner 310*a* includes a sleeve portion 312 having an outer surface 314 that defines an outer diameter 316. In the depicted embodiment, the sleeve portion 312 of the reinforcement liner 310*a* is generally right-cylindrical, but may include other geometries, such as an inclined or tapered geometry (e.g., a frustoconical geometry, described below). A radial protrusion 320 projects radially outward beyond the outer diameter 316 of the outer surface 314. The sleeve portion 312 also defines a sleeve lumen 318 having an inner diameter 319. The outer surface 314 may also be textured, for example with perforations (such as the perforations 360 depicted in FIG. 20A), tangentially- or axially-extending striations (not depicted) or a knurling pattern (not depicted).

In the depicted embodiment of the reinforced reduced energy cartridge 308*a*, the radial protrusion 320 of the reinforcement liner 310*a* is provided by a flared portion 322 at a distal end 324 of the reinforcement liner 310*a*. The radial protrusion 320 may be provided by other means, for example a bead (not depicted) at the distal end 324 of the reinforcement liner 310*a*, or a radially extending band 326 that projects radially outward relative to the outer surface 314 of the sleeve portion 312 (depicted in FIG. 19B).

The reinforcement liner 310*a* includes a shoulder portion 332 that extends from a proximal end 334 of the sleeve portion 312, the shoulder portion 332 defining a radiused inner surface 336. A flange portion 338 extends from a proximal end 335 of the shoulder portion 332 and radially outward, beyond the shoulder portion 332, the flange portion 338 defining a proximal face 342 of the reinforcement liner 310*a* and also defining a radial extremity 344 of the reinforcement liner 310*a*. In the depicted embodiment, the flange portion defines a minimum inner diameter that is the same as an inner diameter of the proximal end 335 of the shoulder portion 332.

In some embodiments, the radiused inner surface 336 of the shoulder portion 332 and the flange portion 338 define an internal axial dimension 346 that is greater than the axial dimension 153 of the hollow rim portion 149 of the propellant unit 138. As such, in combination, the propellant unit 138 and the reinforcement liner 310*a* define a recess 352 between the proximal face 342 of the reinforcement liner 310*a* and the anvil 151 of the hollow rim portion 149, the recess 352 defining an axial dimension 354. In some embodiments, the axial dimension 354 is in a range of 0.02 inches to 0.07 inches inclusive. In some embodiments, the axial dimension 354 is in a range of 0.03 inches to 0.06 inches inclusive. In some embodiments, the axial dimension 354 is in a range of 0.04 inches to 0.05 inches inclusive.

Figure 20:
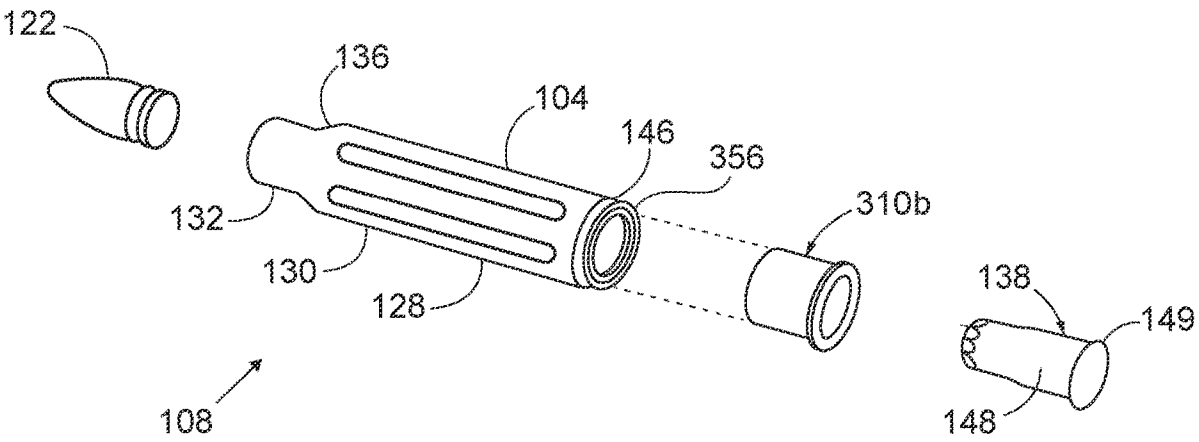
FIG. 20 is an exploded perspective view of the cartridge depicted in FIG. 18B.
Figure 21A:
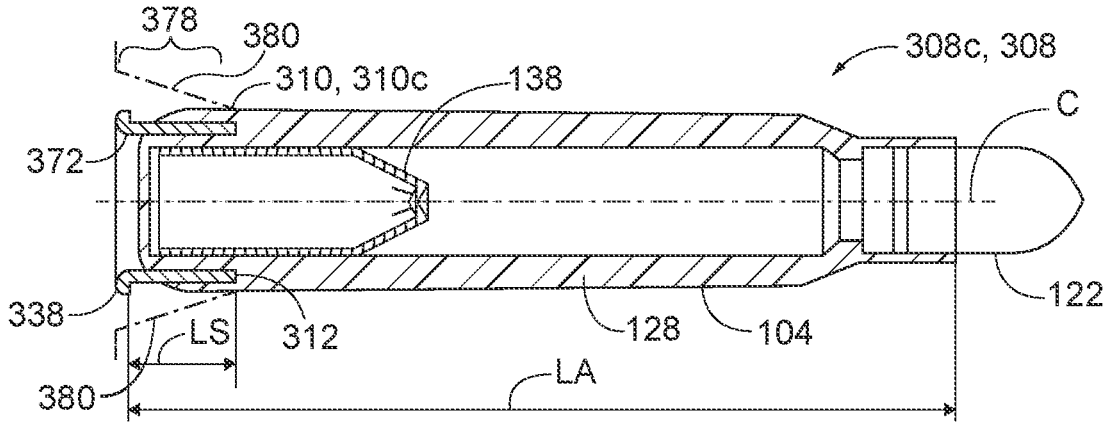
FIGS. 21A through 21C are sectional views of reinforced reduced energy cartridges having reinforcement liners of different lengths according to embodiments of the disclosure.
Figure 21B:
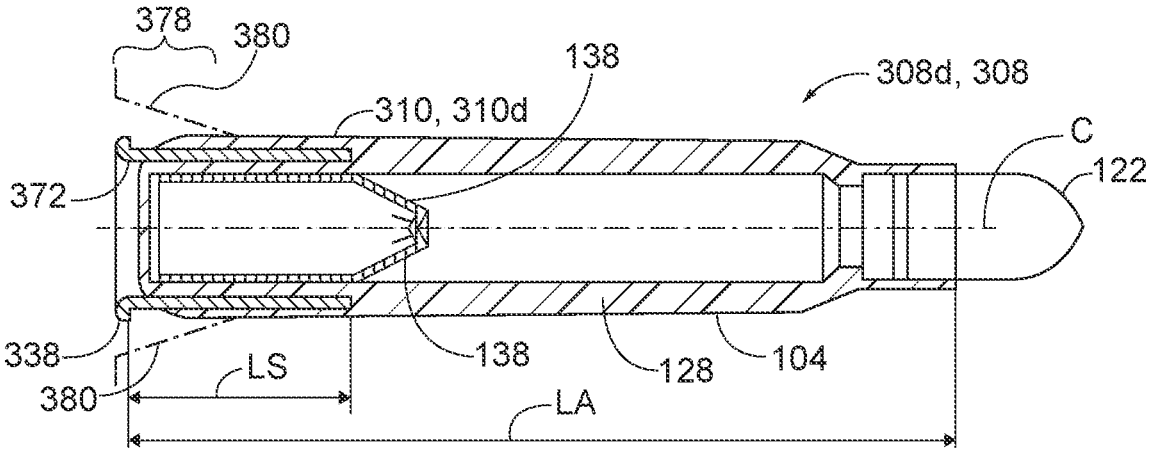
Figure 21C:
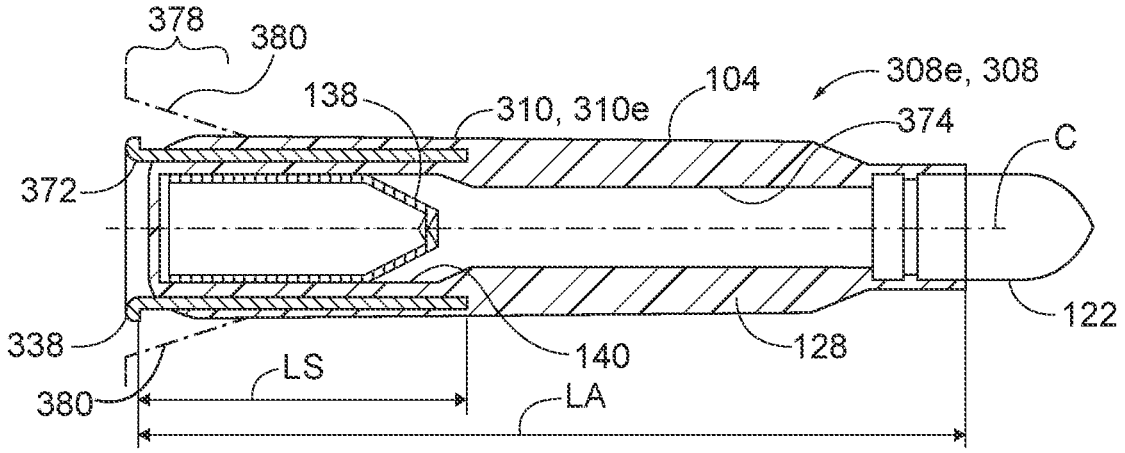

Referring to FIG. 20A, and again to FIGS. 18B and 20, the reinforcement liner 310*b* is depicted in isolation in an embodiment of the disclosure. The reinforcement liner 310*b* includes some of the same components and attributes as the reinforcement liner 310*a*, indicated by same-numbered numerical references. The reinforcement liner 310*b* does not include a shoulder portion, such as the shoulder portion 332 of the reinforcement liner 310*a*. Rather, the flange portion 338 extends directly from a proximal end 334 of the sleeve portion 312 of the reinforcement liner 310*b*, the flange portion 338 also extending radially outward, beyond the sleeve portion 312. In the depicted embodiment, the flange portion defines a minimum inner diameter that is the same as an inner diameter of the proximal end 334 of the sleeve portion 332. The sleeve portion 312 is at least partially imbedded annularly within the polymer case wall 128 of the body portion 130 of the polymer case 104, such that the reinforcement liner 310*b* resides in an annular region 356 within the polymer case wall 128. The outer surface 314 of the sleeve portion 312 may also be textured, for example with tangentially- or axially-extending striations or a knurling pattern (not depicted). In some embodiments, the sleeve portion 312 defines a plurality of perforations 360 to provide surface texturing.

For the depicted embodiment of the reinforced reduced energy cartridge 308*b*, a proximal portion 358 of the reinforcement liner 310*b* extends rearwardly beyond the base 146 of the polymer case 104. A proximal end 362 of the base 146 may define the radiused inner surface 336. In some embodiments, the radiused inner surface 336 of the base 146 and a rearwardly-extending portion 364 of the reinforcement liner 310*b* define the internal axial dimension 346 that is greater than the axial dimension 153 of the hollow rim portion 149 of the propellant unit 138. As such, in combination, the propellant unit 138, the radiused inner surface 336, and the reinforcement liner 310*b* define the recess 352 between the proximal face 342 of the reinforcement liner 310*b* and the anvil 151 of the hollow rim portion 149, the recess 352 defining the axial dimension 354.

The propellant unit 138 is disposed within the base lumen 140 of the polymer case 104. In some embodiments, the base lumen 140 defines a tangentially extending relief groove 366 adjacent the propellant unit 138. The tangentially extending relief groove 366 may surround the propellant unit 138, i.e., be continuous.

Functionally, the reinforcement liner 310 reinforces the base 146 of the reinforced reduced energy cartridge 308 to withstand the forces incurred during discharge of the propellant unit 138, so that the polymer case wall 128 of the reinforced reduced energy cartridge 308 does not rupture during the discharge. The texturing of the outer surface 314, when implemented, enhances the coupling between the polymer case wall 128 and the reinforcement liner 310.

The axial dimension 354 of the recess 352 may be sized so that the reinforced reduced energy cartridges 308 is beyond the reach of center firing pins or rimfiring pins of certain weapons. In this way, the reinforced reduced energy cartridges 308 can be prevented from being discharged in various weapons.

For the reinforcement liner 310*a*, the radial protrusion 320, when implemented, extends radially into the polymer case wall 128 to secure the reinforcement liner 310*a* within the base 146 of the reinforced reduced energy cartridge 308*a*. The radiused inner surface 336 of the shoulder portion 332 of the reinforced reduced energy cartridge 308*a* may be substantially conformal to the hollow rim portion 149 of the propellant unit 138 to prevent deformation of the hollow rim portion 149 when inserted into the reinforcement liner 310*a*. The inner diameter 319 of the sleeve lumen 318 may be dimensioned for a slight interference fit with the propellant unit 138, requiring a light press fit of the propellant unit 138 into the reinforcement liner 310*a*, thereby securing the propellant unit 138 to the reinforcement liner 310*a* during shipping and handling.

For the reinforcement liner 310*b*, a distal end portion 368 of the sleeve portion 312 extends axially into the polymer case wall 128 to secure the reinforcement liner 310*b* within the base 146 of the reinforced reduced energy cartridge 308*b*. Imbedding the distal end portion 368 within the polymer case wall 128 prevents expanding gasses from leaking between the reinforcement liner 310*b* and the polymer case 104, thereby preventing failure of the polymer case wall 128 at the base 146.

The radiused inner surface 336 of the base 146 may be substantially conformal to the hollow rim portion 149 of the propellant unit 138 to prevent deformation of the hollow rim portion 149 when inserted into the base 146. The inner diameter of the base lumen 140 may be dimensioned for a slight interference fit with the propellant unit 138, requiring a light press fit of the propellant unit 138 into the polymer case 104, thereby securing the propellant unit 138 to the reinforcement liner 310*b* during shipping and handling.

The tangentially extending relief groove 366 provides relief for the expansion of the housing 148 of the propellant unit 138. Upon discharge of the propellant unit 138, the housing 148 may expand radially into the tangentially extending relief groove 366, thereby capturing and preventing the spent housing 148 from being propelled rearwardly within or out of the polymer case 104.

The reinforcement liners 310 may be fabricated by techniques known to the artisan, for example by stamping, milling, injection molding (including metals), or casting. The reinforcement liners 310 may be fabricated from any material strong enough to withstand the forces incurred during discharge of the propellant unit 138, such as metals or high strength epoxies.

Referring to FIGS. 21A through 21C, 22A through 22C, 23A through 23C, and 24, reinforced reduced energy cartridges 308 having variously configured reinforcement liners 310 are depicted according to embodiments of the disclosure. The reinforcement liners 310*c*, 310*d*, and 310*e* and corresponding reduced energy cartridges 308*c*, 308*d*, and 308*e* (FIGS. 21A through 21C) have many of the same components and attributes as reinforcement liner 310*b*, which are indicated with same-numbered reference characters. In reference to each other, the reinforcement liners 310*c*, 310*d*, and 310*e* differ only in a length LS of the sleeve portion 312. The length LS of the sleeve portion 312 of the reinforcement liner 310*c* is approximately the same length as the unsupported region 378 of the cartridge 308*c* within a firing chamber 380 (depicted in phantom in FIGS. 21A-21C) of a firearm. The length LS of the sleeve portion 312 of the reinforcement liner 310*d* extends partway along the blank power load 138 but beyond the unsupported region 378 of the cartridge 308*d*. The length LS of the sleeve portion 312 of the reinforcement liner 310*e* extends beyond the length of the blank power load 138.

Accordingly, in some embodiments, a ratio of the length LS of the sleeve portion 312 of the reinforcement liner 310 to an overall length LA of the polymer case 104 is in a range of 5% to 20% inclusive. In some embodiments, the ratio of the length LS of the sleeve portion 312 of the reinforcement liner 310 to an overall length LA of the polymer case 104 is in a range of 20% to 40% inclusive. In some embodiments, the ratio of the length LS of the sleeve portion 312 of the reinforcement liner 310 to an overall length LA of the polymer case 104 is in a range of 30% to 50% inclusive.

The reinforcement liners 310*c*, 310*d*, and 310*e* also depict a radiused corner 372 at the inner diameter of the flange portion 338. The reinforced reduced energy cartridge 308*e* also depicts a body lumen 374 of reduced diameter relative to the base lumen 140 for increased thickness of the unitary polymer case wall 128 relative to wall thickness about the rearward cavity 152, in combination with a rim fire blank power load 138. It is noted that the increased thickness of the unitary polymer case wall 128 may be implemented in any of the reinforced reduced energy cartridges 308, as well as reduced energy cartridges 108. It is further noted that it is not necessary to implement the increased thickness of the unitary polymer case wall 128 in the reinforced reduced energy cartridge 308*e*.

Reinforcement liners 310*f* and 310*g* of reinforced reduced energy cartridge 308*f* and 308*g* (FIGS. 22A through 22C) also have many of the same components and attributes as reinforcement liner 310*b*, which are indicated with same-numbered reference characters. The reinforcement liners 310*f* and 310*g* also depict sleeve portions 312 of differing sleeve length LS. In addition, reinforcement liners 310*f* and 310*g* include a radial protrusion 382 that extends from a distal end of the sleeve portion 312. In the depicted embodiments, the radial protrusion 382 is imbedded within the polymer case wall 128 of the body portion 130 of the reinforced reduced energy cartridge 308*f*, 308*g*. The radial protrusion 382 projects radially inward (i.e., toward the longitudinal axis C).

Figure 22A:
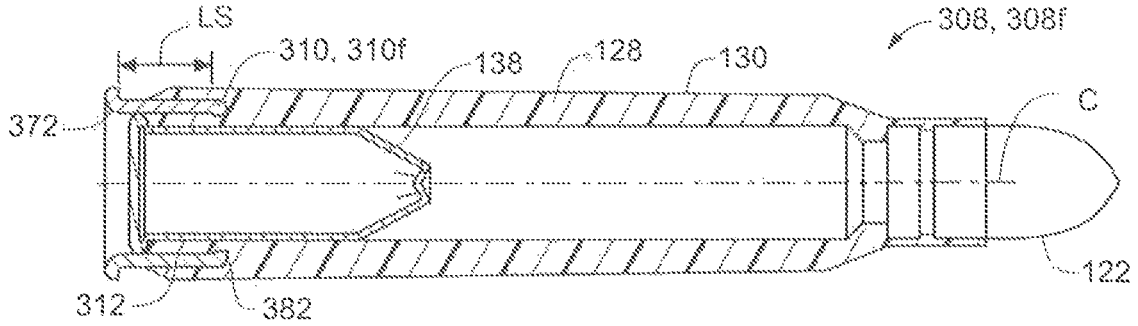
FIGS. 22A and 22B are sectional views of reinforced reduced energy cartridges having reinforcement liners of different lengths according to embodiments of the disclosure.
Figure 22B:
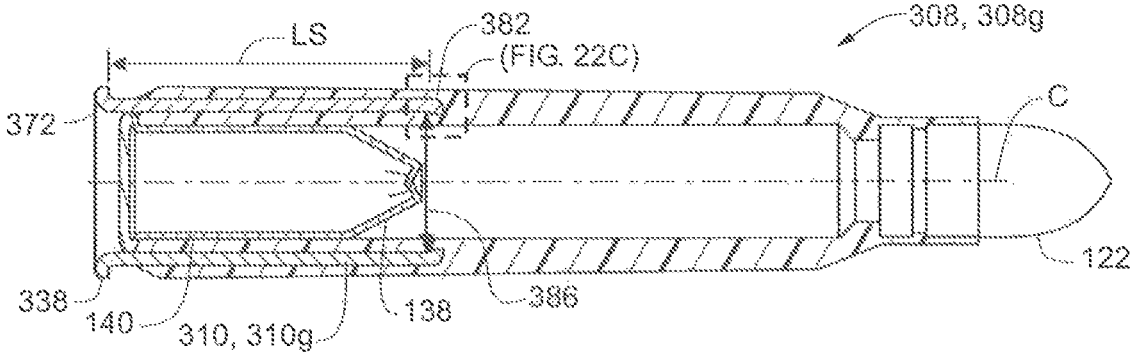
Figure 22C:
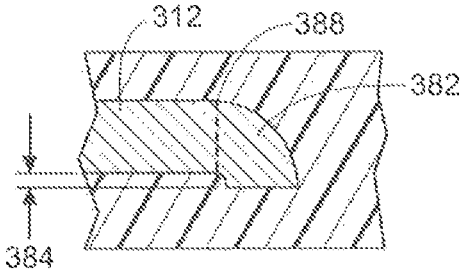
FIG. 22C is an enlarged, partial view of FIG. 22B depicting a radial protrusion at a distal end of the reinforcement liner that projects radially inward.

The radial protrusion 382 may be continuous. The radial protrusion 382 defines a radial protrusion dimension 384 relative to an inner diameter 386 of the sleeve portion 312 at a distal end 388 of the sleeve portion 312 (FIG. 22C). In some embodiments, the radial protrusion dimension 384 is in a range of 75 micrometers to 250 micrometers inclusive. In some embodiments, the radial protrusion dimension 384 is in a range of 75 micrometers to 150 micrometers inclusive. In some embodiments, the radial protrusion dimension 384 is in a range of 100 micrometers to 150 micrometers inclusive.

Reinforcement liner 310*h* of reinforced reduced energy cartridge 308*h* (FIGS. 23A and 23B) includes a sleeve portion 312 having an inwardly inclined inner surface 392 that defines a converging incline or taper from a proximal end 393 to a distal end 395 of the sleeve portion 312, such that a proximal inner diameter 394 of the sleeve portion 312 (i.e., the diameter at the junction of the sleeve portion 312 and the flange portion 338) is greater than a distal inner diameter 396 of the sleeve portion 312.

Figure 23A:
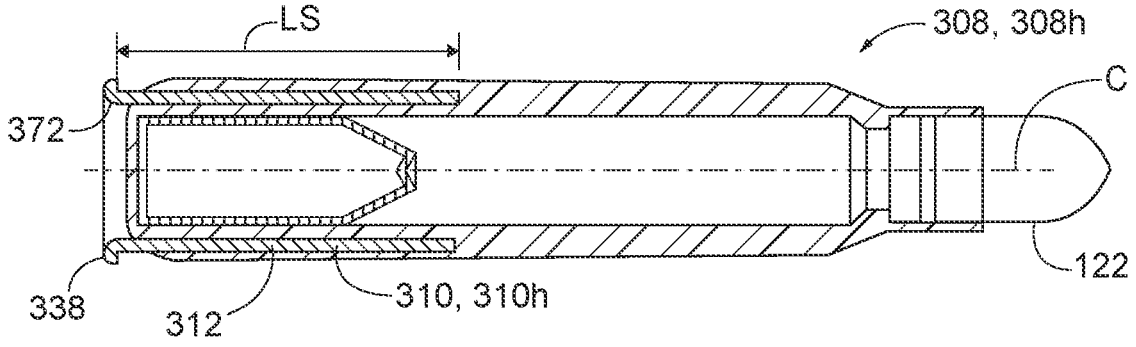
FIG. 23A is a sectional view of a reinforced reduced energy cartridge with a reinforcement liner having a tapered sleeve portion with an inner surface that tapers inward from the proximal end to the distal end according to an embodiment of the disclosure.
Figure 23B:
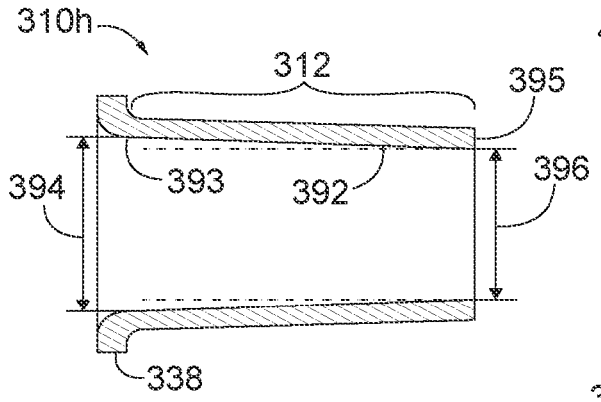
FIG. 23B is a sectional view of a reinforcement liner having a sleeve portion with an inner surface that tapers inward from the proximal end to the distal end according to an embodiment of the disclosure.
Figure 23C:
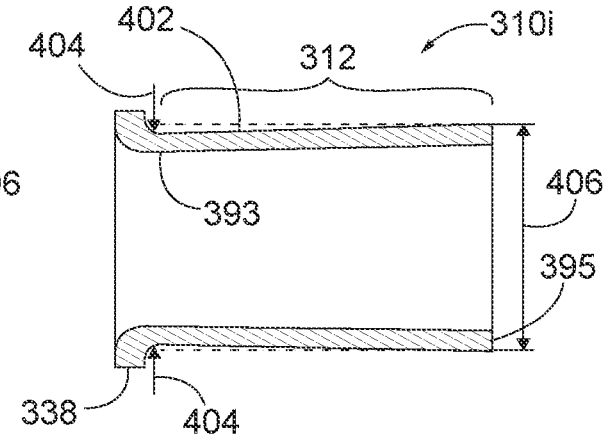
FIG. 23C is a sectional view of a reinforcement liner having a sleeve portion with an outer surface that tapers outward from the proximal end to the distal end according to an embodiment of the disclosure.
Figure 24:
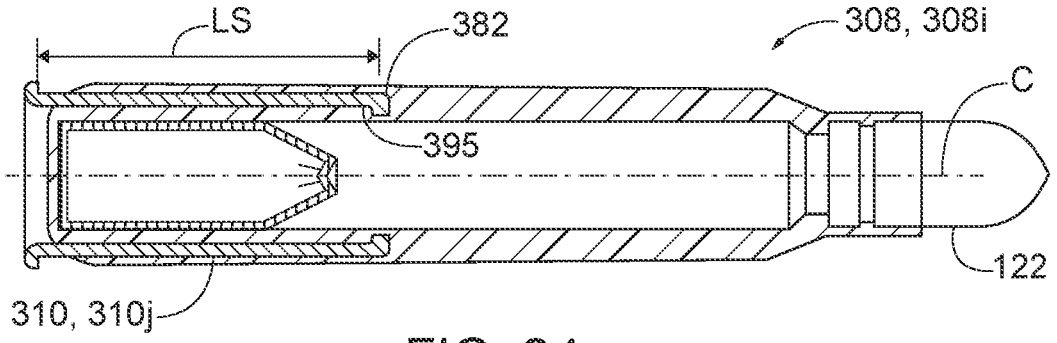
FIG. 24 is a sectional view of a reinforced reduced energy cartridge with a reinforcement liner having a tapered sleeve portion with an inner surface that tapers inward from the proximal end to the distal end and having a radial protrusion at a distal end of the reinforcement liner that projects radially inward according to an embodiment of the disclosure.

Alternatively, or in addition, a reinforcement liner 310*i* may include an outwardly inclined outer surface 402, as depicted in FIG. 23C. For this embodiment, the sleeve portion 312 defines a diverging incline or taper from the proximal end 393 to the distal end 395 of the sleeve portion 312, such that a proximal outer diameter 404 of the sleeve portion 312 (i.e., the diameter at the junction of the sleeve portion 312 and the flange portion 338) is greater than a distal outer diameter 406 of the sleeve portion 312. Also, the embodiments of FIGS. 23A and 24 may also incorporate the various lengths LS of the sleeve portion 312 depicted in FIGS. 21A through 21C and described attendant thereto.

Geometries where the sleeve portion 312 of the reinforcement liner 310 defines inner or outer surfaces 392, 402 that are inclined are herein referred to as "tapered-cylindrical." The tapered-cylindrical geometries depicted in FIGS. 23A, 23B, and 23C are frustoconical geometries, depicted with the incline of the surfaces 392 and 402 exaggerated for illustrative effect. The inclined surfaces 392 and 402 can be achieved with geometries other than a frustoconical geometry. For example, the inclined surfaces 392 and 402 can define a monotonic arcuate surface that is or approximates a segment of a circular, hyperbolic, or elliptical profile.

The reinforcement liners 310*h* and 310*i* may be characterized by the magnitude of the incline of the sleeve portion 312. The "magnitude of the incline" is taken as the difference between the proximal end and distal end diameters. Specifically, for the inwardly inclined inner surface 392, the magnitude of the incline is the difference between the proximal inner diameter 394 and the distal inner diameter 396 of the sleeve portion 312. For the outwardly inclined outer surface 402, the magnitude of the incline is the difference between the distal outer diameter 406 and the proximal outer diameter 404 of the sleeve portion 312. In some embodiments, the magnitude of the incline is in a range of 75 micrometers to 250 micrometers inclusive. In some embodiments, the magnitude of the incline is in a range of 75 micrometers to 150 micrometers inclusive. In some embodiments, the magnitude of the incline is in a range of 100 micrometers to 150 micrometers inclusive.

Reinforcement liner 310*j* of reinforced reduced energy cartridge 308*j* (FIG. 24) includes the same geometrical form as the reinforcement liner 310*h*, with the addition of the radial protrusion 382 that extends from the distal end 395 of the sleeve portion 312. The radial protrusion 382 described attendant to reinforcement liners reinforcement liners 310*f* and 310*g* is applied mutatis mutandis to inclined geometries of the reinforcement liners 310*i* and 310*j*. In some embodiments, the protrusion dimension 384 and the magnitude of the incline are each within the ranges state above. In some embodiments, the combination of the protrusion dimension 384 and the magnitude of the incline is in a range of 75 micrometers to 250 micrometers inclusive. In some embodiments, the combination of the protrusion dimension 384 and the magnitude of the incline is in a range of 75 micrometers to 150 micrometers inclusive. In some embodiments, the combination of the protrusion dimension 384 and the magnitude of the incline is in a range of 100 micrometers to 150 micrometers inclusive.

Functionally, the length of the sleeve portions 312 may be dictated by the power level of the respective reinforced reduced energy cartridge 308. That is, as power increases, the length of the sleeve portion 312 may need to increase as well to effectively bridge and prevent failure of the portion of the polymer case 104 that is not supported by the chamber of the firearm. The radiused corner 372 may facilitate ejection of the reinforced reduced energy cartridge 308, as explained in further detail below. Both the inward radial protrusion 382 of (FIGS. 22A, 22B, and 24) and the inward inclined surface effectively creates an interference between reinforcement liner 310*f*, 310*g* and the polymer case wall 128 that resists axial movement of the reinforcement liner 310*f*, 310*g* relative to the reinforced reduced energy cartridge 308, which militates against dislodging the reinforcement liner 310*f*, 310*g* from the polymer case wall 128 during operation (e.g., discharge and extraction). For embodiments defining the body lumen 374 of reduced diameter relative to the base lumen 140 with the unitary polymer case wall 128, the unitary construction enables the expanding gases and attendant pressures generated during discharge of the cartridge to be bounded by the body lumen 374, such that gas cannot bypass the body lumen 374. Bounding of the expanding gases by the body lumen 374 thus increases the strength of the polymer case wall 128 relative, for example, to use of a bushing inserted in a polymer casing to define a body lumen.

Referring to FIGS. 25A through 25D, a manufacturing process for injection molding of the reinforced reduced energy cartridge 308*a* is schematically depicted in an embodiment of the disclosure. A mold 400 having two complementary radial halves 402*a* and 402*b* cooperate to define a mold cavity 405, a first registration aperture 406 for the projectile 122, and a second registration aperture 408 for the reinforcement liner 310*a*. The complementary halves 402*a* and 402*b* include injection and venting ports 412 and 414, respectively. In some embodiments, the injection port comprises multiple fanned-shaped passages to approximate a disk-shaped void that surrounds the mold cavity. The mold 400 may also include radial inward protrusions (not depicted) for defining the longitudinal flutes of the polymer case 104.

Figure 25A:
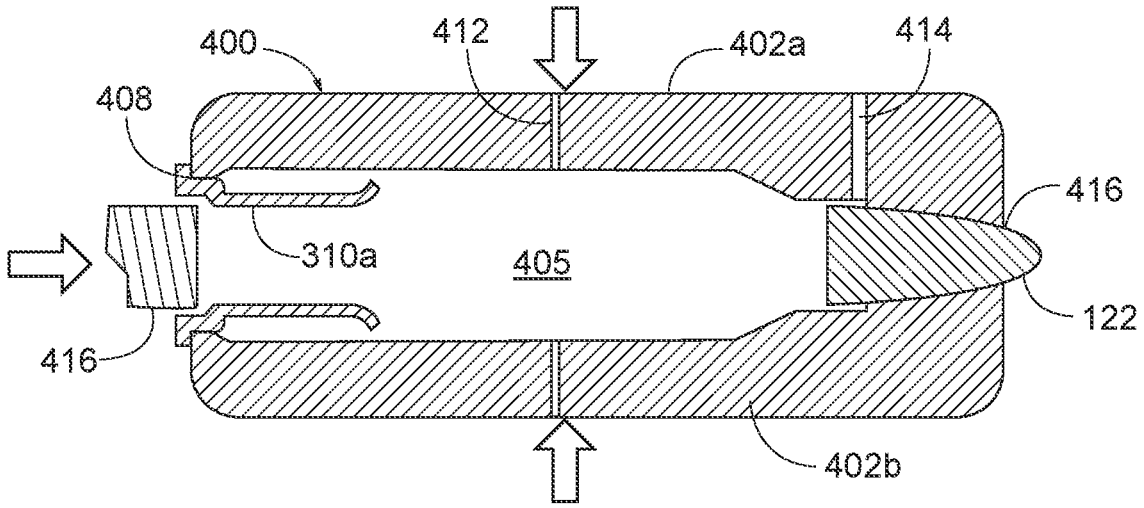
FIG. 25A is a schematic, cross-sectional view of a mold with a reinforcement liner and a projectile mounted thereto according to an embodiment of the disclosure.
Figure 25B:
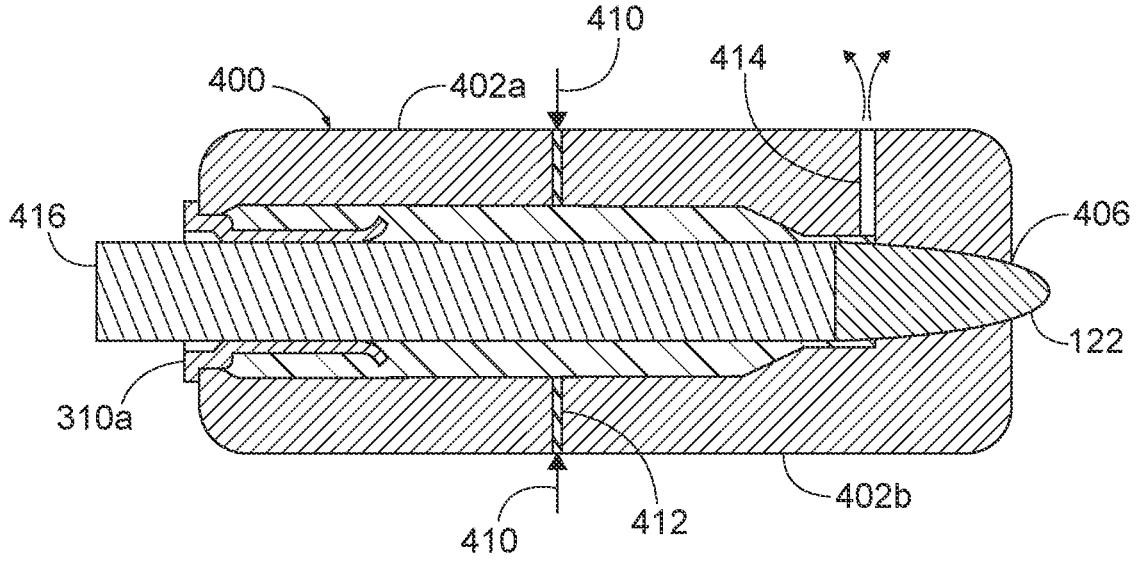
FIG. 25B is a schematic, cross-sectional view of the mold of FIG. 21A with a pull core mounted therein and during injection of a liquid polymer according to an embodiment of the disclosure.

A pull core 416 is inserted through the reinforcement liner 310*a* and registered against and concentrically with the projectile 122 (FIG. 25B). Upon registration of the projectile 122, the reinforcement liner 310*a*, and the core pull 416, the exposed surfaces of the mold cavity 405 define the exterior surfaces of the polymer case 104, and the core pull 416 defines the base lumen 140. The core pull 416 and the projectile 122 cooperate to define the neck lumen 134.

Figure 25C:
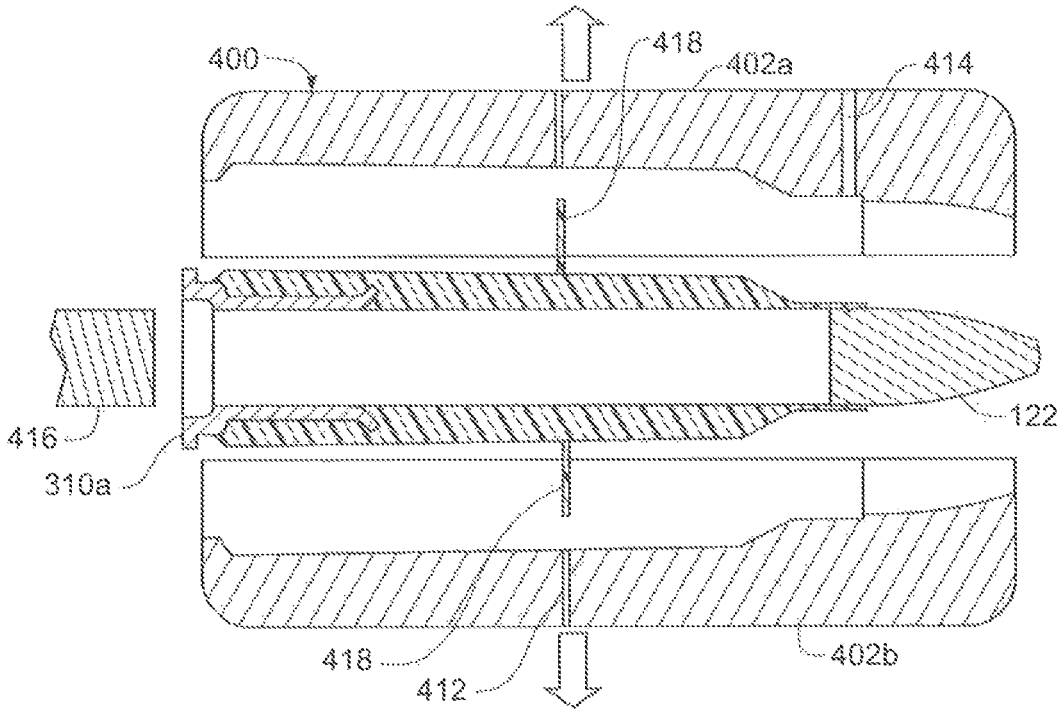
FIG. 25C is a schematic, cross-sectional view of the mold of FIG. 21B with the pull core removed and the mold separated after curing of the polymer according to an embodiment of the disclosure.
Figure 25D:
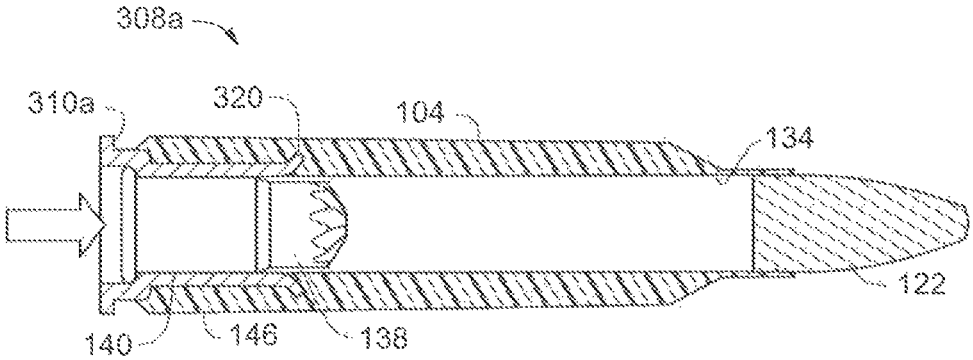
FIG. 25D is a schematic, cross-sectional view of insertion of a propellant unit into the cartridge produced by the mold process of FIGS. 25A-25C according to an embodiment of the disclosure.

Liquid polymer 410 is injected through the injection port 412 to fill the remaining voids of the mold cavity 405. Displaced gas from the mold cavity 405 is vented through the vent port 414 (FIG. 25B). When the polymer case wall 128 is sufficiently cured, the core pull 416 is removed and the polymer case 104 removed from the mold (FIG. 25C). In the depiction of FIG. 25C, the mold 400 is a clam-shell type mold, where the opposing sides 402*a*, 402*b* of the mold 400 are separated to free the polymer case 104. Sprues 418 (FIG. 25C) that may be formed on the polymer case 104 during the molding process may then be removed. The propellant unit 138 is then inserted into the reinforcement liner 310*a* (FIG. 25D).

Figure 26:
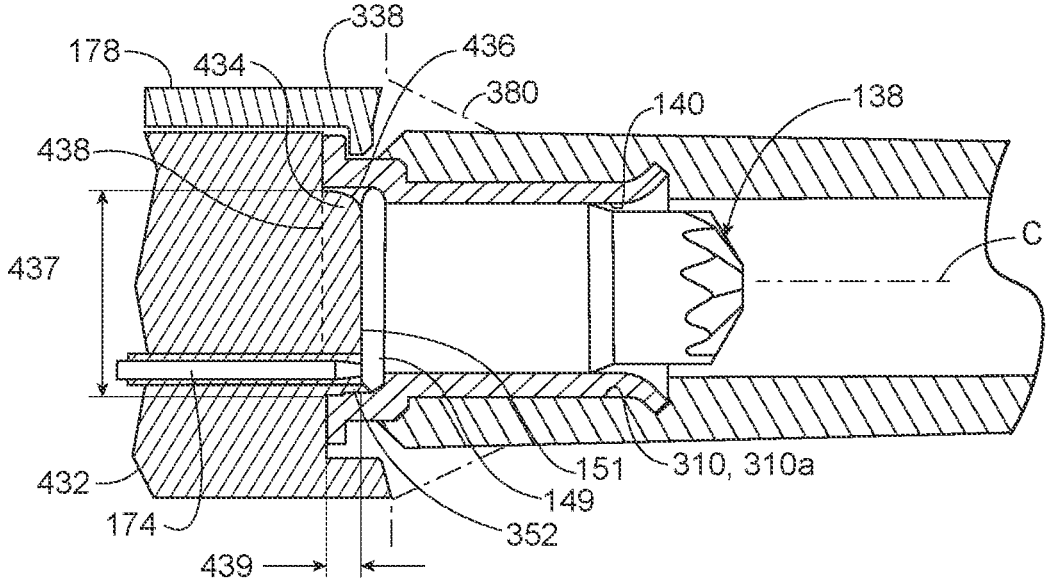
FIG. 26 is a cross-sectional view of a bolt having a raised portion with radiused relief shoulders and engaged with a cartridge according to an embodiment of the disclosure.
Figure 27:
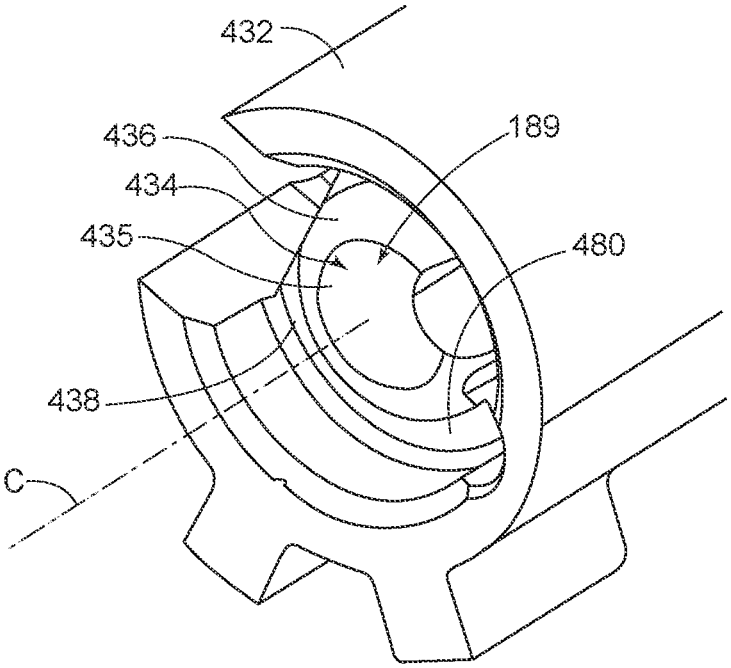
FIG. 27 is an enlarged, partial perspective view of the bolt of FIG. 26 according to an embodiment of the disclosure.

Referring to FIGS. 26 and 27, a bolt 432 having a raised portion 434 with radiused relief shoulders 436 is depicted in an embodiment of the disclosure. The raised portion 434 is a protrusion at a forward end of the bolt 432 that defines a forward or distal face 435, the raised portion 434 defining a radial dimension 437 and an axial dimension 439. The radial dimension 437 of the raised portion 434 is dimensioned to translate into the recess 352 along the longitudinal axis C without interference. The axial dimension 439 is sized to contact the anvil 151 of the propellant unit 138 when the reinforced reduced energy cartridge 308 is loaded in the firing chamber 380 and the flange portion 338 is registered against the bolt 432 (i.e., prior to and during discharge of the propellant unit 138. In the depicted embodiment, the radiused relief shoulders 436 are fully radiused, meaning that the radius starts at a base 438 of the raised portion 434 to define a quarter-circle profile.

Functionally, the raised portion 434 prevents the propellant unit 138 from being displaced rearwardly within the base lumen 140 during discharge. Such displacement may otherwise occur upon contact with the rimfire firing pin 174, causing the anvil 151 of the propellant unit 138 to tear or rupture against the firing pin 174 before the firing pin 174 is withdrawn. Such rupture can cause some of the expanding gases to leak therethrough, reducing the energy imparted to the projectile in an unwanted and unpredictable manner.

Figure 28:
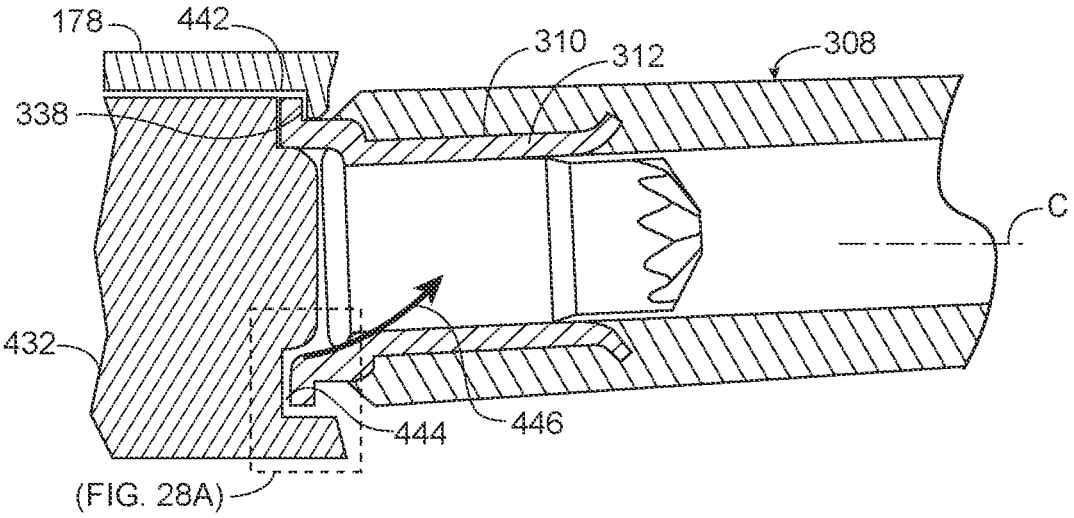
FIG. 28 is a partial, cross-sectional view of the bolt and cartridge of FIG. 26 during the initiation of ejection according to an embodiment of the disclosure.
Figure 28A:
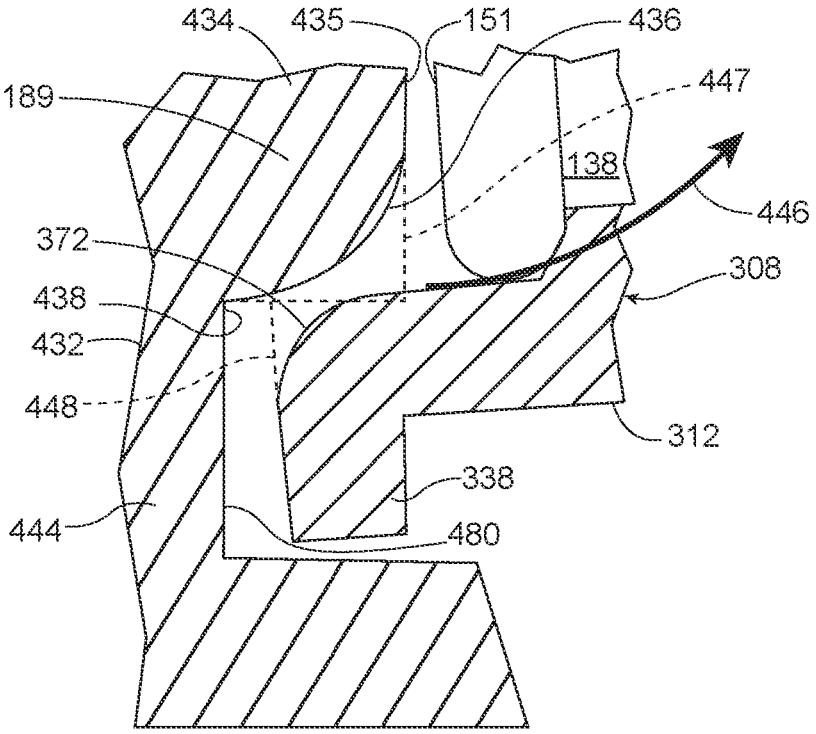
FIG. 28A is an enlarged, partial sectional view of FIG. 28.

Referring to FIGS. 28 and 28A, the function of the radiused relief shoulders 436 is described according to an embodiment of the disclosure. During ejection of the reinforced reduced energy cartridge 308, the flange portion 338 of the reinforcement liner 310 of the cartridge 308 pivots laterally about the extractor 178 to define a contact point or line 442 between the extractor 178 and the flange portion 338. The reinforcement liner 310 lifts away from an opposed portion 444 of the of the bolt 432, the opposed portion 444 being so-named because it is diametrically opposed to the extractor 178. The flange portion 338 of the reinforcement liner 310 that is adjacent the opposed portion 444 lifts away from the bolt 432 in an arc 446 that is centered about the contact point 442.

Because of the arcing action, the portion of the flange portion 338 that is adjacent the opposed portion 444 of the bolt 432 moves radially inward, toward the longitudinal axis C. The radiused relief shoulders 436 enable flange portion 338 to clear the bolt 432 without incidental contact with the raised portion 434. To illustrate this effect, a hypothetical squared corner profile 447 for the raised portion 434 is depicted in phantom in FIG. 28A. The depiction illustrates that if the raised portion 434 had the profile of the hypothetical squared corner profile 447, the flange portion 338 would glancingly contact the raised portion 434 as the reinforced reduced energy cartridge 308 arcs toward the longitudinal axis C. Such incidental contact could inhibit the rapid ejection of the cartridge that is relied upon for smooth operation of the rifle system 100.

The FIG. 28A depiction also illustrates a hypothetical squared corner profile 448 for the flange portion 338, also depicted in phantom. The phantom lines 447 and 448 illustrate that the incidental contact would be exacerbated if both the flange portion 338 and the raised portion 434 had square corner profiles. Accordingly, the radiused relief shoulders 436 of the raised portion 434 and the radiused corners 372 of the flange portion 338 combine to provide ample clearance that militates against incidental contact between the reinforced reduced energy cartridge 308 and the raised portion 434 of the bolt 432. Because of this ample clearance, fully radiused relief shoulders are not necessary. That is, the radius need not extend to the base 438 of the raised portion 434, particularly in combination with cartridges 308 that have radiused flange corners 437. Rather, the radius of the radiused relief shoulders 436 may extend only partway along the axial dimension 439. Such an arrangement would define a smaller radiused shoulder than the full radiused shoulder depicted, thus providing a larger distal face 435 for support of the anvil 151.

Figure 29:
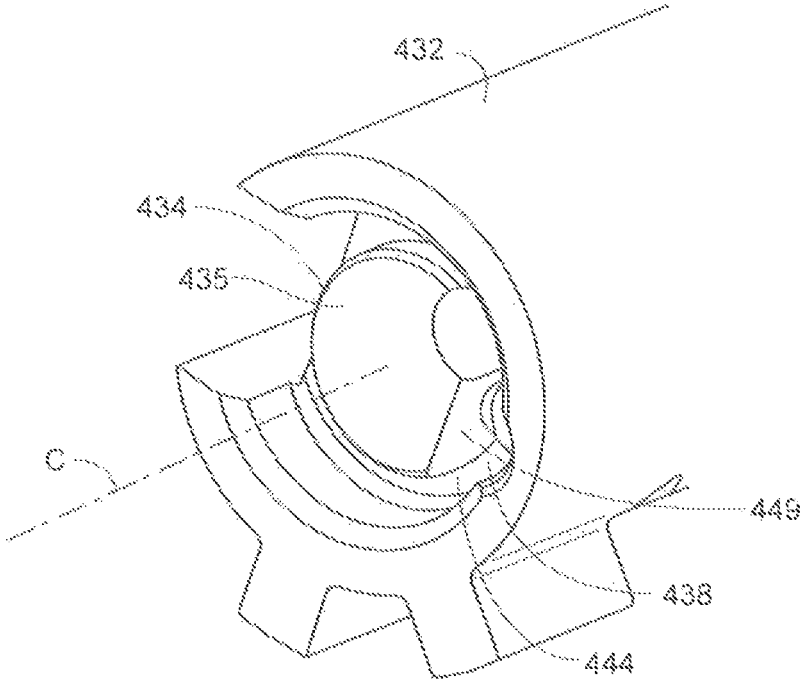
FIG. 29 is an enlarged, partial perspective view of a bolt having a sloped relief face according to an embodiment of the disclosure.
Figure 30:
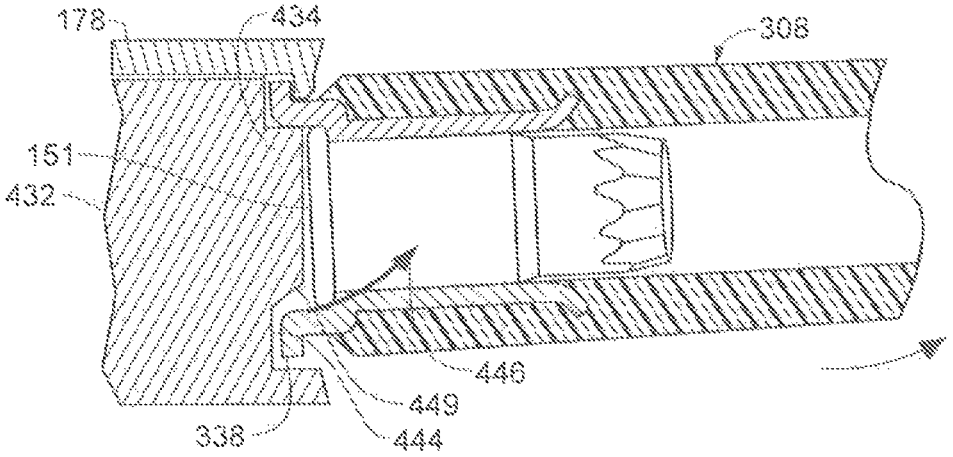
FIG. 30 is a partial, cross-sectional view of the bolt and cartridge of FIG. 29 during the initiation of ejection according to an embodiment of the disclosure.

Referring to FIGS. 29 and 30, a raised portion 434 including a sloped relief face 449 at the opposed portion 444 of the bolt 432. In the depicted embodiment, the sloped relief face 449 is limited locally to the raised portion 434 of the opposed portion 444.

Functionally, the sloped relief face 449 operates to the same effect as the radiused relief shoulders 436, as depicted in FIG. 30. That is, the sloped relief face 449 enables the flange portion 338 to clear the raised portion 434. The remainder of the raised portion 434 may include substantially square corners. Accordingly, the reduction in the contact area between the distal face 435 and the anvil 151 may be increased relative to radiused relief shoulder configurations, which may enhance the integrity of the support of the anvil 151 for higher powered loads.

Alternative relief structures for providing clearance between the reinforced reduced energy cartridge 308 and the raised portion 434 of the bolt 432 are also contemplated. For example, the raised portion 434 could be of a frustoconical shape that tapers toward the longitudinal axis C at the distal face 435. Also, instead of radiused shoulders, chamfered shoulders may be used to the same effect. Also, the radiused, chamfered, or frustoconical relief does have to be continuous about the periphery of the raised portion 434. Rather, as with the sloped relief face 449, the radiused, chamfered, or frustoconical relief may be localized to the opposed portion 444 of the raised portion 434 of the bolt 432.

Figure 31A:
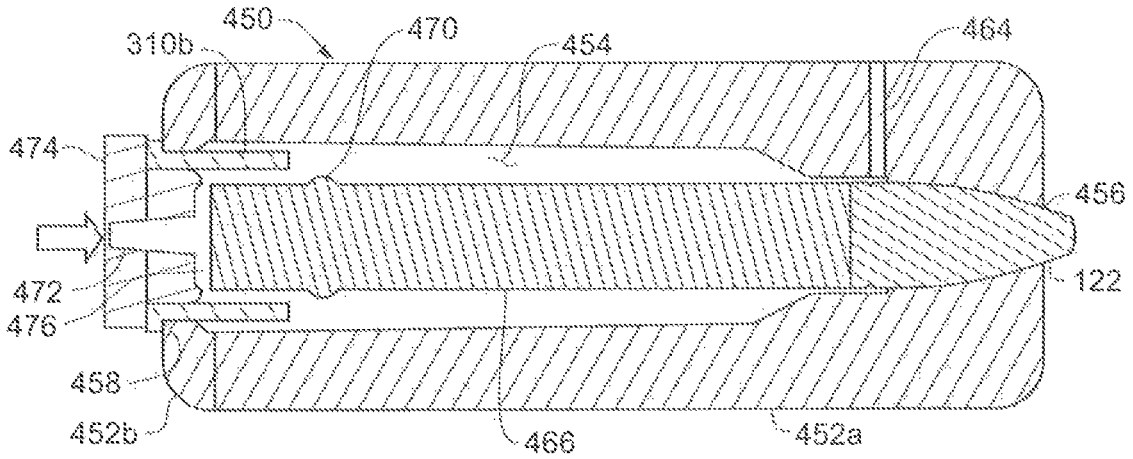
FIG. 31A is a schematic, cross-sectional view of a mold with a reinforcement liner, a projectile, a core pull, and a fitment mounted thereto according to an embodiment of the disclosure.
Figure 31B:
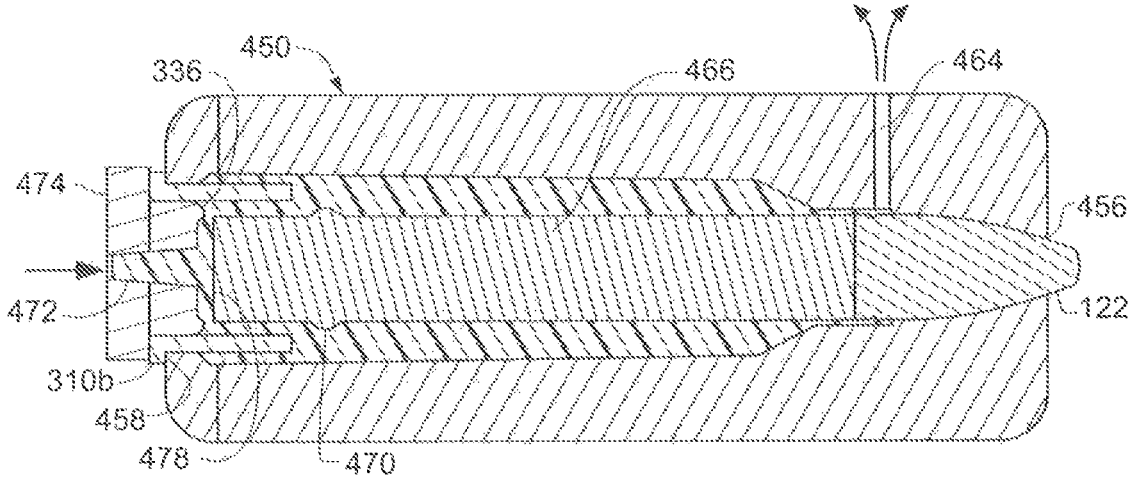
FIG. 31B is a schematic, cross-sectional view of the mold of FIG. 33A during injection of a liquid polymer according to an embodiment of the disclosure.

Referring to FIGS. 31A through 31E, a manufacturing process for injection molding of the reinforced reduced energy cartridge 308*b* is schematically depicted in an embodiment of the disclosure. A mold 450 having two complementary axial components, a forward component 452*a* and a rearward component 452*b*, which cooperate to define a mold cavity 454, a first registration aperture 456 for the projectile 122, and a second registration aperture 458 for the reinforcement liner 310*b*. In the depicted embodiment, the forward component 452*a* of the mold 450 defines a venting port 464. A pull core 466 is inserted through the reinforcement liner 310*b* and registered against and concentrically with the projectile 122 (FIG. 31B). The mold 450 may also include protrusions that project radially inward (not depicted) for defining the longitudinal flutes of the polymer case 104.

An injection port 472 is defined in a fitting 474 that is disposed within the reinforcement liner 310*b* against a proximal end 476 of the pull core 466. In the depicted embodiment, the fitting 474 defines the radiused inner surface 336 of the base 146 during the molding process. Also in the depicted embodiment, the fitting 474 cooperates with the pull core 466 to define a diaphragm gate 478 for injection molding of the polymer case wall 128.

Upon registration of the projectile 122, the reinforcement liner 310*b*, the core pull 466, and the fitting 474, the exposed surfaces of the mold cavity 454 define the exterior surfaces of the polymer case 104, and the core pull 466 defines the base lumen 140 (FIG. 31A). The core pull 466 and the projectile 122 cooperate to define the neck lumen 134.

Liquid polymer 410 is injected through the injection port 472 to fill the remaining voids of the mold cavity 454. Displaced gas from the mold cavity 454 is vented through the vent port 464 (FIG. 33B). When the polymer case wall 128 is sufficiently cured, the core pull 466 is removed and the polymer case 104 removed from the mold (FIG. 25C). Any sprues from the diaphragm gating of the mold may be largely removed from the removal of the pull core 466. Furthermore, any remnant material left within the base lumen 140 from the sprues may assist in providing an interference fit between the propellant unit 138 and the base lumen 140.

As is known in the art, there is a window of time in the curing process where the shape of the molded article is defined and the polymer is set, but the polymer is still soft and pliable. It is during this time window that the core pull 466 is removable from the tangentially extending relief groove 366 without damaging the polymer case 104. Also known in the art is the proper dimensioning of a protrusion 470 that defines the tangentially extending relief groove(s) 366 that enables removal of the core pull 466 without damage to the polymer case 104.

Figure 31C:
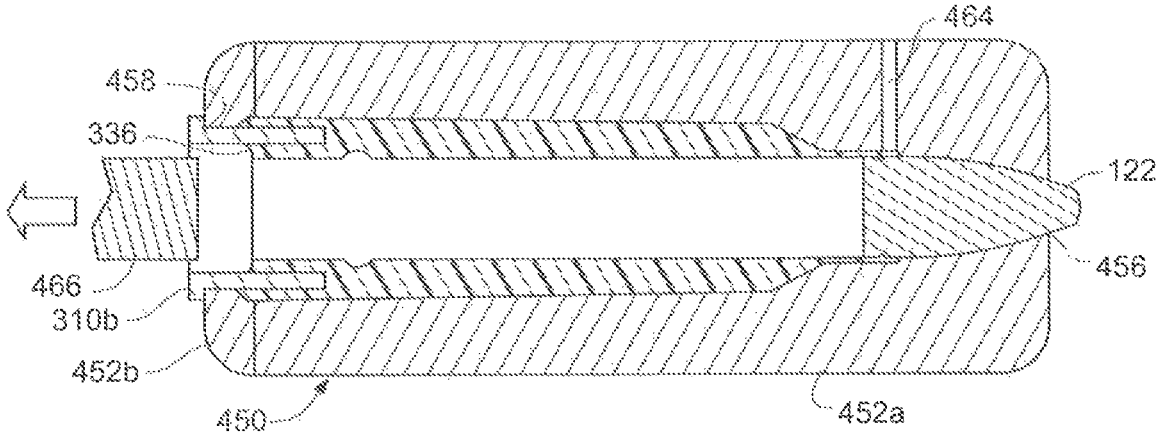
FIG. 31C is a schematic, cross-sectional view of the mold of FIG. 33B with the pull core removed according to an embodiment of the disclosure.
Figure 31D:
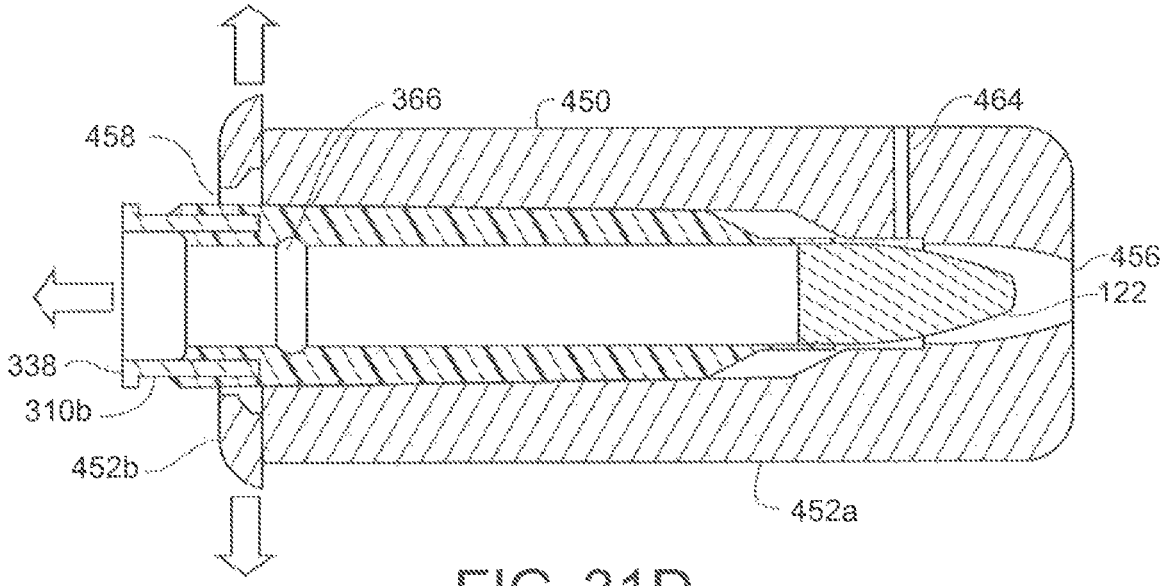
FIG. 31D is a schematic, cross-sectional view of the mold of FIG. 33C with the mold separated and the cartridge being removed after curing of the polymer according to an embodiment of the disclosure.
Figure 31E:
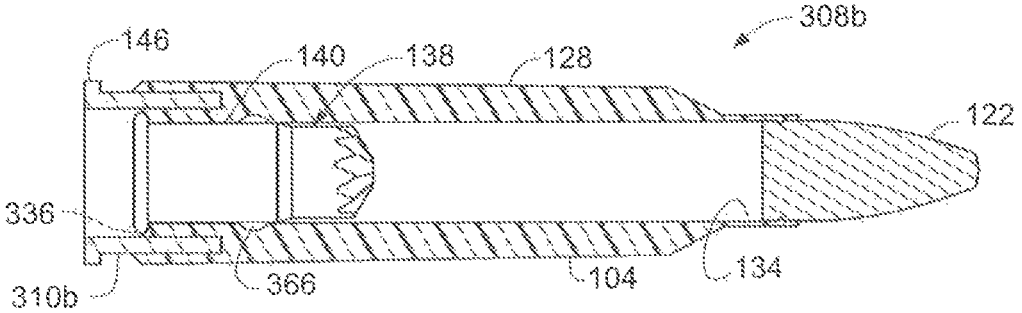
FIG. 31E is a schematic, cross-sectional view of insertion of a propellant unit into the cartridge produced by the mold process of FIGS. 33A-33D according to an embodiment of the disclosure.

In the depiction of FIG. 31C, the mold 450 is an axial pull mold, where the rearward component 452*b* may be bifurcated for removal about the flange 338 of the reinforcement liner 310*b*. Thereafter, the polymer case 104, with the reinforcement liner 310*b* and the projectile 122 overmolded therein, is removed from the forward component 452*a* of the mold 450 (FIG. 31D). The propellant unit 138 is then inserted into the base lumen 140 (FIG. 31E).

The reinforced reduced energy cartridge 308*b* is depicted as defining a single tangentially extending relief groove 366. Alternatively, a plurality of such relief grooves may be defined, each of reduced radial dimension to reduce the force required to remove the core pull 466. Also, the relief groove 366 may be extended in the axial dimension and reduced in the radial dimension to the same effect. Also in the depicted embodiment, the tangentially extending relief groove 366 is disposed forward of the reinforcement liner 310*b*. Alternatively, the relief groove(s) 366 can be disposed closer to the proximal end 362 of the base 146, surrounded by the reinforcement liner 310*b*.

Figure 32:
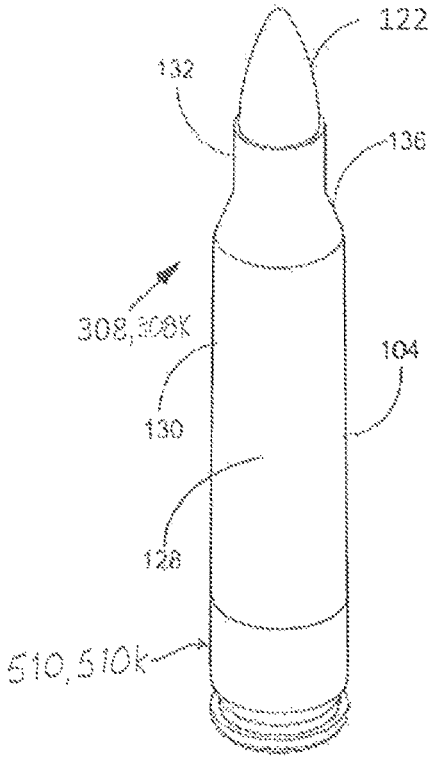
FIG. 32 is a perspective view of a cartridge having a polymer casing with an external reinforcement sleeve according to an embodiment of the disclosure.
Figure 32A:
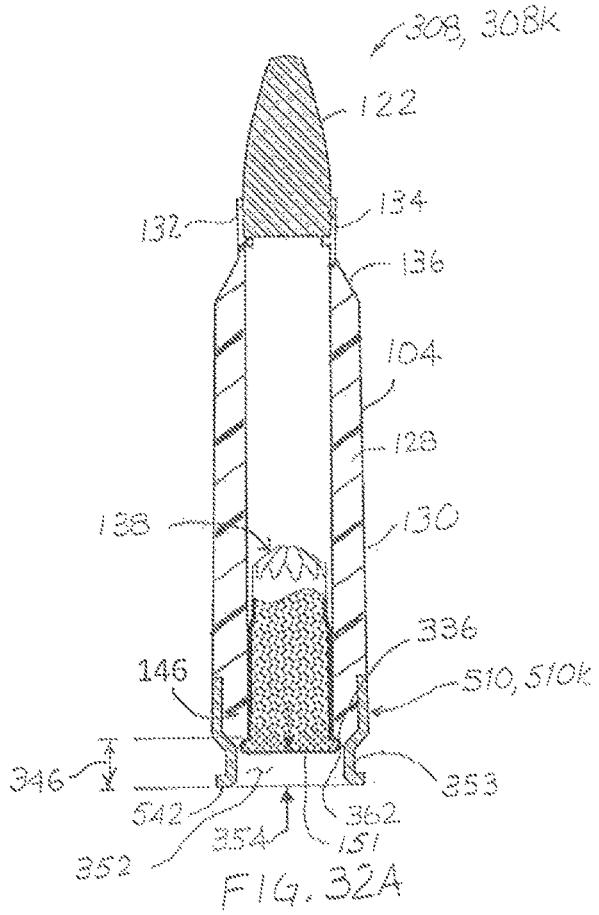
FIG. 32A is a cross-sectional view of the cartridge of FIG. 32 according to an embodiment of the disclosure.

Referring to FIGS. 32 and 32A, a reinforced reduced energy cartridge 308*k* is depicted according to an embodiment of the disclosure. The reinforced reduced energy cartridge 308*k* may include many of the same components and attributes as other reduced energy cartridges 308, indicated by same-numbered numerical references. In addition, the reinforced reduced energy cartridge 308*k* includes an external reinforcement sleeve 510*k* that surrounds the base 146 of the polymer case 104. Herein, external reinforcement sleeves are referred to collectively and generically by reference character 510, with specific configurations referred to by the reference character 510 followed by a letter suffix (e.g., external reinforcement sleeve 510*k* depicted at FIG. 32A).

Figure 33A:
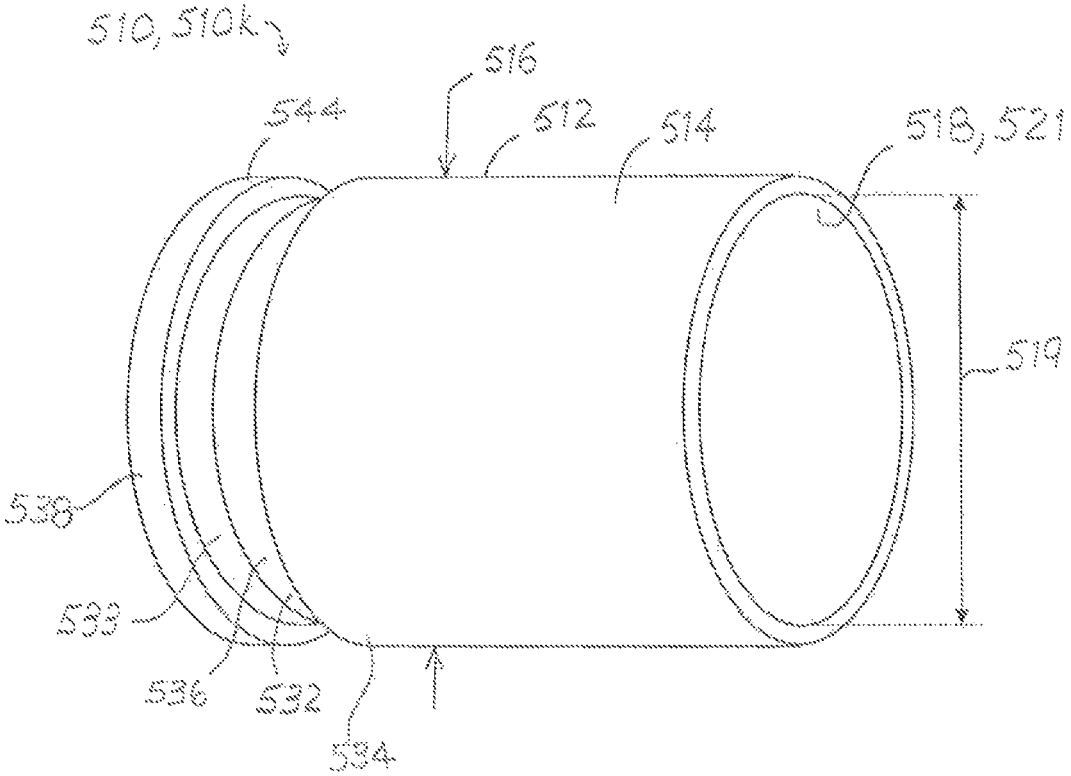
FIGS. 33A and 33B are perspective views of the external reinforcement sleeve of FIG. 32A according to an embodiment of the disclosure.
Figure 33B:
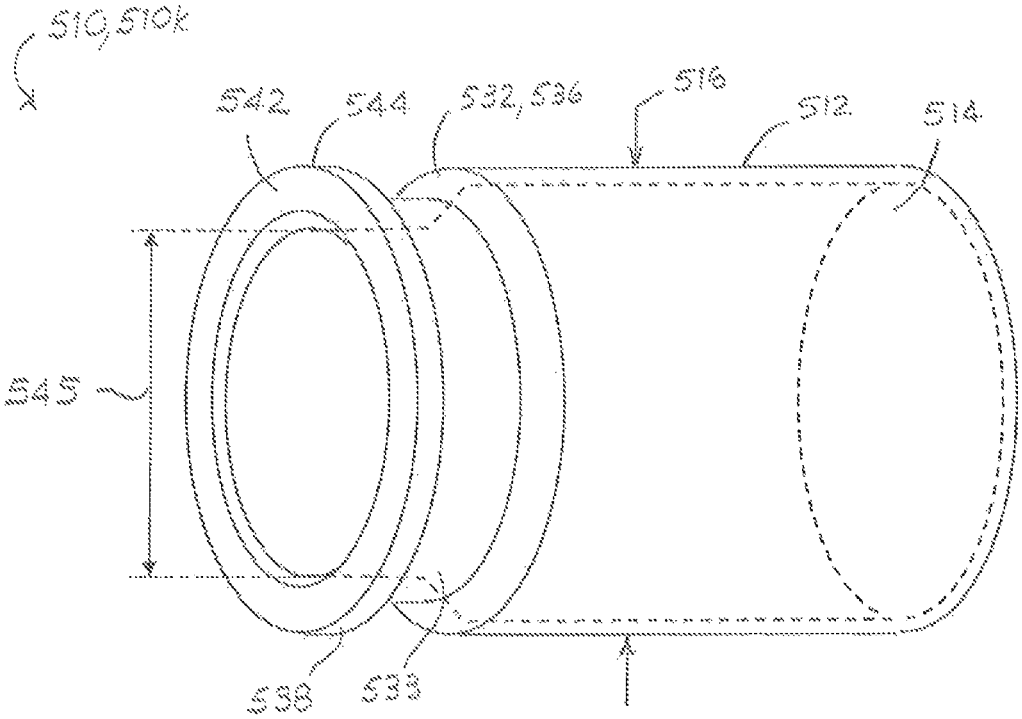

Referring to FIGS. 33A and 33B, the external reinforcement sleeve 510*k* is depicted in isolation according to an embodiment of the disclosure. The external reinforcement sleeve 510*k* includes a sleeve portion 512 having an outer surface 514 that defines an outer diameter 516. In the depicted embodiment, the sleeve portion 512 of the external reinforcement sleeve 510*k* is generally right-cylindrical. Instead of right-cylindrical, the sleeve portion 516 may be tapered (not depicted) to conform to the chamber of certain caliber firearms. The sleeve portion 512 also defines a sleeve lumen 518 that defines a maximum inner diameter 519 of an interior surface 521 of the external reinforcement sleeve 510*k*.

The external reinforcement sleeve 510*k* includes an external shoulder portion 532 that extends from a proximal end 534 of the sleeve portion 512, the external shoulder portion 532 including an outer surface 536. A neck portion 533 extends axially from a proximal end 535 of the shoulder portion 532. A flange portion 538 extends radially outward from the neck portion 533, the flange portion 538 defining a proximal face 542 of the external reinforcement sleeve 510*k* and also defining a radial extremity 544 of the external reinforcement sleeve 510*k*. In the depicted embodiment, the neck portion 533 defines a minimum inner diameter 545 that is less than the maximum inner diameter 519.

For reinforced reduced energy cartridge 308*k*, the neck portion 533 of the external reinforcement sleeve 510*k* extends rearwardly beyond the base 146 of the polymer case 104 (FIG. 32A). As with the reinforced reduced energy cartridge 308*b*, the proximal end 362 of the base 146 may define the radiused inner surface 336. In some embodiments, the radiused inner surface 336 of the base 146 and the proximally extending neck portion 533 of the external reinforcement sleeve 510*k* define the internal axial dimension 346 that is greater than the axial dimension 153 (FIG. 4C) of the hollow rim portion 149 of the propellant unit 138. As such, in combination, the propellant unit 138, the radiused inner surface 336, and the external reinforcement sleeve 510*k* define the recess 352 between the proximal face 542 of the external reinforcement sleeve 510*k* and the anvil 151 of the hollow rim portion 149 of the propellant unit 138, the recess 352 defining the axial dimension 354.

Figure 32B:
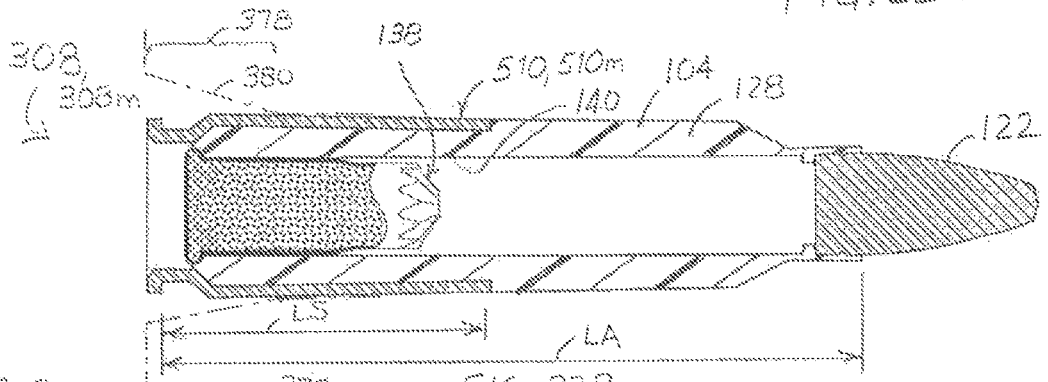
FIGS. 32B and 32C are sectional views of reinforced reduced energy cartridges having external reinforcement sleeves of different lengths according to embodiments of the disclosure.
Figure 32C:
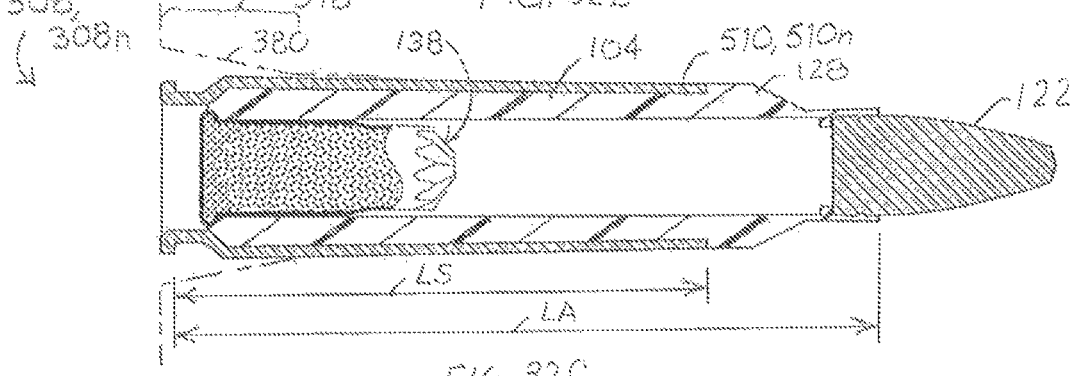

Referring to FIGS. 32B and 32C, reinforced reduced energy cartridges 308*m* and 308*n* having variously configured external reinforcement sleeves 510*m* and 510*n*, respectively, are depicted according to embodiments of the disclosure. The external reinforcement sleeves 510*m* and 510*n* and corresponding reduced energy cartridges 308*m* and 308*n* have many of the same components and attributes as external reinforcement sleeve 510*k*, which are indicated with same-numbered reference characters. In reference to each other, the external reinforcement sleeves 510*m* and 510*n* differ only in the length LS of the sleeve portion 512. The length LS of the sleeve portion 512 of the external reinforcement sleeve 510*m* extends beyond the unsupported region 378 of the cartridge 308*m*, and also beyond the blank power load 138. The length LS of the sleeve portion 512 of the external reinforcement sleeve 510*n* extends to proximate the frustoconical portion 136 of the polymer case 104.

Accordingly, in some embodiments, a ratio of the length LS of the sleeve portion 512 of the external reinforcement sleeve 510 to an overall length LA of the polymer case 104 is in a range of 5% to 20% inclusive. In some embodiments, the ratio of the length LS of the sleeve portion 512 of the external reinforcement sleeve 510 to an overall length LA of the polymer case 104 is in a range of 20% to 50% inclusive. In some embodiments, the ratio of the length LS of the sleeve portion 512 of the external reinforcement sleeve 510 to an overall length LA of the polymer case 104 is in a range of 50% to 80% inclusive.

Referring to FIGS. 34 through 39A, external reinforcement sleeves 510 having retention features 550 for enhancing the coupling between the polymer case 104 and the external reinforcement sleeve 510 are depicted according to various embodiments of the disclosure. Herein, the retention features are referred to collectively and generically by reference character 550, with specific configurations referred to by the reference character 550 followed by a letter suffix (e.g., punched retention feature 550*o* depicted at FIG. 34).

Figure 34:
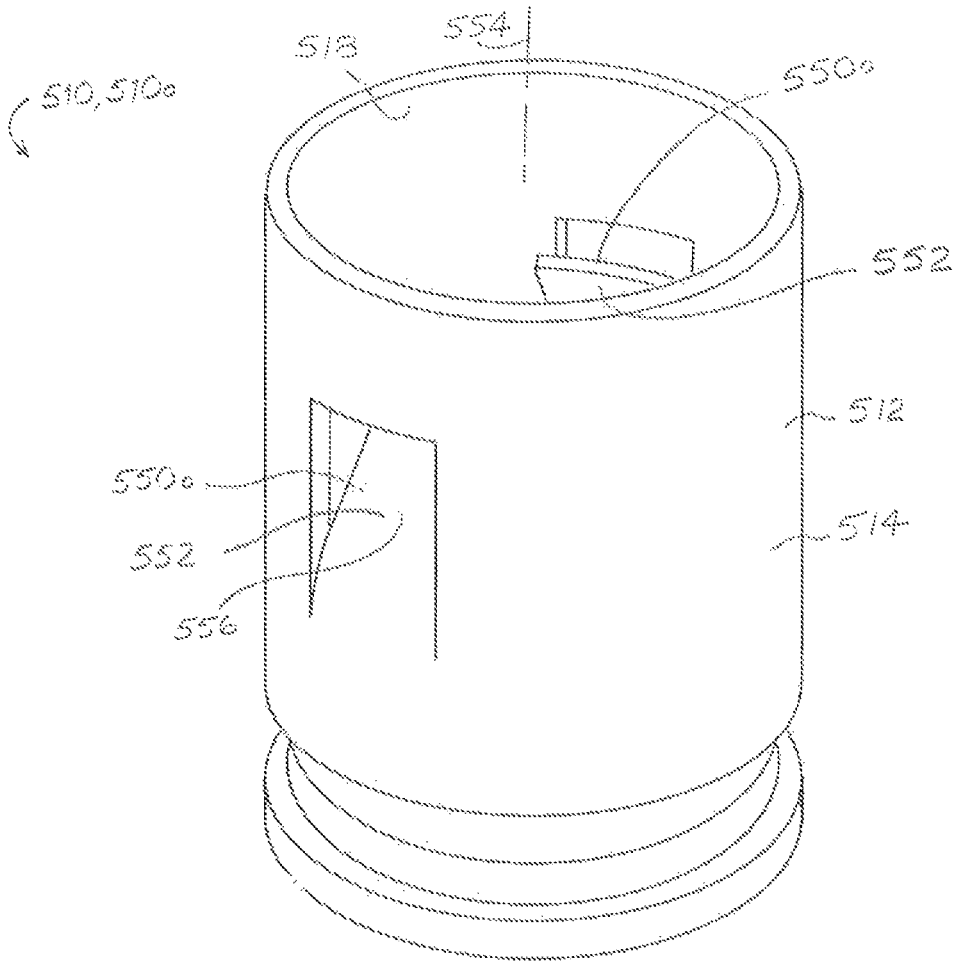
FIGS. 34 and 35 are perspective views of external reinforcement sleeves with punch tab retention features according to embodiments of the disclosure.
Figure 34A:
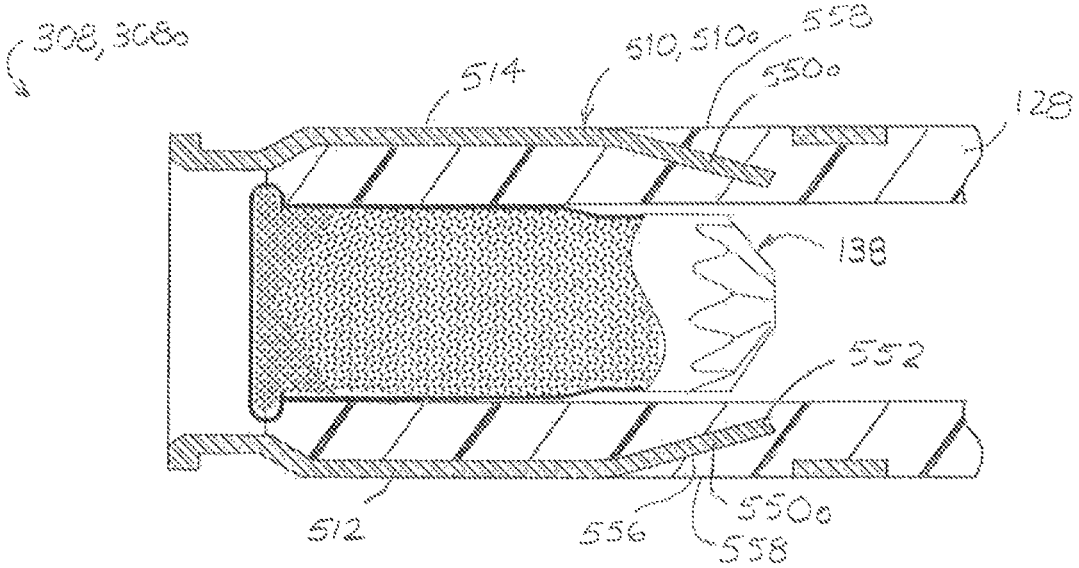
FIGS. 34A and 35A are sectional views of the external reinforcement sleeves of FIGS. 34 and 35, respectively, in a molded configuration with a polymer casing according to an embodiment of the disclosure.
Figure 35:
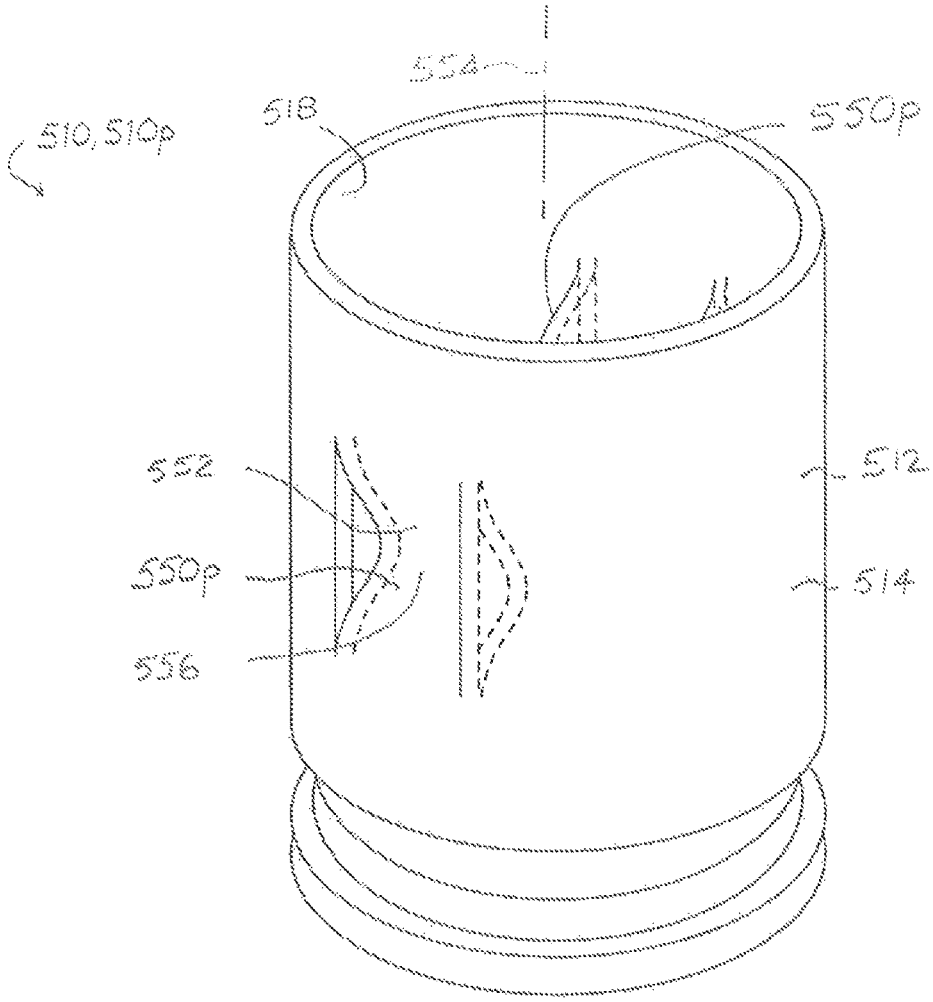
Figure 35A:
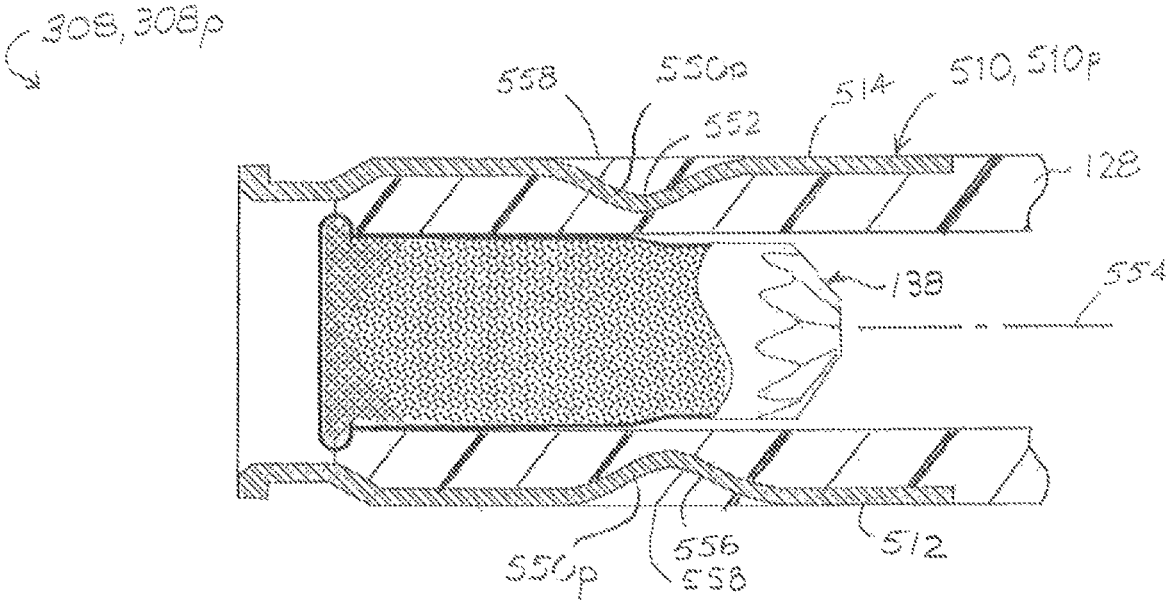

In some embodiments, reinforced reduced energy cartridges 308*o* and 308*p* utilize an external reinforcement sleeve 510*o* and 510*p*, respectively, the reinforcement sleeves 510*o*, 510*p* each include a punched retention feature 550*o*, 550*p*, respectively (FIGS. 34, through 35A). The punched retention feature 550*o*, 550*p* includes a section 552 that is partially cut from the sleeve portion 512 and deformed radially inward toward a centerline 554 of the external reinforcement sleeve 510*o*, 510*p*. The radially inward deformation of the section 552 enables at least a portion of the punched retention feature 550*o*, 550*p* to be recessed from the outer surface 514 of the sleeve portion 512, such that an outer surface 556 of the section 552 is in fluid communication with the sleeve lumen 518. During the molding process, the polymer floods the recess so that a portion of the punched retention feature 550*o*, 550*p* becomes imbedded polymer case wall 128, thereby anchoring the external reinforcement sleeve 510*o*, 510*p* to the polymer case 104. Accordingly, there are exposed portions 558 of polymer on the external reinforcement sleeve 510*o*, 510*p*.

Figure 36:
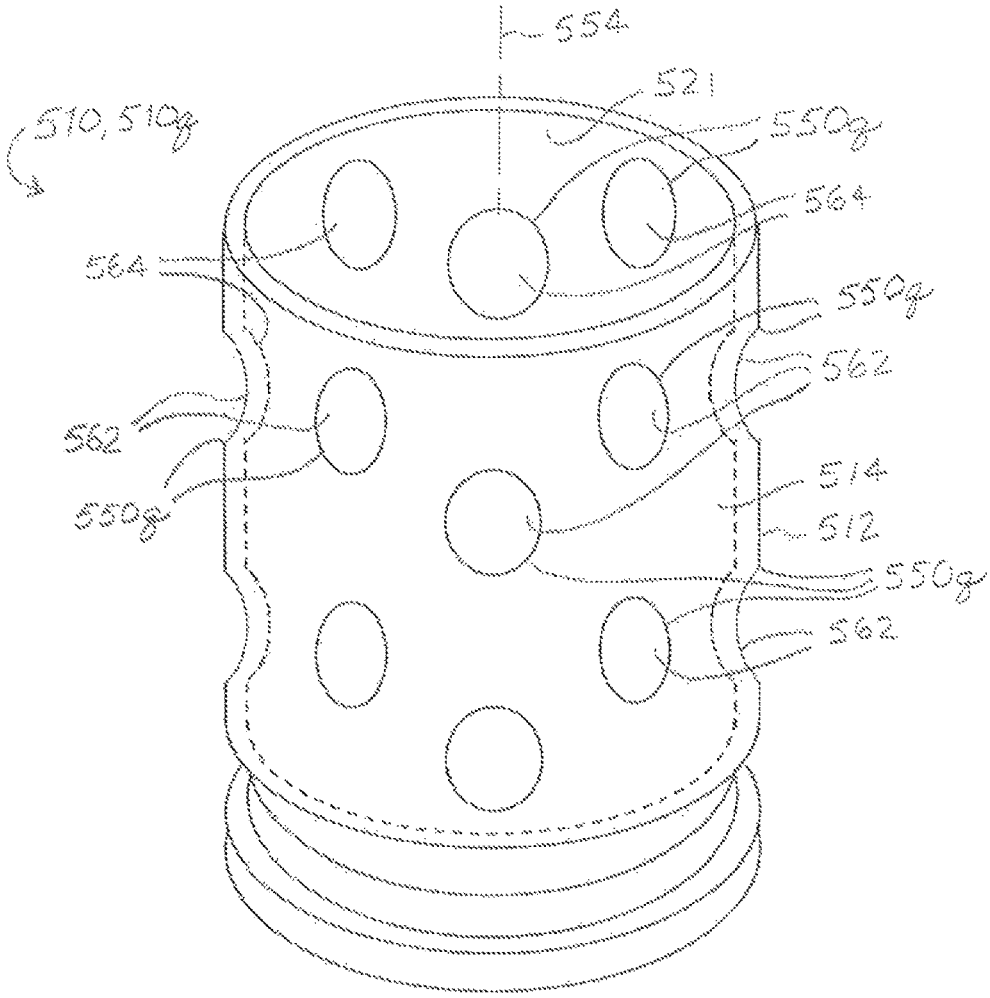
FIG. 36 is a perspective view of an external reinforcement sleeve with dimpled retention features according to an embodiment of the disclosure.
Figure 36A:
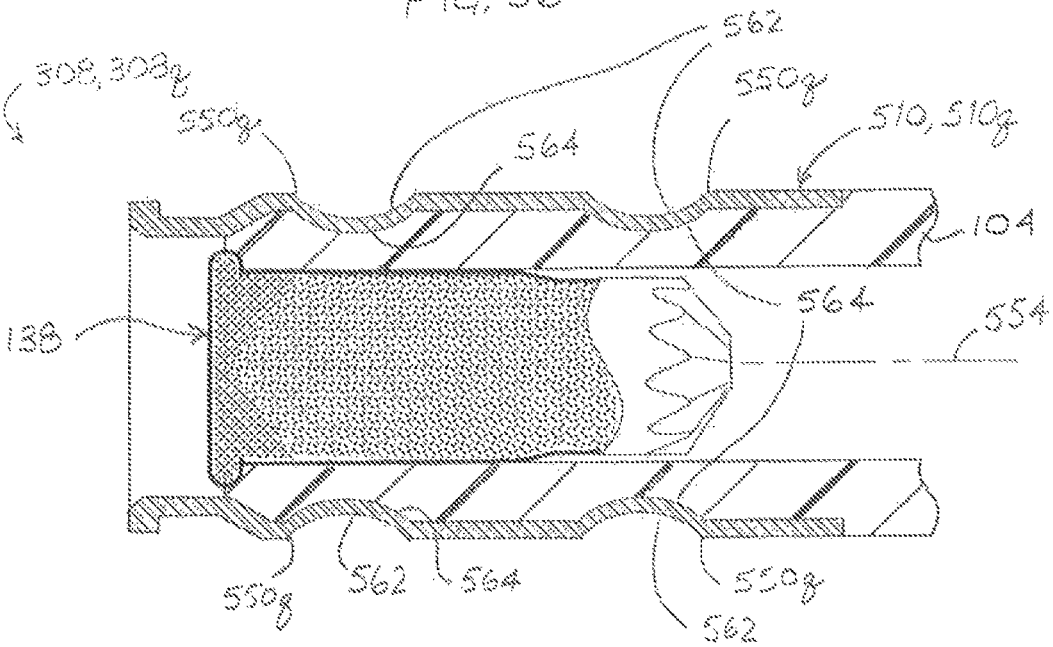
FIG. 36A is a sectional view of the external reinforcement sleeve of FIG. 36 in a molded configuration with a polymer casing according to an embodiment of the disclosure.

In some embodiments, a reinforced reduced energy cartridge 308*q* includes an external reinforcement sleeve 510*q* having dimple retention features 550*q* (FIGS. 36 and 36A). The dimple retention features 550*q* define concavities 562 on the outer surface 514 of the sleeve portion 512 and convexities 564 on the interior surface 521 of the sleeve portion 512, the convexities 564 extending radially inward toward the centerline 554 of the external reinforcement sleeve 510*q*. During the molding process, the polymer flows over and between the convexities 564 to conform to the three-dimensional surface on the interior surface 521 of the sleeve portion 512, effectively securing the polymer case 104 to the external reinforcement sleeve 510*q*.

Figure 37:
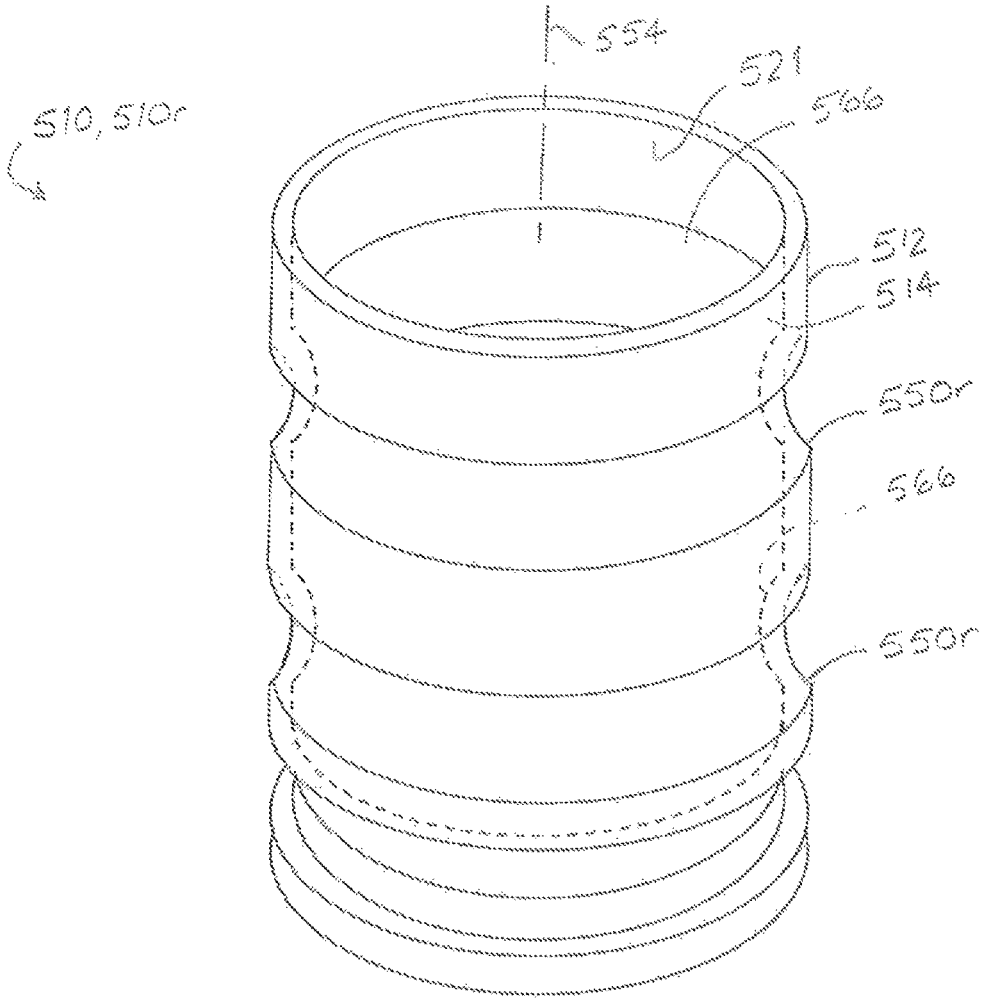
FIG. 37 is a perspective view of an external reinforcement sleeve with ribbed retention features according to an embodiment of the disclosure.
Figure 37A:
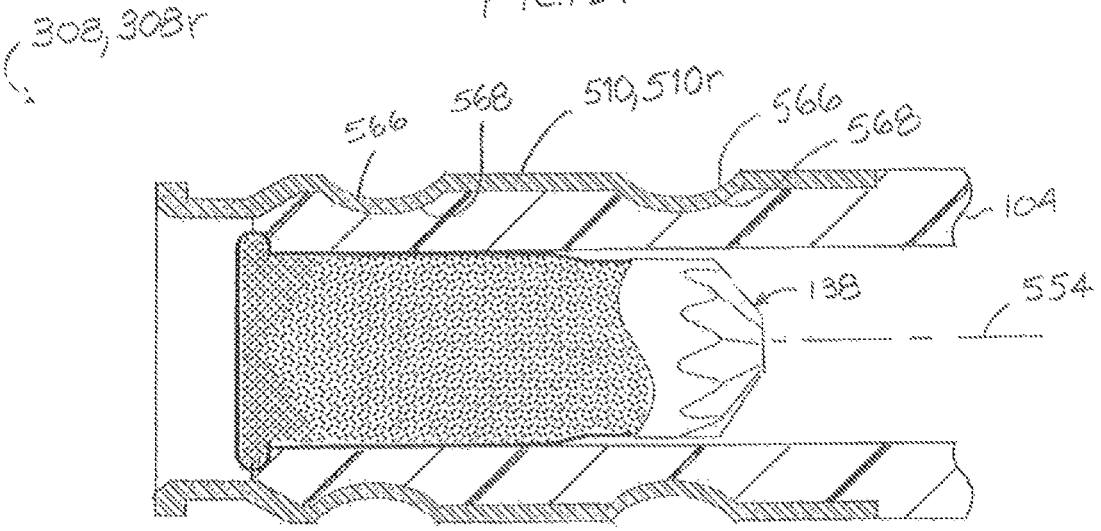
FIG. 37A is a sectional view of the external reinforcement sleeve of FIG. 37 in a molded configuration with a polymer casing according to an embodiment of the disclosure.

In some embodiments, a reinforced reduced energy cartridge 308*r* includes an external reinforcement sleeve 510*r* having at least one ribbed retention feature 550*r* (FIGS. 37 and 37A). Each ribbed retention feature 550*r* defines an annular protruding ring 566 on the interior surface 521 of the sleeve portion 512, the annular protruding ring 566 extending radially inward toward the centerline 554 of the external reinforcement sleeve 510*r*. During the molding process, the polymer flows over the annular protruding ring 566 to form a complementary groove 568 that mates with the annular protruding ring 566 to secure the polymer case 104 to the external reinforcement sleeve 510*r*.

Figure 38:
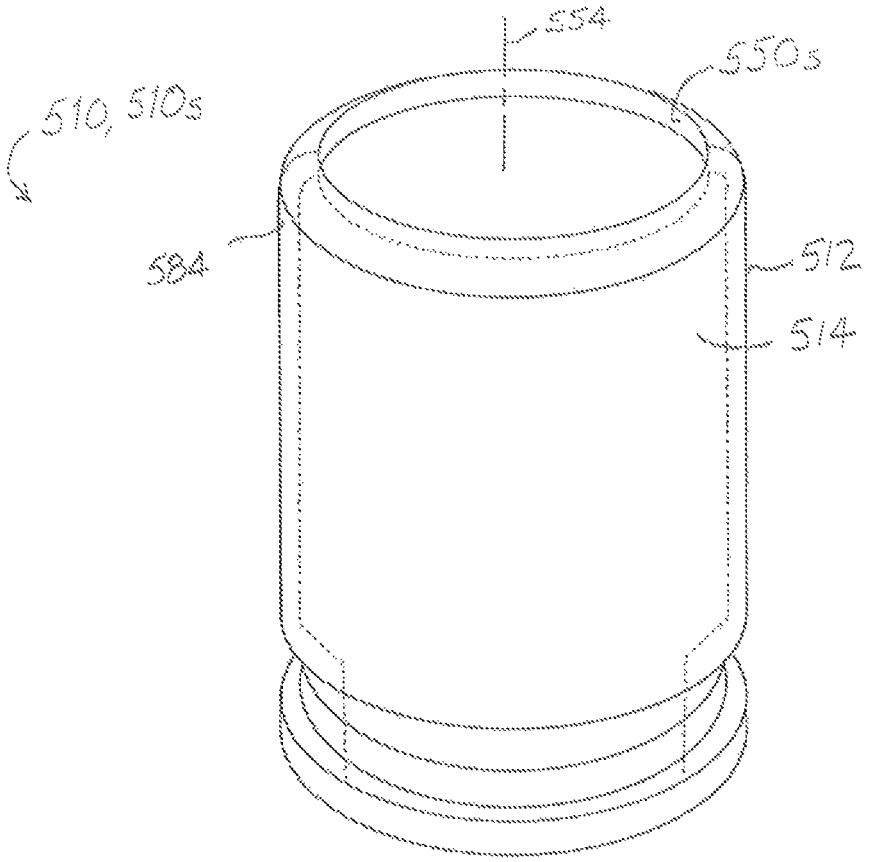
FIG. 38 is a perspective view of an external reinforcement sleeve with a distal end radial protrusion retention feature according to an embodiment of the disclosure.
Figure 38A:
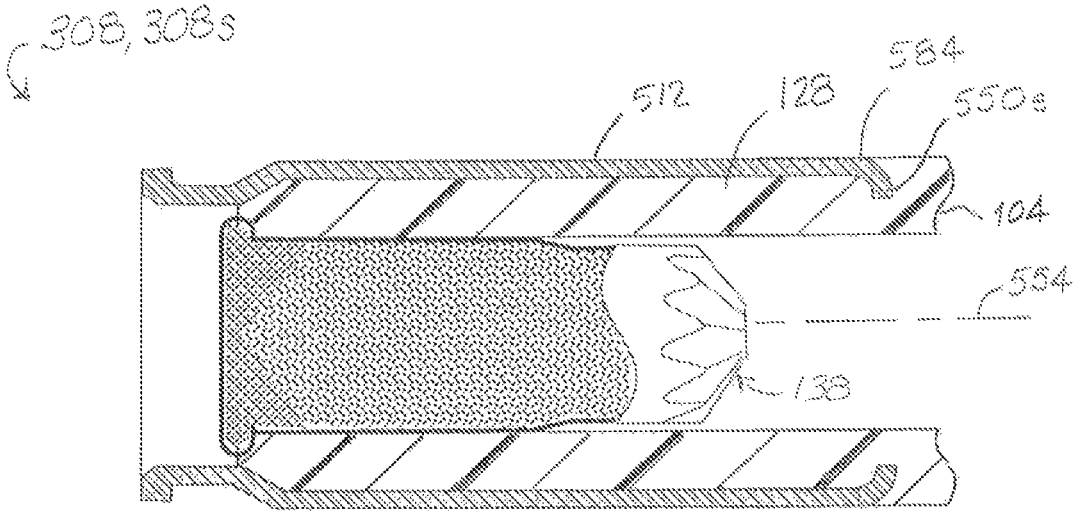
FIG. 38A is a sectional view of the external reinforcement sleeve of FIG. 38 in a molded configuration with a polymer casing according to an embodiment of the disclosure.
Figure 39:
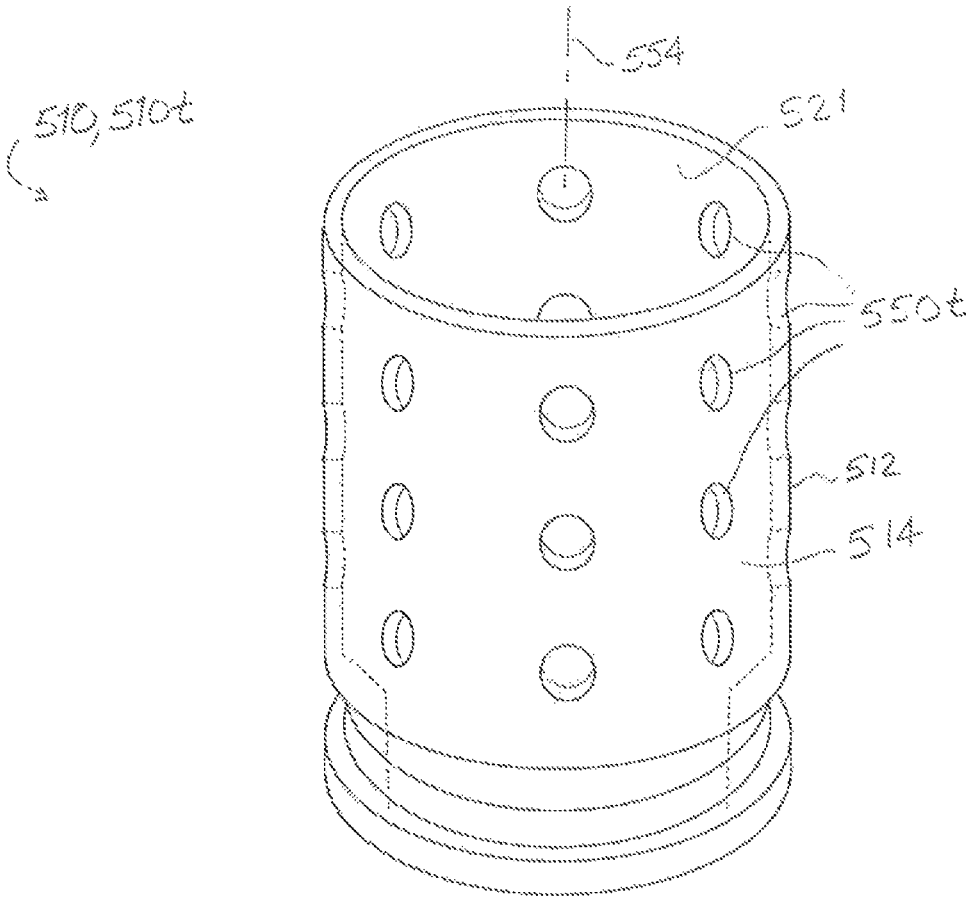
FIG. 39 is a perspective view of an external reinforcement sleeve with perforated retention features according to an embodiment of the disclosure.
Figure 39A:
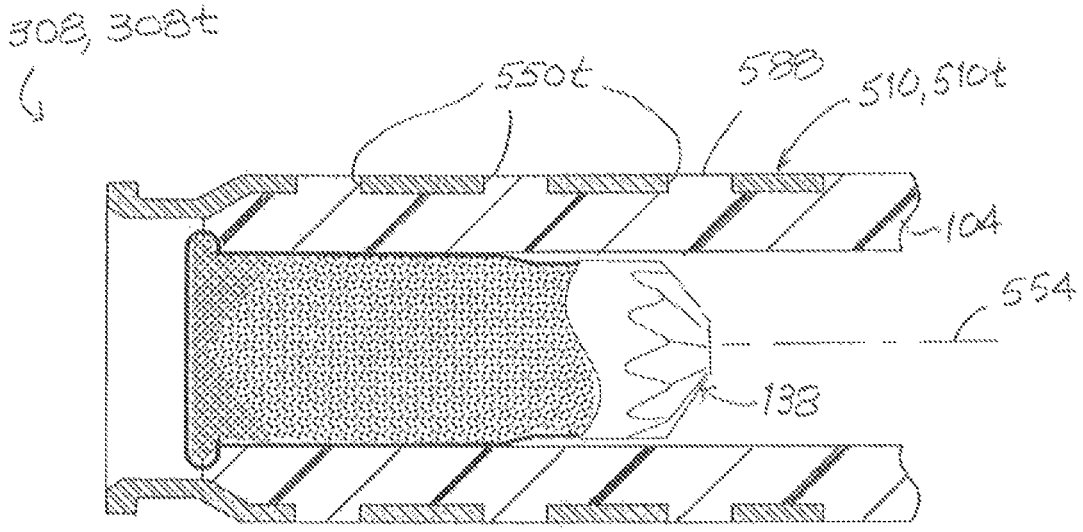
FIG. 39A is a sectional view of the external reinforcement sleeve of FIG. 39 in a molded configuration with a polymer casing according to an embodiment of the disclosure.

In some embodiments, a reinforced reduced energy cartridge 308*s* includes an external reinforcement sleeve 510*s* (FIGS. 38 and 38A) having a radial protrusion retention feature 550*s* that extends radially inward (i.e., toward the centerline 554 of the external reinforcement sleeve 510*s*) from a distal end 584 of the sleeve portion 512. At least a portion of the radial protrusion retention feature 550*s* extends into and is imbedded within the polymer case wall 128 of the reinforced reduced energy cartridge 308*s* to anchor the external reinforcement sleeve 510*s* to the polymer case 104.

In some embodiments, a reinforced reduced energy cartridge 308*t* includes an external reinforcement sleeve 510*t* (FIGS. 39 and 39A) having a plurality of through-apertures 550*t* that pass through a thickness of the sleeve portion 512. In some embodiments, the through-apertures 550*t* are of large enough diameter for the polymer to flood through, so that there is an exposed portion 588 of polymer on the external reinforcement sleeve 510*t* (depicted). In some embodiments, the through-apertures 550*t* are of small diameter, more akin to the perforations 360 of reinforcement liner 310*a*, to effectively provide a textured surface on the interior surface 521 of the sleeve portion 512.

Functionally, the external reinforcement sleeve 510 surrounds the base 146 of the polymer case 104 and partially captures the proximal end 362 of the base 146, thereby enabling the reinforced reduced energy cartridge 308 to withstand the forces incurred during discharge of the propellant unit 138 and prevent rupturing of the polymer case wall 128 of the reinforced reduced energy cartridge 308. Because the polymer case wall 128 effectively lines sleeve portion 512, there is no path for expanding gasses to leak between the external reinforcement sleeve 510 and the polymer case wall 128.

The radiused inner surface 336 of the base 146 may be substantially conformal to the hollow rim portion 149 of the propellant unit 138 to prevent deformation of the hollow rim portion 149 when inserted into the base 146. The inner diameter of the polymer case wall 128 may be dimensioned for a slight interference fit with the propellant unit 138, requiring a light press fit of the propellant unit 138 into the polymer case 104, thereby securing the propellant unit during shipping and handling. Embodiments utilizing the external reinforcement sleeve 510 may also include a tangentially extending relief groove (not depicted), akin to the tangentially extending relief groove 366 of the reinforced reduced energy cartridge 308*b*, for the same function and utility. Embodiments utilizing the external reinforcement sleeves 510 may also incorporate polymer casings with body lumens 374 of reduced diameter (not depicted) relative to the base lumen 140, akin to reinforced reduced energy cartridge 308*e* (FIG. 21C) for the same utility and benefit.

The external reinforcement sleeves 510 may be fabricated by techniques known to the artisan, for example by stamping, milling, injection molding (including metals), or casting. The external reinforcement sleeve 510 may be fabricated from any material strong enough to withstand the forces incurred during discharge of the propellant unit 138, such as metals or high strength epoxies.

The following United States patents are hereby incorporated by reference herein in their entirety except for patent claims and express definitions contained therein: U.S. Pat. Nos. 9,273,941; 9,261,335; 9,003,973; 8,875,633; 8,869,702; 8,763,535; 8,726,560; 8,590,199; 8,573,126; 8,561,543; 8,453,367; 8,443,730; 8,240,252; 8,146,505; 7,984,668; 7,621,208; 7,444,775; 7,441,504; 7,278,358; 7,225,741; 7,059,234; 6,931,978; 6,845,716; 6,752,084; 6,625,916; 6,564,719; 6,439,123; 6,178,889; 5,677,505; 5,492,063; 5,359,937; 5,216,199; 4,955,157; 4,169,329; 4,098,016; 4,069,608; 4,058,922; 4,057,003; 3,776,095; and 3,771,415. Components illustrated in the incorporated by reference references may be utilized with embodiments herein. Incorporation by reference is discussed, for example, in MPEP section 2163.07(B).

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects.

The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A modern sporting rifle for firing reduced energy ammunition with a casing comprising a size conforming to one of a .223 Remington, a 5.56×45 mm NATO, 7.62×51 mm NATO, and a 7.62×38 mm cartridge, the modern sporting rifle comprising:

a barrel comprising:

a firing chamber sized for one of 223 Remington, a 5.56×45 mm NATO cartridge, 7.62×51 mm NATO, and a 7.62×38 mm cartridge, the barrel comprising:

a gas port, a bolt assembly movable into and out of an in-battery position, the bolt assembly configured to move out of the in-battery position by blowback provided by rearward force exerted on the bolt assembly by a fired cartridge in the firing chamber, and a recoil spring configured to return the bolt assembly back to the in-battery position, the bolt assembly comprising: a bolt carrier and a bolt insert, the bolt insert comprising a forward projection sized to be inserted beyond a rear face of the cartridge and comprising a partial or complete ring shaped surface, the bolt carrier comprising a firing pin extending through the bolt insert and offset from the center of the bolt, the firing pin configured to move axially within the bolt insert.

2. The modern sporting rifle of claim 1 wherein the bolt carrier does not comprise a gas key for rearward cycling.

3. The modern sporting rifle of claim 1 in combination with the ammunition, each cartridge of the ammunition comprising:

a projectile, a casing extending from a forward edge of the casing to a rear face of the casing, and a power load comprising propellant, the power load configured to provide reduced energy relative to the energy of a conforming standard rifle cartridge, the power load being recessed from the rear face of the casing, wherein the forward projection of the bolt insert is configured to engage the power load.

4. The combination of claim 3, wherein the power load is a .22 caliber power load configured to provide a muzzle energy of the projectile of 50 ft-lbf to 400 ft-lbf.

5. The combination of claim 3, the casing formed of a polymer and comprising a size conforming to one of a .223 Remington, a 5.56×45 mm NATO cartridge, 7.62×51 mm NATO, and a 7.62×38 mm cartridge, wherein the power load is configured to provide a muzzle energy of the projectile of 15 ft-lbf to 250 ft-lbf.

6. The combination of claim 3, the bolt insert comprising a first portion fixed within a cavity defined by the bolt carrier and a second portion extending forwardly beyond the bolt carrier, the second portion comprising the ring shaped surface and only two lugs, the ring shaped surface configured to engage the rear face of the casing.

7. The combination of claim 3, wherein the bolt carrier is formed of a polymer comprising at least one of nylon and polyamide material, the firing pin is formed of a metal, and wherein the bolt assembly weighs less than about 300 grams.

8. The combination of claim 3, the bolt assembly further comprising tuning means for facilitating reliable cycling.

9. A converted modern sporting rifle in combination with reduced energy ammunition, the modern sporting rifle converted from gas operation to blowback operation, the modern sporting rifle before conversion comprising a conventional bolt assembly weighing greater than 10 ounces, a first recoil spring for the bolt assembly, and a firing chamber sized for one of a .223 Remington, a 5.56×45 mm NATO cartridge, 7.62×51 mm NATO, and a 7.62×38 mm cartridge, the modern sporting rifle after conversion comprising:

a replacement bolt assembly comprising a bolt carrier with a bolt insert fixed within the bolt carrier, the bolt insert comprising forward lugs and a forward face sized for a cartridge of the reduced energy ammunition, and a metal firing pin extending through the bolt insert, axially movable within the bolt insert, and offset from the center of the bolt insert;

the reduced energy ammunition comprising a cartridge with an exterior casing sized to conform with one of .223 Remington, a 5.56×45 mm NATO cartridge, 7.62×51 mm NATO, and a 7.62×38 mm cartridge, the cartridge comprising a case comprising a reduced energy power load with propellant fixed in the case, a projectile, the projectile weight and the ropellant selected to provide a muzzle energy of the projectile leaving the rifle in the range of about 50 ft-lbf to 400 ft-lbf, and wherein the mass of the replacement bolt assembly is configured such that the replacement bolt assembly is configured to move in a rearward direction and compress the first recoil spring by a distance upon firing of the cartridge, the distance being large enough so that the casing of the cartridge is ejected and a second cartridge of the reduced energy ammunition is fed into the firing chamber by blowback operation of the rifle.

10. The combination of claim 9, wherein the replacement bolt assembly weighs less than 7 ounces.

11. The combination of claim 9, wherein the bolt insert comprises a metal, and wherein the bolt carrier is formed by injection molding a polymer with the bolt insert positioned in a mold prior to a molten polymer being injected into the mold.

12. The combination of claim 9, the case of the cartridge comprising a polymer, and wherein the replacement bolt assembly is configured to move the cartridge into the chamber and extract the casing of the cartridge from the chamber after the projectile has been fired through a barrel of the modern sporting rifle.

13. The combination of claim 9, the modern sporting rifle further comprising a receiver housing and a barrel extending forwardly from a forward end of the receiver housing, and the projectile is dimensioned to be received in a bore of the barrel.

14. The combination of claim 9, wherein the first recoil spring is an original recoil spring of the rifle before conversion;

the rifle comprises the first recoil spring disposed in a lumen defined by a receiver extension, the receiver extension extending in a rearward direction from a receiver housing; and the first recoil spring is configured to bias the replacement bolt assembly in a forward direction.

15. The combination of claim 9, the bolt insert further comprising only two lugs.

16. The combination of claim 9, the replacement bolt assembly further comprising tuning means for facilitating reliable cycling.

17. A converted modern sporting rifle in combination with reduced energy ammunition, the modern sporting rifle converted from gas operation to blowback operation, the modern sporting rifle before conversion comprising a conventional steel bolt assembly weighing greater than 10 ounces, and a firing chamber sized for one of a .223 Remington, a 5.56×45 mm NATO, 7.62×51 mm NATO, and a 7.62×38 mm cartridge, the modern sporting rifle after conversion comprising:

a replacement bolt assembly comprising a polymer bolt carrier with a metal bolt insert fixed to the polymer bolt carrier, the bolt insert comprising forward lugs, a raised portion, a forward face on the raised portion, and radiused relief shoulders at the base of the raised portion, the forward face sized to be inserted beyond a rear face of the cartridge;

the reduced energy ammunition comprising at least one cartridge with an exterior casing sized to conform with one of a .223 Remington, a 5.56×45 mm NATO 7.62×51 mm NATO, and a 7.62×38 mm cartridge, the at least one cartridge comprising a case comprising a rear face and formed from a polymer, a power load with propellant comprising an anvil recessed from the rear face of the case, the case defining pathway to a projectile, the projectile weight and the propellant selected to provide a muzzle energy of the projectile leaving the rifle of less than about 840 ft-lbf, and the mass of the replacement bolt assembly is configured to, upon firing of the at least one cartridge, eject the casing from the firing chamber and feed a second cartridge of the reduced energy ammunition into the firing chamber by blowback operation of the rifle.

18. The combination of claim 17, wherein the recoil spring is an original steel recoil spring of the rifle before conversion, and the replacement bolt assembly is biased in a forward direction by the original recoil spring and is configured to translate in a rearward direction upon firing of the rifle to effect cycling of the rifle through blowback operation.

19. The combination of claim 17, wherein the bolt insert comprises a metal and only two lugs, the replacement bolt assembly further comprising a metal firing pin extending through the bolt insert, axially movable within the bolt insert, and offset from the center of the bolt insert, and wherein the replacement bolt assembly weighs less than about 300 grams.

20. The combination of claim 17, wherein the mass of the replacement bolt assembly is selected such that the replacement bolt assembly is configured to move in a rearward direction and is configured to compress a recoil spring by a distance upon firing of the at least one cartridge, the distance being large enough so that the casing is ejected and the second cartridge of the reduced energy ammunition is fed into the firing chamber by blowback operation of the rifle, and the replacement bolt assembly further comprises tuning means for facilitating reliable cycling.

* * * * *